US005873058A

United States Patent [19]

Yajima et al.

[11] Patent Number: 5,873,058

[45] Date of Patent: Feb. 16, 1999

[54] VOICE CODING-AND-TRANSMISSION SYSTEM WITH SILENT PERIOD ELIMINATION

[75] Inventors: Hisashi Yajima; Noriaki Kawano; Yushi Naito; Shigeaki Suzuki, all of Tokyo, Japan

[73] Assignee: Mitsubishi Denki Kabushiki Kaisha, Tokyo, Japan

[21] Appl. No.: 824,520

[22] Filed: Mar. 26, 1997

[30] Foreign Application Priority Data

| | | | |
|---|---|---|---|
| Mar. 29, 1996 | [JP] | Japan | 8-077761 |
| Dec. 9, 1996 | [JP] | Japan | 8-328925 |

[51] Int. Cl.[6] ..... G10L 3/00

[52] U.S. Cl. ..... 704/201; 704/230

[58] Field of Search ..... 204/200, 201, 204/208, 209, 210, 215, 226, 227, 228, 222, 230

[56] References Cited

U.S. PATENT DOCUMENTS

| | | | |
|---|---|---|---|
| 5,148,429 | 9/1992 | Kudo et al. | 370/3.42 |
| 5,151,923 | 9/1992 | Fujiwara | 375/5 |
| 5,241,535 | 8/1993 | Yashikawa et al. | 370/60 |
| 5,297,147 | 3/1994 | Shimokasa | 375/241 |
| 5,475,712 | 12/1995 | Sasaki | 375/241 |
| 5,539,858 | 7/1996 | Sasaki et al. | 704/212 |
| 5,654,964 | 8/1997 | Wake | 370/395 |

FOREIGN PATENT DOCUMENTS

| | | |
|---|---|---|
| 61-275900 | 12/1986 | Japan . |
| 63-127300 | 5/1988 | Japan . |
| 2-181522 | 7/1990 | Japan . |
| 3-101457 | 4/1991 | Japan . |
| 4-284742 | 10/1992 | Japan . |
| 4-357735 | 12/1992 | Japan . |
| 4-362830 | 12/1992 | Japan . |
| 5-19789 | 1/1993 | Japan . |
| 5-73085 | 3/1993 | Japan . |
| 5-244104 | 9/1993 | Japan . |
| 5-297895 | 11/1993 | Japan . |
| 5-300091 | 11/1993 | Japan . |
| 5-316055 | 11/1993 | Japan . |
| 6-216860 | 8/1994 | Japan . |
| 7-74650 | 3/1995 | Japan . |
| 7-84597 | 3/1995 | Japan . |

*Primary Examiner*—Richemond Dorvil
*Attorney, Agent, or Firm*—Burns, Doane, Swecker & Mathis, LLP

[57] ABSTRACT

In a voice coding-and-transmission system using a differential coding, a degradation of voice quality caused by a silent period transmission network and an ATM network is prevented without improving a silent-period elimination transmission network and existing transmission networks such as a STM network. In a relay node 104, an encoder 114 codes a voice signal from a decoder 108 again for a transient period immediately after a voice is started, and a transmission node 100 and a reception node 102 are tandem-connected. The encoder 114 and a decoder 122 at a reception node 102 are given respectively same reference values of a differential processing by memories 118, 128 when the voice is started, thereby preventing an abnormal sound generation due to a mismatch of inner statuses thereof when the voice is started. During the transient period, the internal statuses of an encoder 106 at a reception node 100 and the decoder 122 are closed each other. After the transient period is elapsed, switching a switch in a silent-period eliminator 112 to a digital-one-link, thereby preventing the degradation of the voice quality caused by quantization errors.

35 Claims, 50 Drawing Sheets

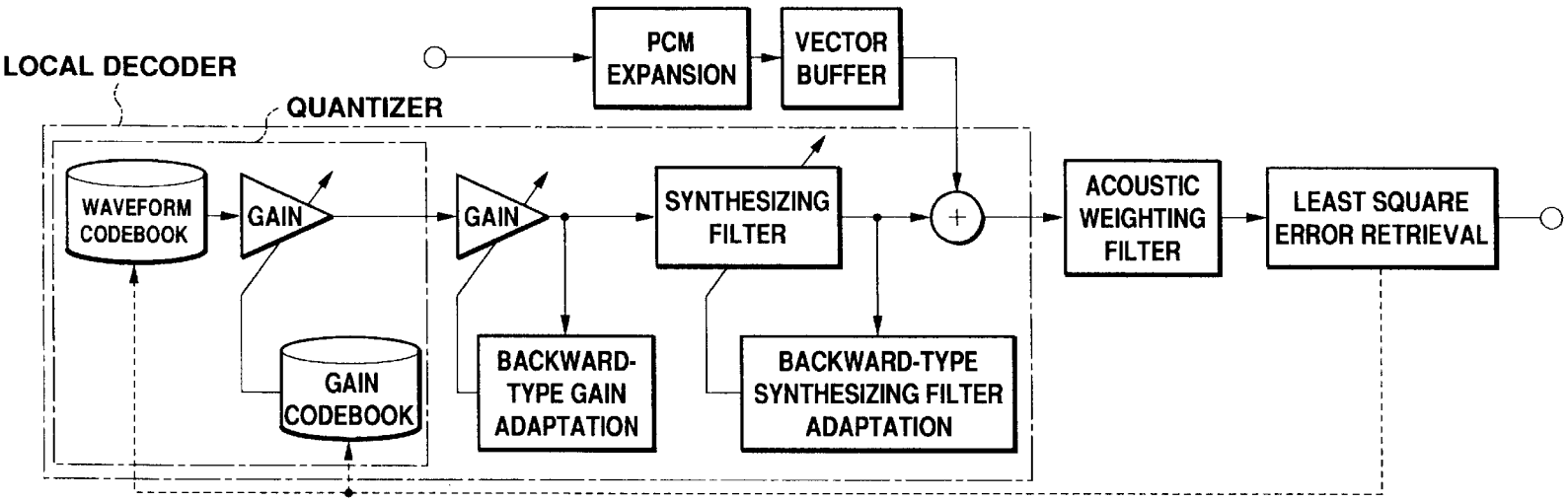
Fig. 46 (a) PRIOR ART
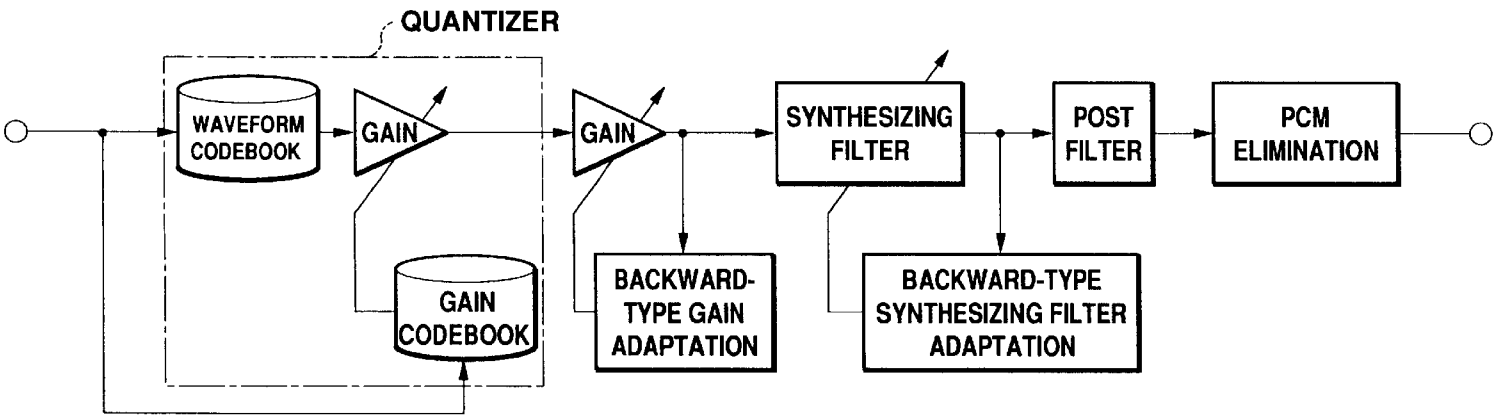
Fig. 46 (b) PRIOR ART

VOICE CODING-AND-TRANSMISSION SYSTEM WITH SILENT PERIOD ELIMINATION

BACKGROUND OF THE INVENTION

1. Field of the Invention

The present invention relates to a voice coding-and-transmission system for compressing and transmitting a voice signal at a high efficiency, with particularly improved voice quality.

2. Description of the Prior Art

In today's age of multimedia communication, communication networks are used not only for voice, as exemplified by the telephone, but also for transmission of images and computer data. Transmission of large amounts of information such as images and computer data is realized by the digital art. That is, information to be transmitted is digital-coded and the switching system is also improved from circuit switching to packet switching. In the future, communication by ATM (Asynchronous Transfer Mode) will be the mainstream technology used to efficiently transmit such varied information.

To more efficiently perform transmission and correspondingly increase the transmitted information content, data to be transmitted is divided into units such as packets or cells which are transmitted by time division multiplexing. Voice transmission has hitherto used a high-efficiency voice coding art for efficiently coding a voice signal by removing redundant components from the signal by differential coding or a similar art.

High-efficiency voice coding systems for performing coding by using a difference include predictive differential coding system such as the ADPCM (Adaptive Differential Pulse Code Modulation) coding system. The predictive differential coding system predicts present signals based on past signals and quantizes differences between values of the predicted signal and values of the actual signal. Because a difference generally has a value smaller than the original data, the number of bits of a code obtained by quantizing the difference is smaller than the number of bits of a code not depending on a difference. A coding part and a decoding part of this system have respective internal states, which are used as a reference value for a differential processing. The internal state consists of a set of parameters which represent the past voice signal.

In a transmission by an ATM network, multiple transmission lines are used by digital-coding information sources such as voice, image, and computer data, dividing the sources into a unit, called a cell, and transmitting asynchronously in a burst mode to improve an efficiency of utilizing the transmission lines. In communication with the ATM network, the above-mentioned high efficiency voice coding technology can be used in combination therewith. As the majority of traffic is due to voice information, applying high efficiency voice coding technology to voice information will reduce transmission amount and achieve higher efficiency transmission.

Moreover, the voice coding system includes the ITU (International Telecommunication Union) Recommendation G.728 coding system (LD-CELP system: Low-Delay Code-Excited Linear Prediction) whose block diagram is shown in FIG. 28 in addition to the above ADPCM. This coding system is described in Draft CCITT Recommendation G.728 "Coding of Speech at 16 Kbits/s using Code Excited Linear Prediction (LD-CELP)" in detail. This coding system is based on the backward adaption for performing adaptation of a synthesizing filter and excitation gain in accordance with past voice signals. This system also has an aggregate of parameters of the past voice signal as an internal state, which is used as a reference for a differential processing of a synthesis filter coefficient, an adaptive gain coefficient, or the like.

Recently, because of a request for higher efficiency as described above, the silent-period elimination art of excluding a silent part when transmitting a voice signal has been used. It is known that the silent-period elimination art can decrease the total quantity of voice signals to be transmitted to a transmission line with a small voice-quality degradation and realizes higher-efficiency voice transmission according to a statistical multiplication effect. In the case of the silent-period-eliminated voice transmission system, however, operations of a decoding part for receiving and decoding a differential-coded voice signal become indefinite because there is no voice information transmitted during silent periods. That is, when a silent state (this may be referred to as a state with no talk spurt) changes to a voiceful state (this may be referred to as a state with a talk spurt), the internal state of an coding part for generating a voice code does not coincide with that of a decoding part. Therefore, the decoding part is not always able to decode a correct voice signal, even if the part is given a correct high-efficiency code with no transmission line error. This phenomenon frequently appears as uncomfortable abnormal sounds, such as a click or oscillation sound, in a regenerated sound at a reception node.

FIG. 45 is a block diagram of a conventional voice coding-and-transmission system for solving the above problem. This diagram is based on the block diagram shown in Japanese Patent Laid-Open No. Hei 2-181552.

This voice transmitting system forms a set of structures by a transmission node 2 and a reception node 4. Under a state with a talk spurt, that is, at a voicefilled period, the transmission node 2 codes a voice signal using a high-efficiency voice encoder 6 and transmits the signal to a transmission line 10 via a changeover switch 8. Because the changeover switch 8 of the transmission node 2 is switched so as to transmit no data to the transmission line 10 with no talk spurt, that is, at a silent time, a silent-period-eliminated voice code is transmitted from the transmission node 2. A voice detector 12 detects a voice or silence of a voice signal and switches the changeover switch 8.

The reception node 4 decodes a voice code sent from the transmission line 10 to a voice signal by a decoder 14 and outputs the signal. While silent period elimination is performed, the changeover switch 16 is switched to the pseudo-background-noise signal generator 18 side and artificial noises are output from the reception node 4. A voice/silence information extractor 20 detects voice or silence in accordance with a voice code and switches the changeover switch 16. In this system, the transmission node 2 is provided with a memory 22 storing a predetermined internal state of the encoder 6, while the reception node 4 is provided with a memory 24 storing the same content with the memory 22. Moreover, at the transition which a voice signal changes from a silent state to a voiceful state and causes the above problem, the voice detector 12 and the voice/silence information extractor 20 synchronously detect the transition, a reference value for differential processing is set from the memory 22 to the encoder 6 as an internal state in the transmission node 2, and the same reference value for differential processing as that of the encoder 6 is sent from the memory 24 to the decoder 14 as an internal state in the reception node 4. Thus, the timing in which a talk spurt is detected synchronizes between the transmission node 2 and the reception node 4 and, at this point, both internal states are reset to the same state. Therefore, the internal state of the encoder 6 always coincides with that of the decoder 14 in a voice period and thereby, it is possible to avoid abnormal sound at the head of a talk spurt.

In the future, as described above, a silent-period-eliminating transmission network or an ATM network will mainly be constructed using the above arts.

However, transmission networks that do not eliminate silent periods and STM (Synchronous Transfer Mode) networks have already been constructed. These transmission networks were constructed as an infrastructure, in many cases using a great deal of capital. Therefore, it is economically difficult to immediately replace them with silent-period-eliminating transmission networks or ATM networks, or otherwise improve them. Therefore, to construct a large network including a range covered by these conventional transmission networks, it is necessary to allow networks eliminating silent periods and networks not eliminating silent periods, or ATM network and STM networks to coexist respectively.

For the time being, it is possible to realize coexistence of both networks by connecting two types of networks with a relay node.

There are two methods for connecting the silent-period-eliminating network and the silent period network, as shown in FIGS. 47 and 48. These Figures illustrates a transmission from the silent-period-eliminating network to the silent period network. In addition, there are two methods for connecting the ATM network and the STM network as shown in FIGS. 49 and 50. These Figures illustrates a transmission from the ATM network to the STM network.

FIG. 47 is a block diagram of a transmission system consisting of tandem-connecting networks eliminating silent periods and of networks not eliminating silent period connected through a relay node. In FIG. 47, components having corresponding functions as those in FIG. 45 are provided with the same symbol, and their description is omitted. An encoder 32 of a transmission node 30 of this system performs the coding, not eliminating silent periods, and transmits a generated voice code to a transmission line 34 (transmission line B). A relay node 36 receives the voice code from the transmission line B, silent-period-eliminates the voice code, and transmits the silent-period-eliminated voice code to the reception node 4 through a transmission line A. The relay node 36 decodes the voice code from the transmission node 30 as a voice signal by a decoder 38 and, thereafter, codes the voice signal as a silent-period-eliminated voice code and transmits it to the reception node 4. The processing, after decoding by the decoder 38, uses the silent-period-eliminated transmission system using the synchronous resetting described for FIG. 45. Therefore, in the case of this transmission system, because the relay node 36 performs decoding once and then coding again, the transmission lines A and B are from the viewpoint of coding greatly independent from each other and, this system is therefore referred to as a tandem connection.

FIG. 48 is a block diagram of a transmission system constituted by connecting networks eliminating silent periods and networks not eliminating silent periods by digital-one-link through a relay node. In FIG. 48, components having corresponding function as those in FIG. 47 are provided with the same symbol and their description is omitted. A voice code with no silent period eliminated that is transmitted to the transmission line 34 from the transmission node 30 is silent-period-eliminated by a relay node 50 and transmitted to a reception node 54 through a transmission line 52 (transmission line A).

In the relay node 50, a decoder 56 decodes a voice code sent from a transmission line B to restore a voice signal. A voice detector 58 detects voice or silence (presence or absence of a talk spurt) in accordance with the voice signal and controls a changeover switch 60. The changeover switch 60 connects the transmission line B to the transmission line A only when a voice code with no silent period eliminated from the transmission line B has a talk spurt. When the voice code does not have any talk spurts, it is abandoned and no data is output to the transmission line A. Thereby, a silent-period-eliminated voice code is transmitted to the transmission line A. In this connection, a processing delay unit 62 delays the voice code from the transmission line B by the processing time in the decoder 56 and the voice detector 58 and realize the synchronization between the operation of the changeover switch 60 and the voice code.

The reception node 54 decodes a silent-period-eliminated voice code transmitted from the relay node 50 to the reception node 54 through the transmission line A as a voice signal by a decoder 64 corresponding to the encoder 32 of the reception node 30 and outputs the decoded voice code. When no voice code is input from the transmission line A, that is, while silent period elimination is performed, a voice/silence information extractor 66 switches a changeover switch 68 toward a pseudo-background-noise signal generator 70 to output artificial noise from the reception node 54.

Thus, the relay node 60 only performs switching. Therefore, though a voice code transmitted to the reception node 54 is silent-period-eliminated, the voice code itself is transmitted from the transmission node 30. Therefore, in the case of this transmission system, the transmission lines A and B are well combined with each other and this is thus referred to as a digital-one-link.

FIG. 49 is a block diagram of a conventional transmission system constituted by tandem-connecting the ATM network and the STM network through a relay node. An encoder 73 of a transmission node 72 in the system digitizes a voice signal and performs the coding at a high compression rate. A cell composer 74 assorts a sequential voice code coded with the encoder 73 and transmits the code to a transmission line A. The transmission line A is the ATM network. The voice code is transmitted through the transmission line A in cell units in a burst mode.

In the relay node 75, a buffer 76 absorbs a transmission fluctuation of the cell, and then a cell decomposer 77 decomposes the received cell to produce the sequential voice code. An vanished cell detector 78 detects a dead cell due to a disuse or a delay in the ATM network, and controls operations of each portion in the relay node 75. A decoder 79 decodes a voice code extracted from the cell to an original digital sampling voice signal, for example a PCM (Pulse Code Modulation) voice signal. A synchronous incoming unit 80 mates an operation timing between the decoder 73 and the decoder 79. An vanished cell compensator 81 compensates a voice signal for the vanished cell. A memory 82 stores a latest voice signal for compensating the cell. A selector switch 83 is a switch for selecting either the voice signal decoded in the decoder 79 or the voice signal compensated the vanished cell. An encoder 84 is same as the encoder 73. A transmission line B is the STM network. A reception node 85 has a decoder 86 corresponding to the decoder 79.

For voice communication, a real time ability is required. Therefore, a retransmission procedure that a data communication utilizes cannot be applied thereto, if a cell disuse occurs which is a specific cause of degrading of the ATM network. Especially, in an ATM voice communication combining with the high-efficiency coding, cell size is fixed at 53 bytes. With a more efficient coding method, more information can be accommodated in one cell, resulting in greater damage in regenerated voice due to cell disuse. Consequently, to realize a high quality voice transmission with the ATM, a processing for regenerating a natural voice is necessary for interpolating/assuming the information included in the vanished cell.

The system as shown in FIG. 49 utilizes the following method as one countermeasure against cell vanishing. The vanished cell detector 78 monitors cells reaching the relay node 75, detects disappeared cells in the ATM network or those not reaching the relay node 75 within a predetermined period, and sends a control signal based on the detection results to the vanished cell compensator 81 and the selector switch 83. As a method for detecting the vanished cell, the cell composer 74, for example, adds an index representing a sending order to a pay load portion of the cell, and the vanished cell detector 78 monitors whether or not the index is lost.

Once the vanished cell detector 78 notifies the vanished cell compensator 81 of an elimination of the cell, the vanished cell compensator 81 interpolates / extrapolates or mutes the lost voice signal based on a past voice signal stored in the memory 82. In addition, the selector switch 83 chooses between an output of the decoder 79 and an output signal of the vanished cell compensator 81 based on a control signal from the vanished cell detector 78. Chosen signal is reapplied the high efficiency coding with the encoder 84, and is sent to the transmission line B (STM network). Thereby, a voice code with reduced cell vanishing damage is sent from the relay node 75.

In the relay node 75, coding is performed again after the voice code is decoded. Therefore, the transmission system has mutually highly independent transmission lines A and B in view of coding. For this reason the system is called the tandem connection system.

As a voice high efficiency coding algorithm used in the encoders 73, 84 and the decoders 79, 86, ITU-T Recommendation G.726/727 ADPCM (Adaptive Differential Pulse Code Modulation), ITU-T Recommendation G.728 LD-CELP (Low-Delay Code-Excited Linear Prediction), and ITU-T Recommendation G.729 CS-ACELP (Conjugate Structure Algebraic Code Excited Linear Prediction) or the like is well known.

FIG. 50 is a block diagram of a conventional transmission system consisting of digital-one-linking the ATM network and the STM network through a relay node. Components in FIG. 50 having corresponding functions as those in FIG. 49 are provided with the same symbol and their description is omitted. A cell including high efficiency voice code which is sent from the transmission node 72 to the transmission line A (ATM network) is decomposed by the relay node 90, remounted to a synchronous frame, and then transmitted to the reception node 85 through the transmission line B (STM network).

The reception node 85 decodes the voice code, which is transmitted from the relay node 90 through the transmission line B, using the decoder 86 corresponding to the encoder 73 at the transmission node 72, and outputs the decoded voice code. Thus, the relay node 90 only performs a switching. The voice code for transmitting to the reception node 85 is a signal sent from the transmission node 72 itself. Therefore, the transmission system has mutually highly integrated transmission lines A and B in view of encoding. This is a reason that the system is called the digital-one-link system.

Connecting the transmission lines A and B according to a tandem connection or digital-one-link has the following problems. In the case of tandem-connecting a network eliminating silent period and a network not eliminating silent period as shown in FIG. 47, a voice code from the transmission node 30 is once decoded to a voice signal and then transmitted in accordance with the silent period elimination using synchronous resetting. Therefore, the internal state of the encoder 6 of the relay node 36 coincides with that of the reception node 4 and abnormal sound is avoided as described above. However, because the processing of decoding and coding a voice code is performed in a relay node, a voice signal input to a transmission node is coded and decoded twice before it is output from a reception node. Therefore, a problem occurs that quantization errors are accumulated and the quality of a voice signal output from the reception node 4 deteriorates. It is known that the above quality degradation becomes more remarkable as an elimination rate increases, though the quality degradation is almost inconsequential at a high bit rate (16 Kbit/s or more). Because a voice transmission system uses a low bit rate, it is impossible to ignore the above voice quality degradation. This is entirely applicable to the transmission system combined with the high efficiency coding where the ATM network and the STM network is tandem-connected as shown in FIG. 49.

However, in the case of connecting a network eliminating silent period and a network not eliminating silent period according to digital-one-link as shown in FIG. 48, the conditions are completely reversed. In this case, because a voice code corresponding to presence of a talk spurt transmitted to the reception node 54 is the same as a voice code generated in the transmission node 30, voice-signal quality degradation due to accumulation of quantization errors is prevented. However, the internal state of the encoder 32 of the transmission node 30 does not generally coincide with that of the decoder 64 of the reception node 4 at the timing of change from a silent state to a voiceful state. That is, because reference values of the differences in coding/decoding are different, though the voice codes are same, a problem again occurs that abnormal sound is produced. This abnormal sound is not only unpleasant to a user, but it also causes the problem of extreme degradation of speech content clarity because the abnormal sound is generally produced at the head of a talk spurt.

For a transmission system combining high efficiency coding technology in which the ATM network and the STM network are connected in digital-one-link as shown in FIG. 50, the voice code for transmitting to the reception node 85 is the same as the voice code generated at the transmission node 72. Therefore, voice-signal quality degradation due to an accumulation of quantization errors is prevented. However, in the relay node, only switching is performed and extracting voice information from the voice code is not performed. Normally, it is difficult to directly compensate for the vanished voice code by a simple method such as interpolation/extrapolation/assumption without decoding the voice code applied the high efficiency coding.

Accordingly, it is extremely difficult to remove the impact of the cell vanishing in the relay node of the transmission system, although the cell vanishing itself can be detected. As a result, the voice information transmitted to the reception node 85 is discontinuous to induce an abnormal sound at the reception node 85 making a listener uncomfortable. In addition, a missing phoneme remarkably lowers speech comprehension. Nevertheless, to remove the impact due to the cell vanishing at the reception node 85 nevertheless in the digital-one-link connection, the information about the cell vanishing detected in the relay node may be transmitted to, for example, the STM network by providing a signal line separately, and other mechanism for a countermeasure of the cell vanishing may be provided at the reception node 85. However, connecting the ATM network and the STM network is required in case that the STM network and the reception node 85 are existing systems, as described above. Consequently, the solution of removing the impact due to the cell vanishing at the reception node 85 needs an improvement or alternation of the existing system, and lacks reality.

As described above, conventionally, problems have been existed in housing the transmission network in the silent period transmission network or in the ATM network without improving the voice communication system at a side of existing silent-period-vanished transmission network or a side of existing STM network.

SUMMARY OF THE INVENTION

An object of the present invention is to provide a voice coding-and-transmission system solving the above problems and realizing a high-quality voice transmission at a realistic cost, in which an ATM network and a STM network are coexisted and an existing silent-period-elimination transmission network is housed in a high-efficiency transmission network using a silent period eliminating art together with a high-efficiency voice coding art using a differential coding.

A voice coding-and-transmission system related to the first aspect of the present invention is characterized in that a relay node includes a relay decoder for extracting voice information included in a voice signal from an original voice code, a relay control circuit for discriminating between a voice period and a silent period of said voice signal in accordance with said voice information and outputting a relay control signal for controlling operations of a relay node in accordance with a discrimination result, an coding reference value determination circuit for determining a reference value for differential coding at the start of voicing which is the timing of change from said silent period to said voice period in accordance with said relay control signal, a relay encoder for starting said differential coding of said voice information in accordance with said reference value and generating relay voice codes for at least a certain change period, and a silent-period elimination circuit for receiving said original voice code and said relay voice code and outputting said relay voice code to said second transmission line during said change period and said original voice code to the second transmission line during a voice period after said change period in accordance with said relay control signal to synthesize a silent-period-vanished voice code; and a reception node includes a reception control circuit for deciding the start of said voicing in accordance with said silent-period-vanished voice code and outputting a reception control signal for controlling operations of a reception node in accordance with a decision result, a decoding reference-value determination circuit for determining a reference value for said decoding corresponding to said reference value for differential coding at the start of said voicing in accordance with said reception control signal, and a reception decoder for starting said decoding of said silent-period-vanished voice code in accordance with the reference value for said decoding at the start of said voicing and outputting said voice signal. According to the present invention, a relay encoder and a reception decoder obtain a differential-coding reference value (referred to as a reference value at start of voicing) from respective coding reference-value determination or decoding reference-value determination circuits. The differential coding is a method for fetching and coding a difference between reference values given by past coding or decoding. The number of reference values is not limited to one, but it is possible to use a reference value for each of various parameters showing a voice signal.

A reference value at start of voicing to be determined by an coding-reference value determination circuit and that to be determined by a decoding reference-value determination circuit respectively are made to correspond to each other so that a reception decoder can regenerate voice information input to a relay encoder and the reference values are generally equal to each other. Hereafter, in the case of the encoder and decoder in which their reference values are made to correspond to each other, it is assumed that their internal states coincide. If internal states do not coincide with each other, abnormal sound may be output from a reception node. However, because the internal states of the relay encoder and reception decoder are synchronized and initialized to coincide with each other, no abnormal sound is produced. In this case, however, it is not assured that the internal state for coding in a transmission node coincides with the internal state of a reception decoder. Therefore, a silent-period elimination circuit transmits a relay voice code which is an output of a relay encoder to a reception decoder via the second transmission line within a predetermined change period from the start of voicing.

In this change period, the internal state for coding in the transmission node approximates the internal state of the reception decoder. Therefore, the silent-period elimination circuit directly transmits an original voice code transmitted from the transmission node to the reception decoder during a voiceful period after the change period. That is, after the change period, a voice signal is differential-coded by the transmission node and then regenerated through decoding in the reception node without undergoing the coding/decoding in the change period by the relay node. Therefore, the coding/decoding frequency is smaller than that in the change period and the number of quantization errors decreases. Therefore, voice quality degradation due to abnormal sound is prevented by tandem connection when the internal state of the transmission node dissociates from that of the reception decoder, and voice quality degradation due to accumulation of quantization errors such as in tandem connection is prevented by digital-one-link when their internal states approximate each other.

In this case, the degree of approximation between the internal state of the transmission node and that of the reception decoder is further improved as the time after the start of voicing increases and the abnormal-sound suppression effect is improved. However, the period of degradation due to quantization errors by tandem connection also increases. The transient period is determined in accordance with the balance between suppression of abnormal sounds and lengthening of the period in which voice quality degradation due to quantization errors is suppressed.

Therefore, according to the voice coding-and-transmission system of the present invention, voice quality degradation due to abnormal sound at the head of a talk spurt is prevented by tandem connection during only a short change period until the difference between the internal state for coding in a transmission node and the internal state of a decoder of a reception node converge immediately after the talk spurt is detected, and voice quality degradation due to accumulation of quantization errors such as in the tandem connection is prevented by performing digital-one-link during most voice period after the difference between these internal states completely converges. That is, there are advantages that abnormal sound produced at the head of a talk spurt is suppressed and moderated, rugged feeling due to abnormal sound is vanished, degree of voice comprehension is improved, and, moreover, voice quality degradation due to continuous tandem connection is prevented.

A voice coding-and-transmission system related to the second aspect of the present invention is characterized in that a relay node includes a relay decoder for extracting voice information included in a voice signal from an original voice code, a relay control circuit for discriminating between a voiceful period and a silent period of said voice signal in accordance with said voice information and outputting a relay control signal for controlling operations of a relay node in accordance with a discrimination result, a voice code corrector for outputting a corrected voice code obtained by replacing an original voice code of a portion of a voice signal output from a reception node with a voice code for suppressing said abnormal sound in accordance with said voice information when said abnormal sound may be produced, and a silent period elimination circuit for receiving said original voice code and said corrected voice code and outputting said corrected voice code to said second transmission line within a predetermined transient period from the start of voicing which is the timing of change from said silent period to said voiceful period and outputting said original voice code to said transmission line during a voice period after said change period in accordance with said relay control signal to synthesize a silent-period-vanished voice code.

According to the present invention, a corrected voice code causes little divergence, even in unstable coding/decoding systems with different internal states output from a relay node in a change period with a high possibility of voice signal divergent and abnormal sound production. For example, the corrected voice code is obtained by suppressing values of parameters related to gain among voice parameters.

The voice coding-and-transmission system related to the second aspect of the present invention also has an advantage that no special consideration or operation is necessary for internal states of relay and reception nodes in order to suppress abnormal sound, in addition to the advantage of the first aspect, because the relay node outputs a corrected voice code for suppressing abnormal sound at the time of tandem connection in a change period and the reception node decodes the corrected voice code.

A voice coding-and-transmission system related to the third aspect of the present invention is characterized in that a voice code includes a gain code made to correspond to gain information in voice information in accordance with codebooks which are tables for correlating a quantized gain value and a gain code, a relay node includes a relay decoder for fetching voice information included in a voice signal from an original voice code, a relay control circuit for discriminating between a voiceful period and a silent period of said voice signal in accordance with said voice information and outputting a relay control signal for controlling operations of a relay node in accordance with a discrimination result, a suppression codebook which is one of said code books, a relay encoder for performing said differential coding of said voice information by obtaining a gain code from said suppression codebook to generate a relay voice code, and a silent-period elimination circuit for receiving said original voice code and said relay voice code and outputting said relay voice code to said second transmission line during a predetermined change period which is the timing of change from said silent period to said voiceful period to said second transmission line and said original voice code to said transmission line during a voiceful period after said change period in accordance with said relay control signal; a reception node includes a reception control circuit for deciding the start of said voicing in accordance with said silent-period-vanished voice code and outputting a reception control signal for controlling operations of a reception node in accordance with a decision result, another suppression codebook, a standard codebook which is another one of said codebooks, and a reception decoder connected with said suppression codebook within a predetermined change period from the start of said voicing and connected with said standard codebook after said transient period in accordance with said reception control signal and obtaining said gain information from these codebooks to perform said decoding of said voice signal from said silent-period-vanished voice code and output said voice signal; and the quantized gain value of said suppression codebook is suppressed in comparison with the quantized gain value of said standard codebook.

According to the present invention, a relay encoder generates a relay voice code causing little divergence even in an unstable coding/decoding system with different internal states by using a suppression codebook. In a change period with a high possibility that abnormal sound is produced, a reception node prevents abnormal sound by outputting the relay voice code from a relay node. Basically, several ranges are formed for gain values in voice information and each range is assigned one gain value as a quantized value. A gain code is made to correspond to the quantized value. In a change period, a relay encoder and a reception decoder use the same suppression codebook and a quantized gain value is obtained at the reception decoder side for an actual gain value in voice information serving as an input of the relay encoder. By adjusting the range of a gain value and the quantized value and further suppressing a quantized gain value of a suppression codebook than that of the standard codebook, divergence of a voice signal of an output of the reception decoder in a change period is prevented and abnormal sound is prevented.

The voice coding-and-transmission system related to the third aspect of the present invention also has an advantage that no special consideration or operation is necessary for internal states of a relay node and a reception node in order to suppress abnormal sound, in addition to the advantage of the first aspect, because tandem connection is performed which delivers a voice code for suppressing divergence of the system by changing gain codebooks used by a relay node and a reception node. Moreover, the system has advantages that the structure is simple because only a few control signals necessary for controlling operations are used, decreasing the processing load such as arithmetic.

A voice coding-and-transmission system related to the fourth aspect of the present invention is characterized in that a reception node includes a reception control circuit for discriminating between start of voicing and end of voicing in accordance with a silent-period-vanished voice code and outputting a reception control signal for controlling operations of a reception node in accordance with a discrimination result, a voice code corrector for outputting a corrected voice code obtained by replacing a silent-period-vanished voice code of a portion of a voice signal output from said reception node with a voice code for suppressing abnormal sound in accordance with said silent-period-vanished voice code when said abnormal sound may be produced, a decoded input selector for receiving said silent-period-vanished voice code and said corrected voice code and outputting said corrected voice code within a predetermined change period from the start of said voicing and said silent-period-vanished voice code up to the end of said voicing after said change period in accordance with said reception control signal, and a reception decoder for applying said decoding corresponding to said differential coding to an output of said decoded input selector and outputting said voice signal.

According to the present invention, a corrected voice code causing little divergence even in an unstable coding/decoding system with different internal states is generated by a voice code corrector in a reception node during a change period with a high possibility that a voice signal diverges and abnormal sound is produced and a silent-period-vanished voice code received by the reception node is replaced with the corrected voice code. For example, the corrected voice code is obtained by suppressing values of parameters related to gain among voice parameters. Thereby, abnormal sound is prevented in the reception node.

The voice coding-and-transmission system related to the fourth aspect of the present invention also has an advantage that a relay node does not require the function of tandem connection, in addition to the advantage of the first aspect, because a corrected voice code is generated in a reception node and tandem connection during a change period is falsely realized in the reception node. Thereby, an advantage is also obtained that no special consideration or operation is necessary for internal states of the relay node and reception node in order to suppress abnormal sound. Moreover, an advantage is obtained that the structure of the relay node is simplified and it is unnecessary to improve a conventional structure.

A voice coding-and-transmission system related to the fifth aspect of the present invention is characterized in that a relay node includes a relay decoder for extracting voice information included in a voice signal from an original voice code, a relay control circuit for discriminating between a voiceful period and a silent period of said voice signal in accordance with said voice information and outputting a relay control signal for controlling operations of a relay node in accordance with a discrimination result, a relay encoder for coding voice information at the present time and generating a relay voice code, and a silent-period elimination circuit for receiving said original voice code and said relay voice code and outputting said relay voice code to said second transmission line within a predetermined change period from the start of voicing which is the timing of change from said silent period to said voice period and said original voice code to said second transmission line during a voice period after said change period in accordance with said relay control signal to synthesize said silent-period-vanished voice code; a reception node includes a reception control circuit for deciding the start of said voicing in accordance with said silent-period-vanished voice code and outputting a reception control signal for controlling operations of a reception node in accordance with a decision result, a first reception decoder for decoding said original voice code and outputting said voice signal, a second reception decoder for decoding said relay voice code and outputting said voice signal, a reference-value adapting section for applying said differential coding to a voice signal output from said second reception decoder to output it to said first reception decoder and update the reference value for said differential coding of said first reception decoder, and a decoder changeover circuit for connecting said second reception decoder to said second transmission line during said change period and said first reception decoder to said second transmission line up to the end of said voicing after said change period in accordance with said reception control signal.

According to the present invention, a relay encoder codes voice information decoded by a relay decoder in accordance with voice information at the present time without depending on the non-differential coding system, that is, past coding or decoding. In a transient period, a reception node decodes a relay voice code output from a relay encoder as a voice signal by a second reception decoder, corresponding to the coding system of the signal, and outputs the signal. In the transient period, simultaneously with the above operation, a reference-value adapting section codes a voice signal sent from the second reception decoder by the same differential coding system as in the case of a transmission node and supplies a first reception decoder corresponding to the coding system. Thereby, because the internal state of the first reception decoder approximates the internal sate for coding in the transmitting node, the relay node connects the transmission node with the reception node by digital-one-link and the reception node starts decoding by the first reception decoder synchronously with the connection between the nodes after the change period. In this case, because the tandem connection between the relay encoder and the second reception encoder in the change period uses the non-differential coding system, the coding reference value determination circuit and decoding reference value determination circuit for performing operations such as synchronous resetting of the relay encoder and second reception decoder at start of voicing are unnecessary.

Therefore, according to the voice coding-and-transmission system related to the fifth aspect of the present invention, tandem connection according to the non-differential coding system is performed to prevent voice quality from deteriorating due to abnormal sound when the internal state of the transmission node dissociates from that of the first reception decoder and digital-one-link is used when their internal states approach each other due to working of the reference-value adapting section. Thereby, similar to the case of the first aspect, an advantage is obtained that voice quality degradation due to accumulation of quantization errors in tandem connection is prevented.

A voice coding-and-transmission system related to the sixth aspect of the present invention is characterized in that a relay node includes a relay decoder for fetching voice information included in a voice signal from an original voice code, a relay control circuit for discriminating between a voice period and a silent period of said voice signal in accordance with said voice information and outputting a relay control signal for controlling operations of a relay node in accordance with a discrimination result, a delay circuit for delaying said original voice code by a predetermined delay time, and a silent-period elimination circuit for performing silent period elimination by outputting said original voice code from said delay circuit to said second transmission line during said voiceful period in accordance with said relay control signal; and a reception node includes a reception control circuit for deciding the start of said voicing in accordance with a silent-period-vanished voice code and outputting a reception control signal for controlling operations of a reception node in accordance with a decision result, and a reception decoder for applying said decoding corresponding to said differential coding to said silent-period-vanished voice code and outputting said voice signal.

According to the present invention, the timing of a relay control signal in accordance with the voice detection by a relay control circuit precedes the timing of an original voice code to be input to a silent period elimination circuit. Thereby, a silent period according to a delay value of a delay circuit is provided at the head of a silent-period-vanished voice code as a hangover period. In a reception node, a reception control circuit decides the start of voicing in accordance with a transmitted silent-period-vanished voice code and the start of said voicing precedes the timing of change from a silent state to a voice state of an actual voice signal. A voice code corresponding to silent is input to a reception decoder during the hangover period after the start of said voicing. That is, the time base of the voice code is shifted by the delay circuit so that the state change which is a process when the internal state of the reception decoder approximates the internal state of coding of a transmitting node is performed in a silent period. Therefore, even for an coding/decoding system whose operations become unstable due to incoincidence between internal states, oscillation is not performed and little abnormal sound is produced.

Thus, according to the voice coding-and-transmission system related to the sixth aspect of the present invention, it is possible to suppress abnormal sound by a very simple structure in which a delay circuit is set to a relay node and moreover, connection is always made by digital-one-link and voice quality degradation due to accumulation of quantization errors does not occur because a silent period (hangover period) is included in the head of a silent-period-vanished voice code to be transmitted to a reception node by setting a delay circuit to a relay node and delaying the transmission of a voice code and convergence of the difference between the internal states of the relay node and a reception decoder is previously performed.

A voice coding-and-transmission system related to the seventh aspect of the present invention is characterized in that a relay node includes a relay decoder for fetching voice information included in a voice signal from an original voice code in accordance with a reference value for decoding corresponding to differential coding, a relay control circuit for discriminating between a voice period and a silent period of said voice signal in accordance with said voice information and outputting a relay control signal for controlling operations of a relay node, a delay circuit for delaying said original voice code by a predetermined delay time, a reference state encoder for outputting a reference state code obtained by coding said reference value of said relay decoder, and a silent-period elimination circuit for receiving an original voice code output from said delay circuit and said reference state code and outputting said state code within said delay time from start of voicing which is the timing of change from said silent period to said voice period and said original voice code after said delay time passes in accordance with said relay control signal to synthesize a silent-period-vanished voice code. Further, a reception node includes a reception control circuit for deciding the start of said voicing in accordance with said silent-period-vanished voice code and outputting a reception control signal for controlling operations of a reception node in accordance with a decision result, a reference state decoder for decoding said reference state code and outputting said reference value, and a reception decoder for starting said decoding of said silent-period-vanished voice code in accordance with said reference value and outputting said voice signal.

According to the present invention, the internal state of the relay decoder, that is: the reference state code obtained by coding the reference value for differential coding, is transmitted to the reception node in the above hangover period. In the reception node, the reference state decoder decodes the reference state code and forcibly initializes the reception decoder. Thereby, because the reference value to be set is the same as that in the transmission node, no abnormal sound is produced.

The voice coding-and-transmission system related to the seventh aspect of the present invention uses the above hangover period by setting the delay circuit to the relay node and transmits a reference state code obtained by coding the internal state of the relay decoder during the hangover period to the reception decoder to make the internal states of the transmission node and reception node forcibly coincide with each other. Thereby, it is possible to suppress abnormal sound and, moreover, an advantage is obtained that no voice quality degradation due to accumulation of quantization errors occurs because a voice signal to be output from the reception node is always based on a voice code transmitted from the transmission node by digital-one-link. Moreover, a further advantage is obtained that the hangover period is shortened because of forcible coincidence of internal states.

A voice coding-and-transmission system related to the eighth aspect of the present invention is characterized in that a relay node includes a relay control circuit for detecting cell vanishing in an asynchronous transfer mode transmission line based on received cells, and outputting a relay control signal for controlling operations of the relay node in accordance with a detection result; a voice code repairing portion for compensating an original voice code which is lost due to the cell vanishing based on the original voice code received and for generating a relay voice code; and an output switching unit for switching outputs of the original voice code and the relay voice code in the synchronous transfer mode transmission line based on the relay control signal, outputting the relay voice code when detecting the cell vanishing and outputting the original voice code when detecting no cell vanishing.

According to the eighth aspect of the voice-coding-transmission system of the present invention, the ATM network and the STM network are tandem-connected only for a period in which the cell is vanished, and are digital-one-link-connected for a normal period in which the cell is not vanished. Thereby, for most periods, voice quality degradation due to accumulation quantization errors from the tandem connection is prevented. In case of cell vanishing, a compensation processing of the vanished cell is realized under the tandem-connection, thereby the degradation of the voice quality due to the vanished cell is prevented. In other words, following effects can be obtained: generation of abnormal sound due to the vanished cell is suppressed and eased, harsh sound caused by abnormal sound generation is solved, intelligibility of the voice is improved, and the degradation of the voice quality cased by a regular tandem connection is avoided. In addition, these effects are achieved by a configuration of the relay node alone. Namely, the reception node, the transmission node and the transmission network may have conventional configurations, and require no modifications. Above-mentioned effects of the voice quality can be obtained at a realistic cost.

BRIEF DESCRIPTION OF THE DRAWINGS

FIG. 46 is a block diagram of the ITU Recommendation G.728 coding system which is an example of the differential coding system;

DESCRIPTION OF THE PREFERRED EMBODIMENTS

[Embodiment 1]

Figure 1:
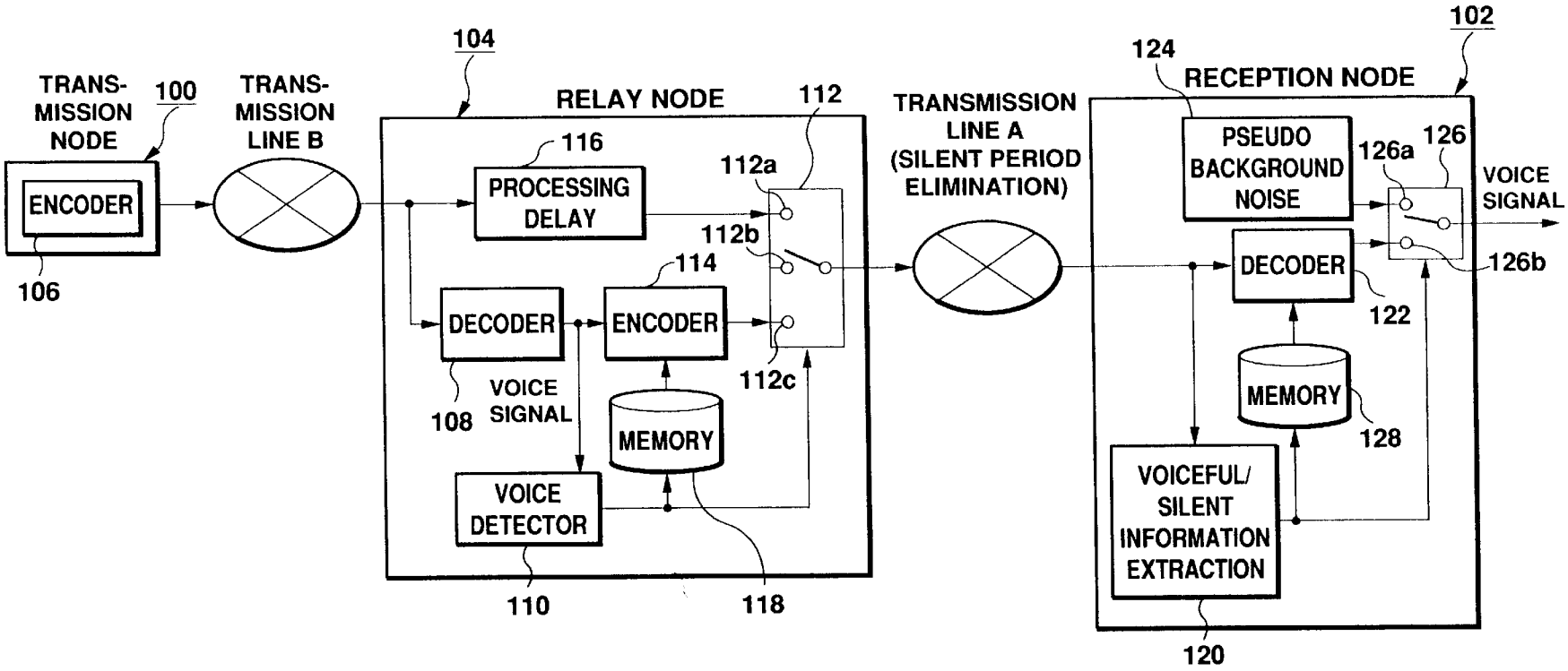
FIG. 1 is a block diagram of the voice coding-and-transmission system of the first embodiment.

The first embodiment of the present invention is described below by referring to the accompanying drawings. FIG. 1 is a block diagram of the voice coding-and-transmission system of this embodiment. In the case of the voice coding-and-transmission system, a transmission node 100 outputs an original voice code obtained by coding a voice signal. Though the original voice code is a differential-coded high-efficiency voice code, it is not silent-period-vanished. The original voice code is transmitted to a transmission line B. That is, the transmission line B represents a transmission network in which silent period elimination is not performed. However, a transmission line A to which a reception node 102 is connected represents a transmission network in which silent period elimination is performed. A relay node 104 connects these two transmission networks, receives an original voice code from the transmission node 100 through the transmission line B, and converts the voice code to a silent-period-vanished voice code to output it to the transmission line A. The reception node 102 decodes the silent-period-vanished voice code and outputs a voice signal.

The transmission node 100 has an encoder (coding unit) 106 for differential-coding an input voice signal. The encoder 106 generates an original voice code which is a high-efficiency voice code. The high-efficiency voice code transmitted from the transmission node 100 to the relay node 104 through the transmission line B is decoded as a voice signal by a decoder (relay decoder) 108. A voice detector 110 detects presence or absence of a talk spurt in accordance with the voice signal, that is, discriminates between a voice period and a silent period and outputs a signal (relay control signal) for controlling operation modes of the relay node in accordance with a discrimination result.

Figure 2:
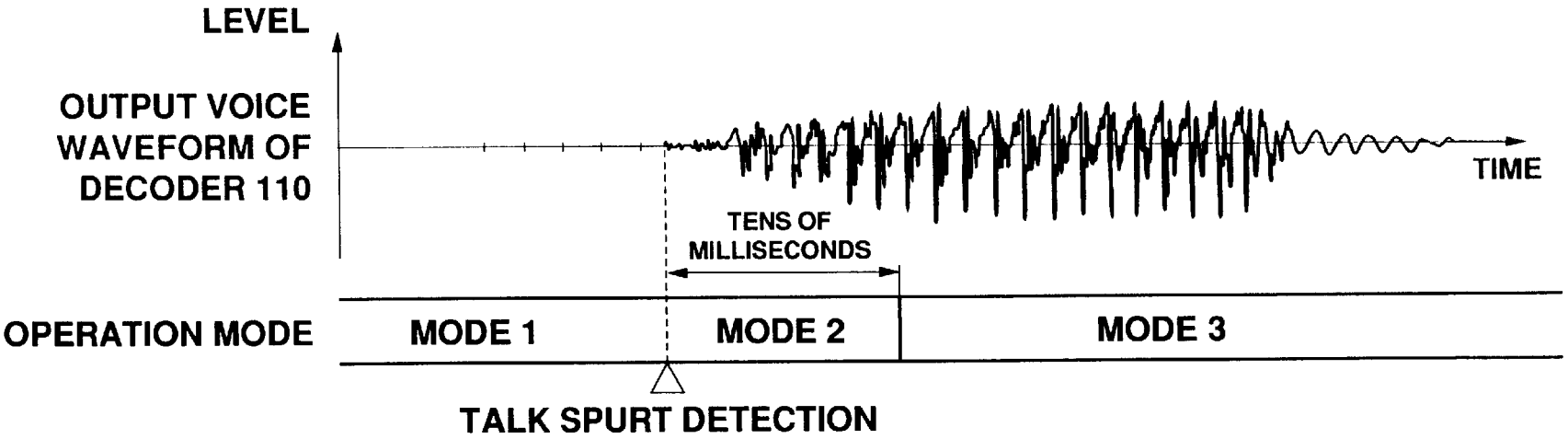
FIG. 2 is a waveform diagram of a voice signal for explaining operation modes related to the first to seventeenth embodiments.

The relay node has three operation modes switched by the voice detector 110. These operation modes are described below by referring to FIG. 2. FIG. 2 is a waveform diagram of a voice signal output from a decoder 108. The y axis represents signal level and x axis represents time. The voice detector 110 divides the voice signal into three periods (sections) corresponding to operation modes and controls operations of the relay node 104. First, the period in which no talks part is detected from a high-efficiency voice code input to the relay node 104 is assumed as mode 1. Second, the period for some tens to hundreds of milliseconds after a talk spurt is detected (this period is referred to as a change period or a transient period) is assumed as mode 2. Third, the period in which talk spurts are continuously detected after mode 2 is assumed to be mode 3. The voice detector 110 supplies a control signal reflecting the above-described operation-mode decision results to a silent period elimination circuit 112.

The relay node 104 has two routes for connecting the transmission lines B and A. The first route comprises the decoder 108 and the encoder (relay encoder) 114 and the second route passes a processing delay unit 116. The silent period elimination circuit 112 has a built-in switch for switching three states of voice code outputting to the transmission line A through either of the first and second routes or outputting no voice code by not connecting the transmission line A to any object. The processing delay unit 116 has a delay time equal to a signal delay produced in the route comprising the decoder 108 and the encoder 114 and arranges the signal timing between the first and second routes. As described later, the silent period elimination circuit 112 eliminates a voice code during silent periods by outputting no data to the transmission line A in mode 1 with "no" talk spurt. Moreover, the silent period elimination circuit 112 adds the information necessary for the mode decision (mode information) in the reception node 102 to a voice code. The mode information shows the start or end of a voice period. Thus, a silent period eliminator 112 synthesizes a silent-period-vanished voice code and transmits the code to the transmission line A. A memory 118 is described later.

In the reception node 102, a voice/silence information extractor 120 extracts mode information from a silent-period-vanished voice code and outputs a signal for controlling operation modes of a reception node (reception control signal). The reception node 102 includes a decoder (reception decoder) 122 and a pseudo background noise generator (pseudo-background-noise signal generator) 124 for generating artificial noises. A changeover switch 126 directs output of a signal from the decoder 122 or generator 124. A memory 128 is described later.

Operations in each mode are described below mainly on a relay node and a reception node. First, in mode 1, the relay node 104 connects the changeover switch in the silent period eliminator 112 to a terminal 112*b*. Because the terminal 112*b* is not connected to either of the first or second routes, no high-efficiency voice code is output to the transmission line A in this case. The voice detector 110 constantly operates because it is necessary to continuously monitor the change of modes. Because the voice detector 110 performs mode decision by using a voice signal output from the decoder 108 as its input, the voice signal must always be supplied. Therefore, the decoder 108 also operates constantly. However, the encoder 114 need not be operated because it is unnecessary to supply a high-efficiency voice code output from the encoder 114 to other block or transmit it to a reception node in this mode. Moreover, in the reception node 102, the voice/silence information extractor 120 decides mode 1 in accordance with a silent-period-vanished voice code transmitted from the transmission line A. This decision is made by obtaining the information showing the end of a voice period added to the last of a group of silent-period-vanished voice codes (the last packet or cell when silent-period-vanished voice codes are transmitted by being divided into a plurality of packets or cells) and thereby deciding mode 1 after the final code. By receiving a control signal reflecting the information of being mode 1, the changeover switch 126 is switched to the terminal-126*a* side, pseudo-background noises of the pseudo background noise generator 124 are output from the reception node 102, and a natural silent state is transferred to a receiver.

In the relay node 104, when the voice detector 110 detects that operation modes change from 1 to 2, it transmits to the encoder 114 a control signal form notifying that a silent state changes to a voice state. The encoder 114 responds to the control signal, loads the data stored in a memory 118 in a memory inside of the encoder 114 as a reference value for the differential coding of various voice parameters, and starts coding a voice signal output from the decoder 108 in accordance with the reference value. That is, the memory 118 determines a reference value of the encoder 114. Moreover, by receiving the same control signal, a changeover switch of the silent period eliminator 112 is switched to the terminal-112*c* side.

Moreover, in the reception node 102, the voice/silence information extractor 120 extracts mode information from a silent-period-vanished voice code transmitted from the transmission line A and detects that operation modes change from 1 to 2. The voice/silence information extractor 120 transmits a control signal for notifying that a silent state changes to a voice state to the decoder 122. The decoder 122 responds to the control signal to load the data stored in the memory 128 in a memory inside of the decoder 122 as a reference value for the differential coding or decoding of various voice parameters. Moreover, the voice/silence information extractor 120 transmits the same signal to the changeover switch 126. The changeover switch 126 is switched to the terminal-126*b* side in accordance with the control signal. That is, the memory 128 determines a reference value of the decoder 122.

When the voice detector 110 decides mode 3, a changeover switch in the silent period eliminator 112 is switched to the terminal-112*a* side and a high-efficiency voice code sent from the encoder 106 of the transmission node 100 is output directly to the transmission line A. Also, in this case, the voice detector 110 is continuously operated because it is necessary to monitor the change of modes. Because the voice detector 110 performs mode decision by using a voice signal output from the decoder 108 as its input, the voice signal must be supplied to the voice detector 110. Therefore, the decoder 108 also continuously operates. However, the encoder 114 need not be operated because it is unnecessary to supply a high-efficiency voice code generated by the encoder 114 to other block or transmit the code to a reception node in this mode. Operations of the reception node 102 are the same as those in mode 2. In this case, if the state of mode 2 is not prepared, the following trouble occurs. That is, though it is assured that internal state of the encoder 106 of the transmission node 100 coincides with that of the decoder 108 of the relay node 104 and the internal state of the encoder 114 of the relay node 104 coincides with that of the decoder 122 of the reception node 102, it is not at all assured that the internal state of the encoder 106 coincides with that of the decoder 122. Therefore, when operation modes suddenly change from 1 to 3, abnormal sound due to the incoincidence between the internal states is produced similar to the case of the conventional system. However, by setting a change period defined by mode 2, abnormal sound can be avoided because the present operation mode changes to operation mode 3 when the internal state of the decoder 122 approaches that of the encoder 106 and their internal states completely coincide with each other.

About the setting of internal memories of the encoder 114 and decoder 122 shown above, it is the necessary minimum condition of the present invention to delete the memory contents reflecting the processing results of the past indefinite operations by equalizing the data stored in the memory 118 with the data stored in the memory 128 and setting the same reference value for differential coding to the encoder 114 and decoder 122 when assuming that prevention of abnormal sound is the final object. However, the data values stored in the memories 118 and 128 are used only when the mode changes from 1 to 2. Therefore, by using a value corresponding to the state of the mode change, it is possible to obtain a higher-quality decoded voice. For example, when ITU Recommendation G.728 is used for a high-efficiency coding system, a higher-quality decoded voice can be obtained by using a previously-calculated predictive filter factor and memory belonging to predictive filter adaptive means (e.g. auto-correlation function) or memory belonging to adaptive gain or gain adaptive means.

Moreover, when ITU Recommendation G.728 is applied to the high-efficiency coding system, the data calculated and stored when coding/decoding background noises is the most suitable from the viewpoint of the acoustic quality. However, it can easily be imaged that this value depends on the coding system used. Moreover, an advantage almost equal to that of the above embodiment can be obtained even if using other value. That is, it is the essence of the present invention that the timings of control signals generated by the voice detector 110 and voice/silence information extractor 120 coincide each other and thereby, the same internal state is sent to the encoder 114 and decoder 122 and indefinite components due to past data are vanished.

The voice coding-and-transmission system of this embodiment makes it possible to avoid quality degradation by limiting the period for performing tandem connection for which it is known to cause voice quality degradation to a short time of a transient period in which a silent state changes to a voiceful state and connecting most talk spurts by digital-one-link and fully bring out the performances of the high-efficiency voice coding system. Moreover, it is possible to decrease the processor processing load and the hardware scale of the relay node 104.

As described above, the value of tens to hundreds of milliseconds is shown as the continuous time (change time) of mode 2. However, the base of this value conforms to the following empirical rule. First, as a prerequisite, it is assumed that the internal state of the encoder 106 is completely different from that of the decoder 122 when using G.728 as the high-efficiency coding system. Under the prerequisite, coding/decoding is performed by the encoder 106 and decoder 122 through a transmission line. Because the stability of every filter used for G.728 is assured, the internal states for transmission and reception gradually converge to become equal. While coding and decoding are continued, the internal states completely coincide with each other, up to a degree in which there is no possibility that abnormal sound is produced. The time required from a mode change up to a complete coincidence between internal states is some tens or hundreds of milliseconds. It is obvious that it is predicted that the above value changes depending on the high-efficiency coding system used. Therefore, it is important to set a change period corresponding to each coding system.

Figure 3:
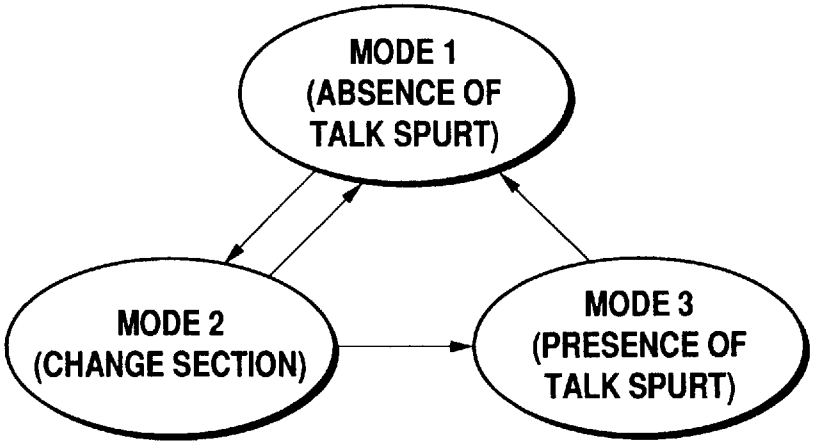
FIG. 3 is a state change diagram showing change between operation modes.

FIG. 3 is a state change diagram showing the change between the modes described above. Only the directions shown by arrows are allowed for the change between three modes and a change other than the above change is an inhibited change or a change which cannot physically be considered.

In the case of this embodiment, a system is described in which ITU Recommendation G.728 is applied to a high-efficiency coding system. However, the present invention is not restricted to the coding system. The present invention can be applied to every voice coding system using past coding/decoding result referred to as the differential coding system in this case.

[Embodiment 2]

Figure 4:
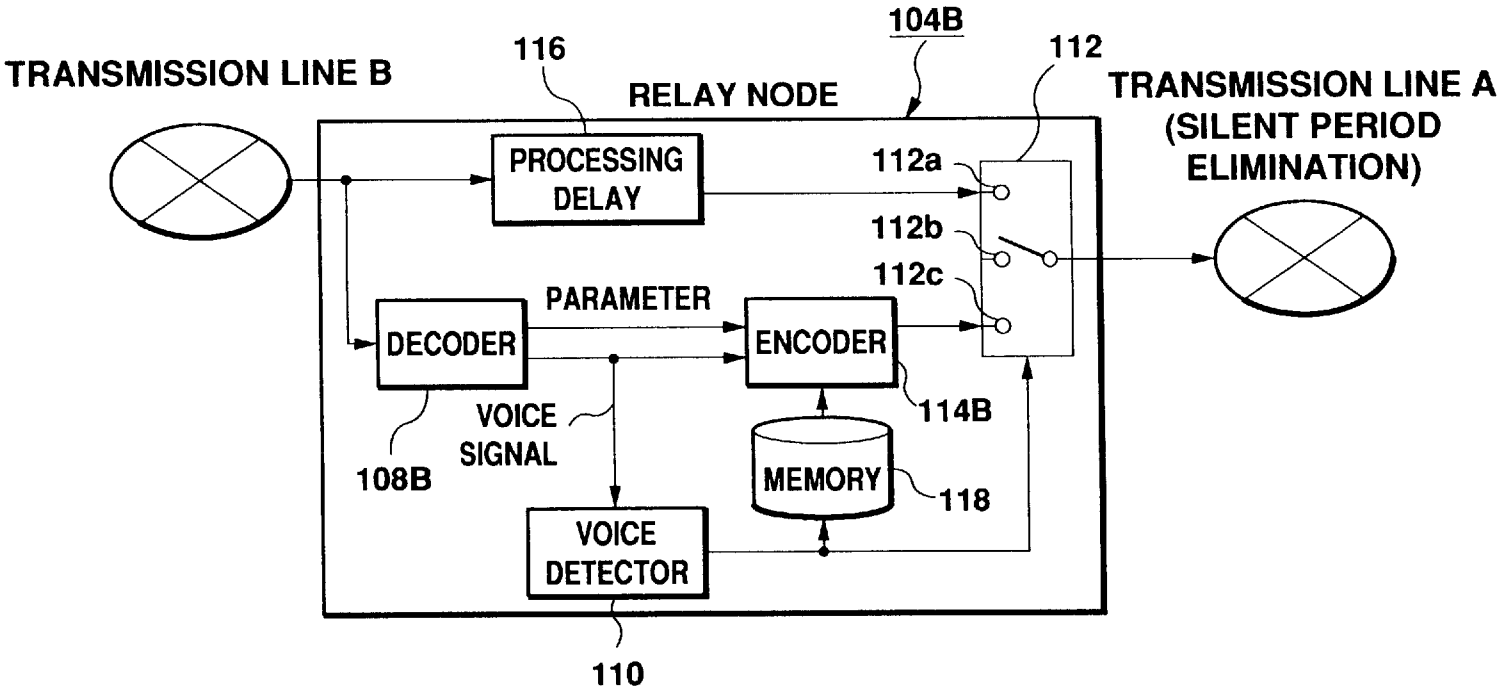
FIG. 4 is a block diagram of a relay node related to the second embodiment.

FIG. 4 is a block diagram of a relay node for explaining the second embodiment of the present invention. This embodiment is obtained by improving the relay node of the voice coding-and-transmission system of the embodiment 1. As a result of improving the relay node, the processing load and hardware scale of the relay node can be decreased. In FIG. 4, the transmission node 100 and the reception node 102 are not illustrated because they are the same as those of the embodiment 1; only a relay node is shown. Moreover, in FIG. 4, a component having the same function as that of the component described for the embodiment 1 is provided with the same symbol as in FIG. 1 and its description is not repeated. For a modified component, the character B is added to its symbol in FIG. 1 so that how the component corresponds to the component of the embodiment 1 can easily be understood.

A decoder 108B decodes a voice signal and outputs some of the adaptive parameters. An adaptive parameter is generated in high-efficiency coding such as ADPCM, which is a voice parameter for constituting a voice signal. An encoder 114B receives the voice signal and adaptive parameters. In the case of the encoder 114B, it is possible to omit the processing for generating input adaptive parameters. Most operations of this voice coding-and-transmission system are the same as those of the embodiment 1 except that some of adaptive parameters are supplied to the encoder 114B from the decoder 108B. Thereby, some adaptive differential processings can be omitted for the encoder 114B. However, supply of some parameters to the encoder 114B from the decoder 108B may result in partially admitting the incoincidence between internal states of the encoder 114B and the decoder 122 of the reception node. Therefore, it is necessary to carefully select parameters to be supplied in order to not correspondingly cause abnormal sound to a high-efficiency coding system. For example, to use G.728 for a high-efficiency coding system, there is a synthesizing filter factor as a backward-type parameter which can be supplied to the encoder 114B from the decoder 108B. A synthesizing filter takes charge of a sound adjusting mechanism equivalent to the throat or palate of the to generate a vowel. However, a consonant part or background noise part frequently appears in the period of mode 2. Therefore, the sound adjusting mechanism does not greatly contribute to voice synthesis. Moreover, abnormal sounds such as "gya" or "bu" (phonetic) are in most cases caused by an unsuited gain value. From the above viewpoint, even if some troubles occur in adaptation of a synthesizing-filter factor, it is considered that no abnormal sound is produced in this period.

Supply of backward-type parameters is described above and it is pointed out that the parameters must carefully be selected. In the case of forward-type parameters, however, it is needless to say that there is no problem on the supply of the parameters from the decoder 108B to the encoder 114B because the parameters are not provided with past influences at all.

[Embodiment 3]

Figure 5:
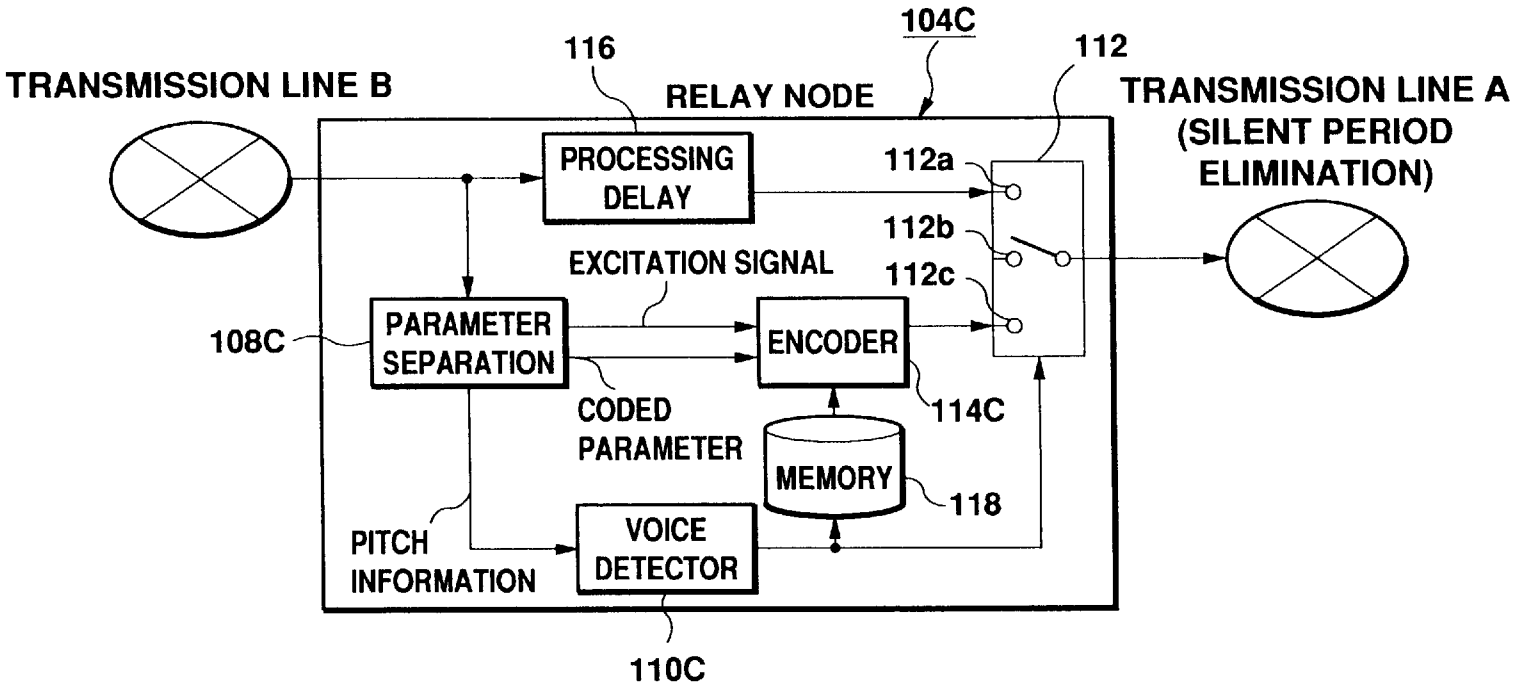
FIG. 5 is a block diagram of a relay node related to the third embodiment.

FIG. 5 is a block diagram of a relay node for explaining the third embodiment of the present invention. This embodiment is obtained by improving the relay node of the voice coding-and-transmission system of the embodiment 1 or 2. As the result of improving the relay node, the processing load and hardware scale of the relay node can be decreased. In FIG. 5, the transmission node 100 and the reception node 102 are not illustrated because they are the same as those of the embodiment 1 and only the relay node is shown. Moreover, in FIG. 5, a component having the same function as that explained in the embodiment 1 is provided with the same symbol and its description is not repeated. For a modified component, the character C is added to its symbol in FIG. 1, so that how the component corresponds to the components of the embodiment 1 and embodiment 2 can easily be understood.

A parameter separator 108C is constituted by omitting some processings of the decoder 108B in FIG. 4. The parameter separator 108C is not provided with a function for decoding a voice signal in a complete form, but it is provided with a parameter extracting function. The parameter separator 108C outputs an excitation signal and a parameter to the encoder 114C and outputs pitch information (or excitation signal information) to a voice detector 110C. The voice detector 110C detects voices in accordance with the pitch information (or excitation signal information). Other operations of this voice coding-and-transmission system are the same as those of the embodiment 2.

It is pointed out in the description of the embodiment 2 that parameters causing abnormal sound due to incoincidence can be specified to a certain extent. In the case of this voice coding-and-transmission system, an encoder and a decoder omit the adaptive processings for some parameters in a relay node.

In the case of the parameter separator 108C, if even some of the adaptive processings performed by the decoder 108B are omitted, every voice decoding function is lost and no voice signal cannot be output. Because a relay node 104C does not require a voice signal, which is an output signal, there is no macroscopic problem. However, because the voice detector 110B and the encoder 114B in FIG. 4 require a voice signal input, the relay node 104C uses the voice detector 110C and encoder 114C having a structure requiring no voice signal input instead of the detector 110B and encoder 114B.

Figure 6:
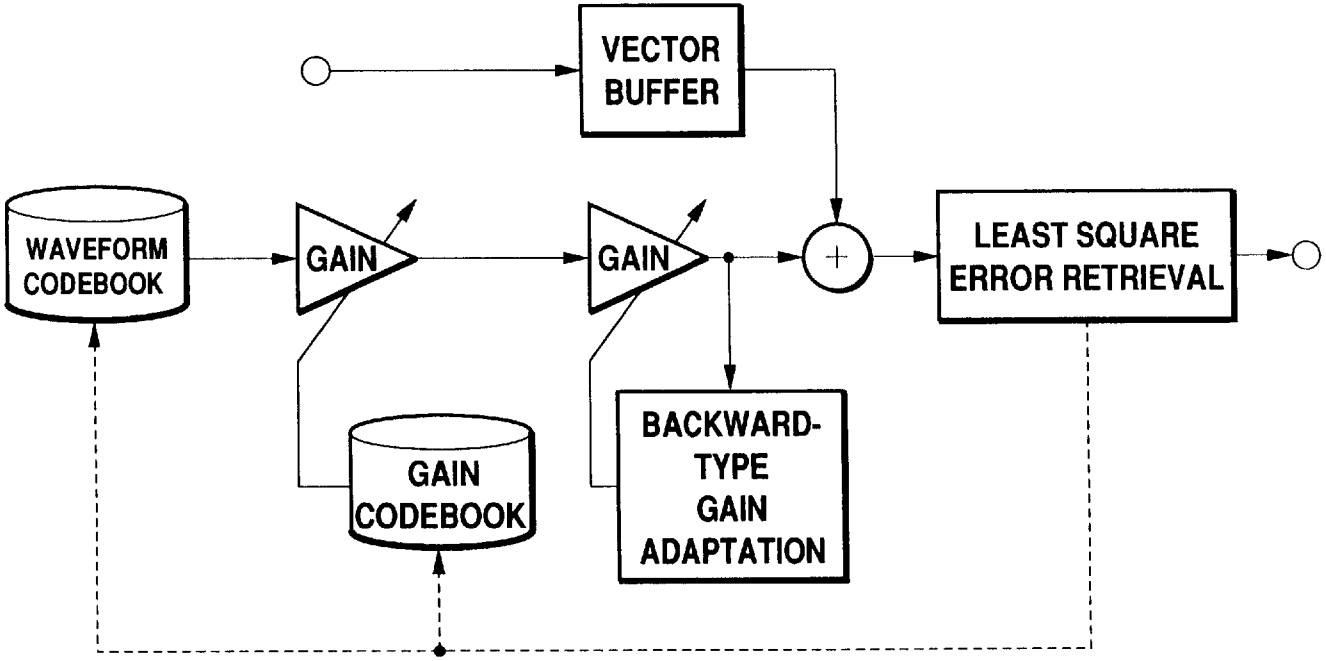
FIG. 6 is a block diagram of an encoder of a relay node related to the third embodiment.

First, the structure of the encoder 114C is described below. As an example, a case is described in which ITU Recommendation G.728 is used for a high-efficiency coding system (see FIG. 28). It is described for the embodiment 2 that a slight incoincidence between synthesizing-filter factors does not greatly influence abnormal sound in G.728 . When omitting the synthesizing-filter processing, the parameter separating section 108C can only decode up to an excitation vector. FIG. 6 is a block diagram of the encoder 114C for performing coding in accordance with an excitation vector without using any voice signal input. By constituting the encoder 114C as shown in FIG. 6, it is possible to realize an encoder requiring no voice signal input. In the case of the encoder 114C, a vector to be referenced is only shifted from a voice signal to an excitation signal and the structure is the same as that of the original encoder, except that a synthesizing filter and its adaptive processing are omitted. Therefore, the compatibility with the original ITU Recommendation G.728 coding system is assured. Also, it is easy to change the structure of the voice detector 110C to a structure based on an excitation signal because voice power is strongly reflected on excitation gain. Moreover, it is possible to improve the accuracy by extracting pitch information from an excitation signal.

[Embodiment 4]

Figure 7:
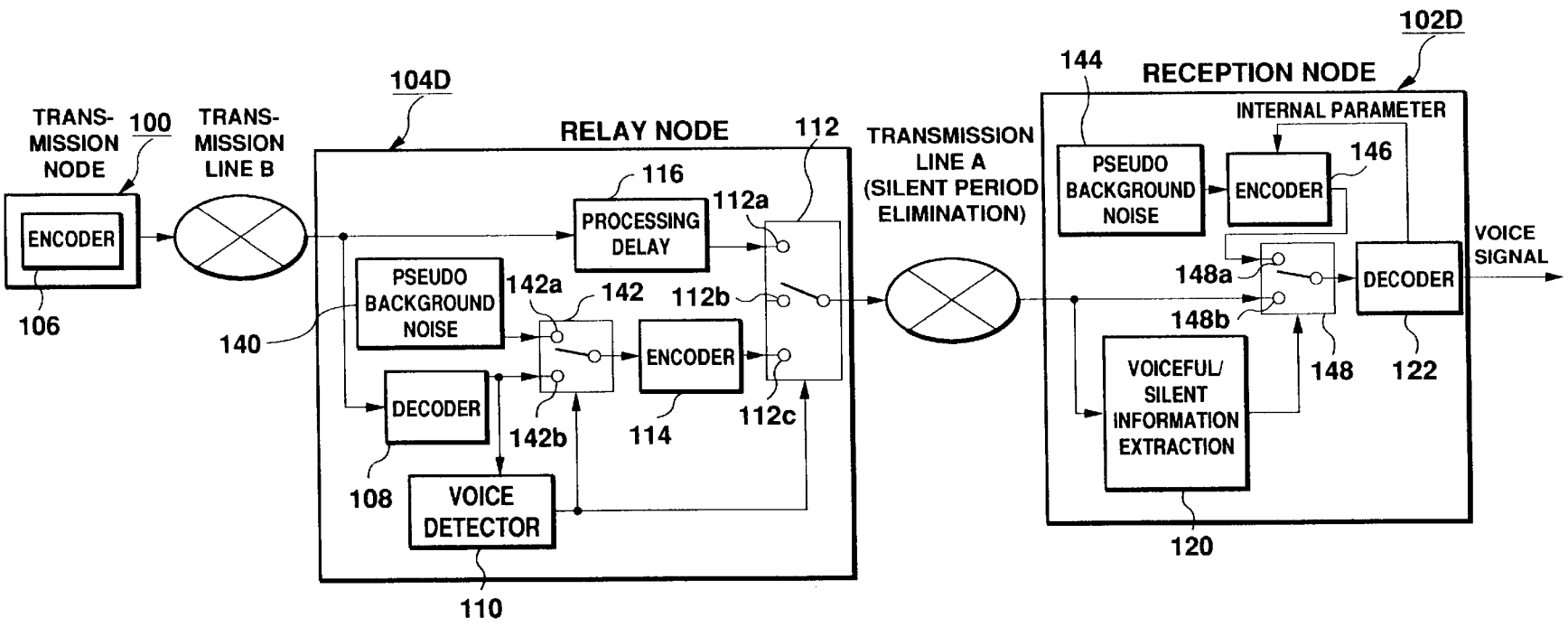
FIG. 7 is a block diagram of the voice coding-and-transmission system of the fourth embodiment.

FIG. 7 is a block diagram of the voice coding-and-transmission system of the fourth embodiment of the present invention. This embodiment is obtained by improving the relay node and reception node of the voice coding-and-transmission system of the embodiment 1. In FIG. 7, a component having the same function as that described for the embodiment 1 is provided with the same symbol and its description is not repeated. In the case of a modified component, the character D is added to the symbol in FIG. 1 so that how the component corresponds to that of the embodiment 1 can easily be understood. A relay node 104D has a pseudo background noise generator 140. An input from the encoder 114 is connected to either the pseudo background noise generator 140 or the decoder 108 by a changeover switch 142. In a reception node 102D, an output from a pseudo background noise generator 144 is coded by an encoder (noise encoder) 146. An input for the decoder 122 is connected to either the encoder 146 or the transmission line A by a changeover switch 148.

Operations of the fourth embodiment are described below by referring to FIG. 7. A voice code from the transmission line B is once decoded as a voice signal by the decoder 108 in the relay node 104D. The voice detector 110 detects presence or absence of a talk spurt in accordance with the voice signal and decides an operation mode of the relay node 104D in accordance with a detection result.

An coding/decoding system of the present invention has three operation modes. However, description of these operation modes is omitted because the operation modes are the same as those described for the embodiment 1.

The operation in mode 3 (voiceful state) is completely the same as the operation in mode 3 shown in the embodiment 1. In this case, it is possible to stop the encoder 146 at the reception node.

In the relay node 104D, when it is detected that the voice detector 110 changes from mode 3 to mode 1, the changeover switch 142 is connected to a terminal 142*a* and a changeover switch 112 is connected to the terminal 112*b*. Therefore, a pseudo background noise output from the pseudo background noise generator 140 is input to the encoder 114. The encoder 114 receives the input of the pseudo back ground noise and codes the noise. As a result, a signal obtained by high-efficiency-coding of the pseudo background noise is output from the encoder 114 and, moreover, internal variables of a filter factor and the like are adaptively updated. This operation is previously shown by taking ITU Recommendation G.728 as an example. In this case, because the high-efficiency-coded signal output from the encoder 114 is not connected to the changeover switch 112*c*, it is not output to the transmission line A. The voice detector 110 is always operated because it is necessary to continuously monitor the mode changes. Moreover, in the reception node 102D, the voice/silence information extractor 120 fetches mode information from a silent-period-vanished voice code transmitted from the transmission line A, extracts the information showing that the decision result of the voice encoder 110 is switched from mode 3 to mode 1, and outputs a control signal according to the information to the changeover switch 148 and the encoder 146. The changeover switch 148 is switched to the terminal-148*a* side in accordance with the control signal. Moreover, the encoder 146 loads the internal variables of the decoder 122 (e.g. synthesizing filter memory and adaptive gain) in a predetermined area of the encoder 146 by responding to the control signal and also makes its internal state coincide with that of the decoder 122. Thereafter, the encoder 146 starts coding by using a pseudo background noise output from the pseudo background noise generator 144 as its input.

The decoder 122 operates by using a high-efficiency background noise code output from the encoder 146 as its input. In this case, to continuously keep the same internal state of the encoder 114 and of the decoder 122, a high-efficiency background noise code output from the encoder 114 (the code is not actually output to a transmission line) must be completely the same as that output from the encoder 122. Because the internal state of the encoder 146 and that of the decoder 122 are kept so that both internal states are equal, a pseudo background noise output from the pseudo background noise generator 144 must be the same as a pseudo background noise output from the pseudo background noise generator 140 in the relay node 104D.

As described above, by setting the pseudo background noise generator 144 and the encoder 146 to the reception node 102D, it is possible to avoid an indefinite state during the silent periods described for the prior art because setting of the generator 144 and the encoder 146 is equivalent to setting of a pseudo transmission node to the reception node 102D. Therefore, the pseudo background noise generator 140 supplies a reference value for differential coding to the encoder 114 when changing from mode 1 to mode 2 (that is, at start of voicing) and the pseudo background noise generator 144 and the encoder 146 supply a reference value for differential coding to the decoder 122 at start of voicing). Therefore, the incoincidence between the internal states of the encoder 114 of the relay node 104D and the decoder 122 of the reception node 102D does not occur and abnormal sound at the change of operation modes from 1 to 2 can be avoided. However, it is necessary to consider that the internal states of the encoder 106 and the decoder 122 still do not coincide with each other. Operations of the relay node 104D in mode 2 are described below. When the voice detector 110 detects the head of a talk spurt, it transmits a control signal to the changeover switch 142 and the silent period eliminator 112. By responding to the control signal, the changeover switch 142 is switched to the terminal-142*b* side and a changeover switch in the silent period eliminator 112 is switched to the terminal-112*c* side. Thereby, in the relay node 104D, a voice signal decoded by the decoder 108 is coded as a high-efficiency voice code again by the encoder 114 and the high-efficiency voice code is output to the transmission line A from the relay node 104D. In the reception side 102D, when the voice/silence information extractor 120 detects the change to operation mode 2, it outputs a control signal to the changeover switch 148. The changeover switch 148 is switched to the terminal-148*b* side by the control signal. The decoder 122 decodes an output of the encoder 114 input from the transmission line A. When the period of mode 2 continues, the internal states of the encoder 106 and the decoder 122 of the transmission node 100 approach each other. Therefore, no abnormal sound is produced, even if operation modes are thereafter changed from 2 to 3. As described above, it is possible to avoid quality degradation and fully realize the performance of a high-efficiency voice coding system. Moreover, it is possible to decrease the processor processing load and the hardware scale of the relay node 104D.

[Embodiment 5]

Figure 8:
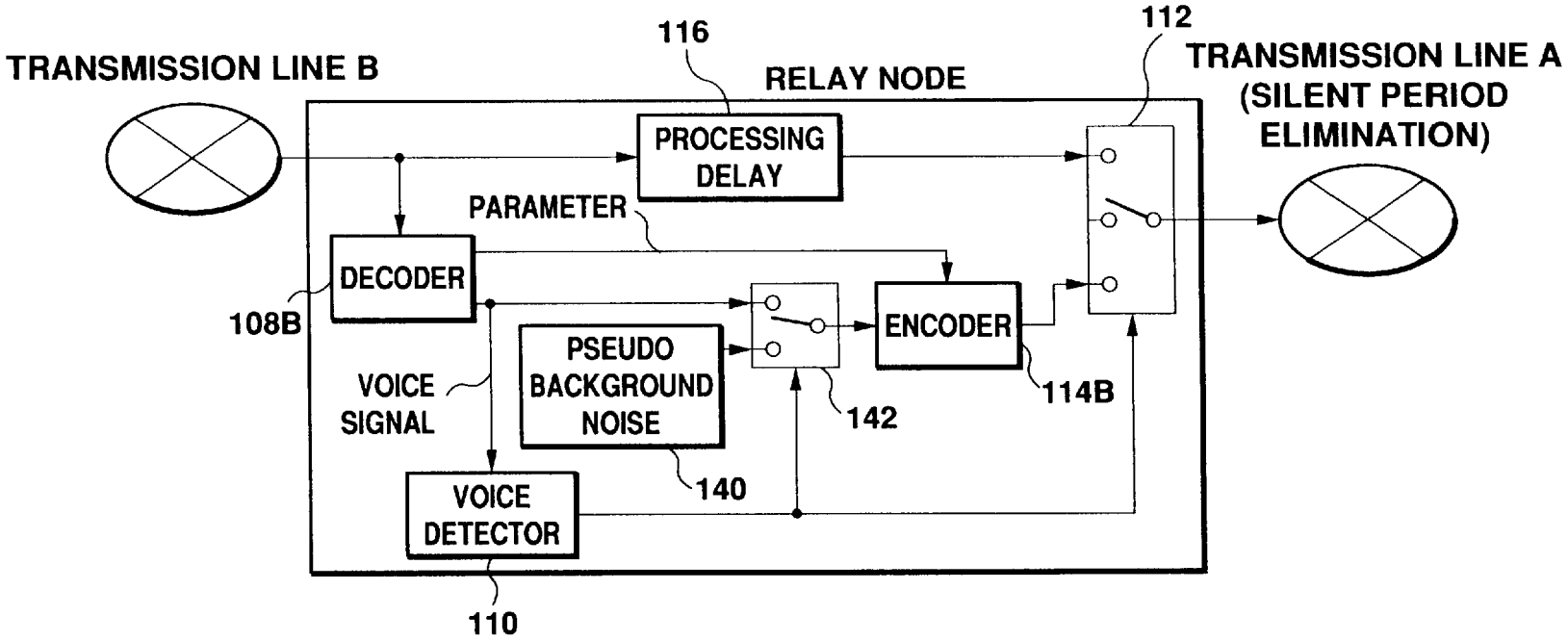
FIG. 8 is a block diagram of a relay node related to the fifth embodiment.

FIG. 8 is a block diagram of a relay node for explaining the fifth embodiment of the present invention. This embodiment is obtained by applying the same improvement as that shown in the embodiment 2 to the relay node of the embodiment 4. That is, a relay decoder and relay encoder use the decoder 108B and the encoder 114B having the same function as that of the embodiment 2 respectively. The decoder 108B decodes a voice signal and outputs some adaptive parameters. In the case of the encoder 114B, it is possible to omit the processing for generating these adaptive parameters. This improvement decreases the processing load and hardware scale of the relay node.

The decoder 108B decodes a voice signal and outputs some adaptive parameters. An adaptive parameter is a voice parameter to be generated in high-efficiency coding such as ADPCM to form a voice signal. The encoder 114B receives the voice signal and adaptive parameters. In the case of the encoder 114B, it is possible to omit the processing for generating input adaptive parameters. Most operations of this voice coding-and-transmission system are the same as those of the embodiment 4, except that the decoder 108B fetches adaptive parameters and the encoder 114B uses them similar to the case of the embodiment 2.

[Embodiment 6]

Figure 9:
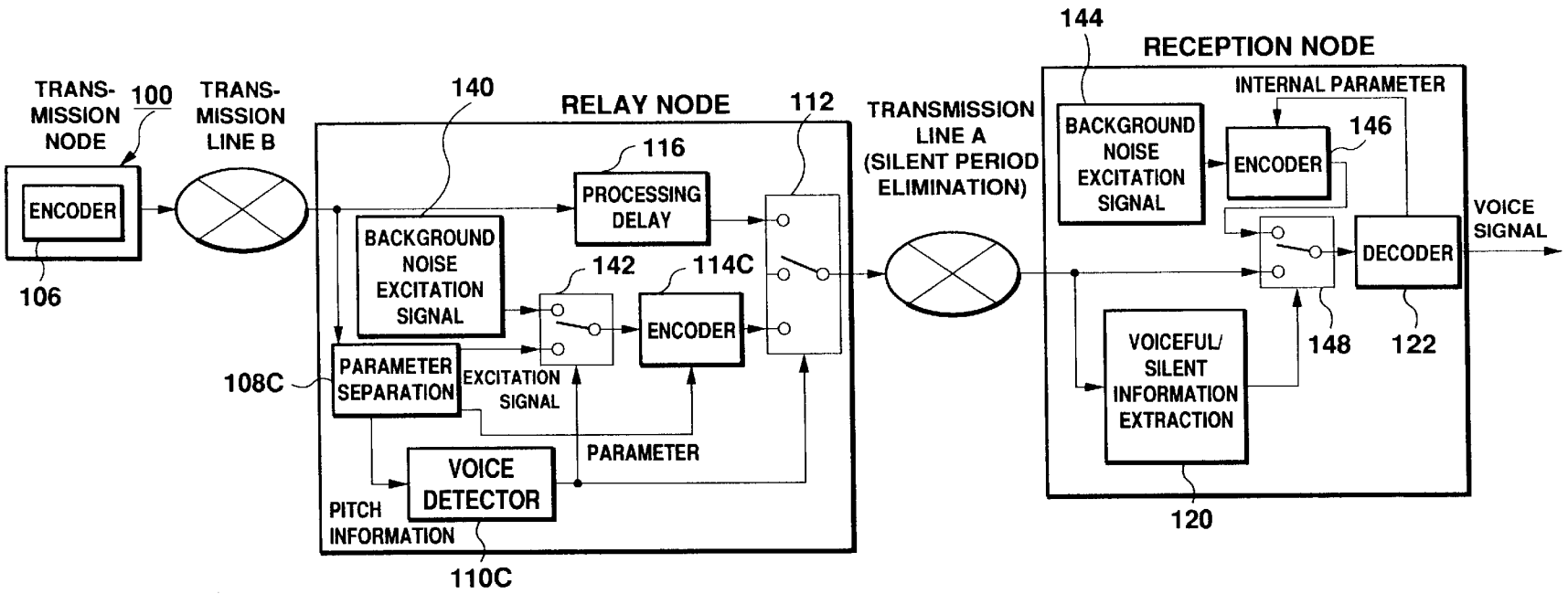
FIG. 9 is a block diagram of the voice coding-and-transmission system of the sixth embodiment.

FIG. 9 is a block diagram of the voice coding-and-transmission system of the sixth embodiment of the present invention. This embodiment is obtained by further applying the same improvement as that shown in the embodiment 3 to the relay node of the embodiment 5. That is, a relay decoder, relay encoder, and voice detector use the parameter separator 108C, encoder 114C, and voice detector 110C having the same function as the embodiment 3 respectively.

The parameter separator 108C fetches only some of the adaptive parameters included in a voice signal while the encoder 114 generates a voice code instead of a complete voice signal in accordance with some of the adaptive parameters. This improvement further decreases the processing load and hardware scale of the relay node.

[Embodiment 7]

Figure 10:
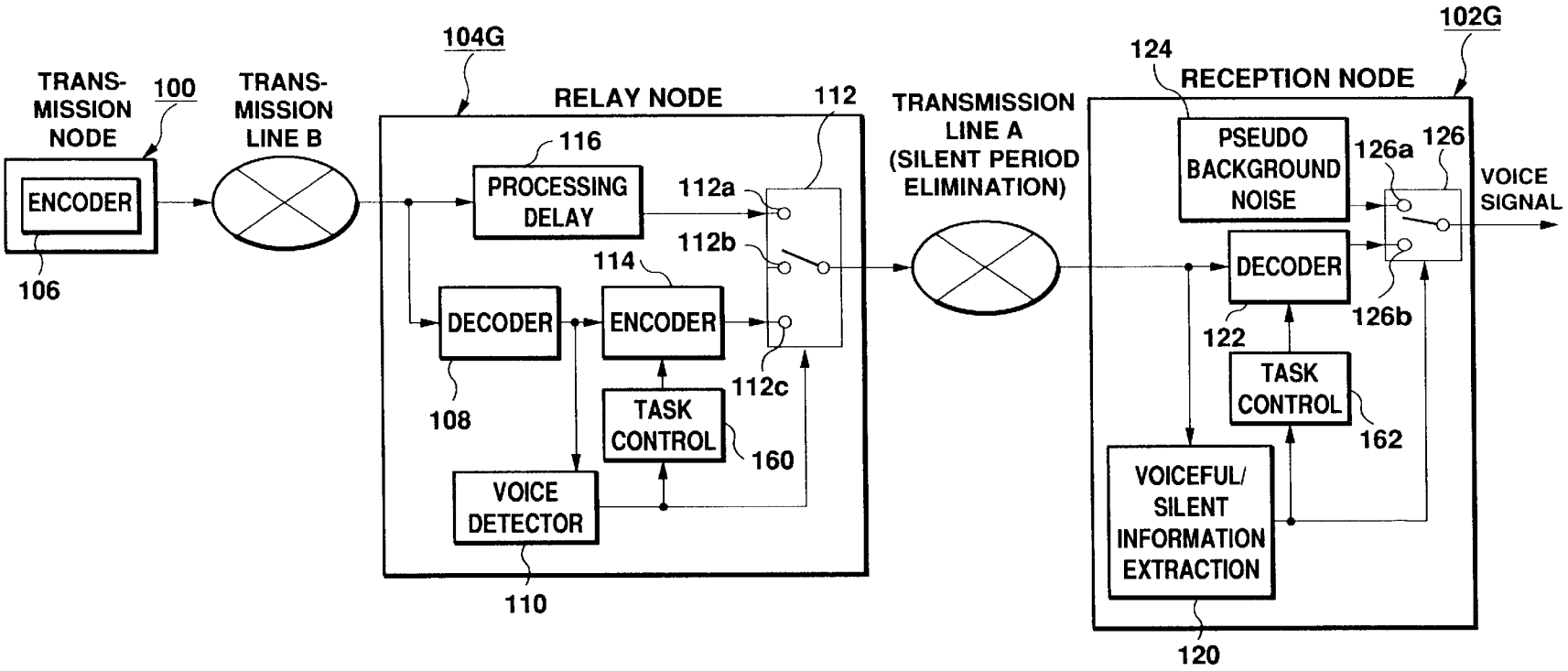
FIG. 10 is a block diagram of the voice coding-and-transmission system of the seventh embodiment.

FIG. 10 is a block diagram of the voice coding-and-transmission system of the seventh embodiment of the present invention. This embodiment is obtained by improving the relay node and the reception node of the voice coding-and-transmission system of the embodiment 1 of the present invention. In FIG. 10, a component having the same function as that described for the embodiment 1 is provided with the same symbols as in FIG. 1 and its description is not repeated. In the case of a modified component, the character G is added to the symbol in FIG. 1 so that how the component corresponds to that of the embodiment 1 can easily be understood. A relay node 104G and a reception node 102G have respective task controllers 160 and 162. The task controller 160 controls operations of the encoder 114 in accordance with a control signal output from the voice detector 110. The task controller 162 controls the decoder 122 in accordance with a control signal output from the voice/silence information extractor 120.

Then, operations of the embodiment 7 are described below by referring to FIG. 10. In the relay node 104G, the decoder 108 once decodes a voice code sent from the transmission node 100. The voice detector 110 detects presence or absence of a talk spurt in accordance with the voice signal and decides an operation mode of the relay node in accordance with a detection result.

The coding/decoding system of the present invention has three operation modes. However, description of the operation modes is omitted because the operation modes are the same as those described for the embodiment 1.

The operation in mode 3 is completely identical to that mode 3 shown in the embodiment 1. In this case, however, the encoder 114 of the relay node 104G codes a voice signal output from the decoder 108.

In the relay node 104G, when the voice detector 110 detects the change of operation modes from 3 to 1, it transmits a control signal to the silent period eliminator 112. A changeover switch in the silent period eliminator 112 responds to the control signal to connect with the terminal 112*b* and stop the output of a voice code from the relay node 104G. Moreover, the control signal is sent to the task controller 160. The task controller 160 responds to the control signal and sends a control signal for stopping the coding operation of the encoder 114 to the encoder 114. The encoder 114 responds to the control signal to stop the coding operation while holding the contents (e.g. synthesizing filter factor and adaptive gain) in its internal memory. The encoder 114 does not perform any coding while holding the contents of the internal memory as long as the state of mode 1 continues since the mode change.

In the reception node 102G, the voice/silence information extractor 120 fetches mode information from a silent-period-vanished voice code transmitted from the transmission line A and sends a control signal corresponding to the change of operation modes from 3 to 1 to the changeover switch 126 and the task control section 162. The changeover switch 126 is switched to the terminal-126*a* side. The task controller 162 responds to the control signal to stop the decoding operation of the decoder 122 while holding the contents of the internal memory. The decoder 122 does not perform decoding at all while holding the contents of the internal memory as long as the state of mode 1 continues since the mode change.

In the relay node 104G, when the voice detector 110 detects the change of operation modes from 1 to 2, it switches a changeover switch in the silent period eliminator 112 to the terminal-112*c* and sends a control signal for notifying the change of operation modes from 1 to 2 to the task controller 160. The task controller 160 responds to this control signal and outputs a control signal for restarting coding to the encoder 114. The encoder 114 responds to the control signal to restart coding by using the contents (e.g. synthesizing filter factor and adaptive gain) held in the internal memory since the change of operation modes from 3 to 1 without initializing the contents as reference values for differential coding/decoding. A high-efficiency voice code output from the encoder 114 is output to the transmission line A from the relay node and transmitted to the reception node 102G. Moreover, the voice/silence information extractor 120 fetches mode information from a silent-period-vanished voice code transmitted from the transmission line A and transmits a control signal corresponding to the change of operation modes from 1 to 2 to the changeover switch 126 and the task control section 162. The changeover switch 126 is switched to the terminal-126*b* side in accordance with the control signal. The task controller 162 responds to the control signal and outputs a control signal for restarting decoding to the decoder 122. The decoder 122 responds to the control signal to restart decoding by using the contents held in the internal memory since the change of operation modes from 3 to 1 as the reference values for differential coding/decoding without initializing the contents. The decoder 122 decodes an output of the encoder 114 of the relay node 104G and outputs a voice signal.

As described above, it is possible to avoid an indefinite state of the decoder described for the prior art by setting the task controllers 160 and 162 to the relay node 104G and the reception node 102G respectively and synchronizing the processing schedule of the encoder 114 with that of the decoder 122. Thus, the task controller 160 determines a reference value for differential coding at the change of the encoder 114 to mode 2 (that is, at start of voicing) and the task controller 162 determines a reference value for differential coding at start of voicing for the decoder 122. Therefore, the incoincidence between the internal states of the encoder 114 of the relay node 104G and the decoder 122 of the reception node 102G does not occur and it is possible to avoid abnormal sound at the change of operation modes from 1 to 2. However, it is necessary to consider that the internal states of the encoder 106 and the decoder 122 still do not coincide with each other.

Operations of this embodiment in mode 2 are basically the same as those of the embodiment 1. In the relay node 104G, when the voice detector 110 detects the head of a talk spurt, it sends a control signal to the silent period eliminator 112. By responding to the control signal, a changeover switch in the silent period eliminator 112 is switched to the terminal-112*c* side. Thereby, in the relay node 104G, a voice signal decoded by the decoder 108 is coded as a high-efficiency voice code again by the encoder 114 and the high-efficiency voice code is output to the transmission line A from the relay node 104G. In the reception side 102G, when the voice/silence information extractor 120 detects the change to operation mode 2, it outputs a control signal to the changeover switch 126. The changeover switch 126 is switched to the terminal-126*b* side in accordance with the control signal. The decoder 122 decodes an output of the encoder 114 input from the transmission line A. When the period of mode 2 continues, the internal states of the encoder 106 and the decoder 122 of the transmission node 100 adequately approach as described for the embodiment 1. Thereafter, no abnormal sound is produced, even if operation modes are changed from 2 to 3. As described above, it is possible to avoid quality degradation and fully realize the performance of a high-efficiency voice coding system by limiting the period for performing tandem connection, which is known to cause voice quality degradation, to the short time of a transient period for the change from a silent state to a voice state and connecting most talk spurts by digital-one-link. Moreover, it is possible to decrease the processor processing load and hardware scale of the relay node 104G.

[Embodiment 8]

Figure 11:
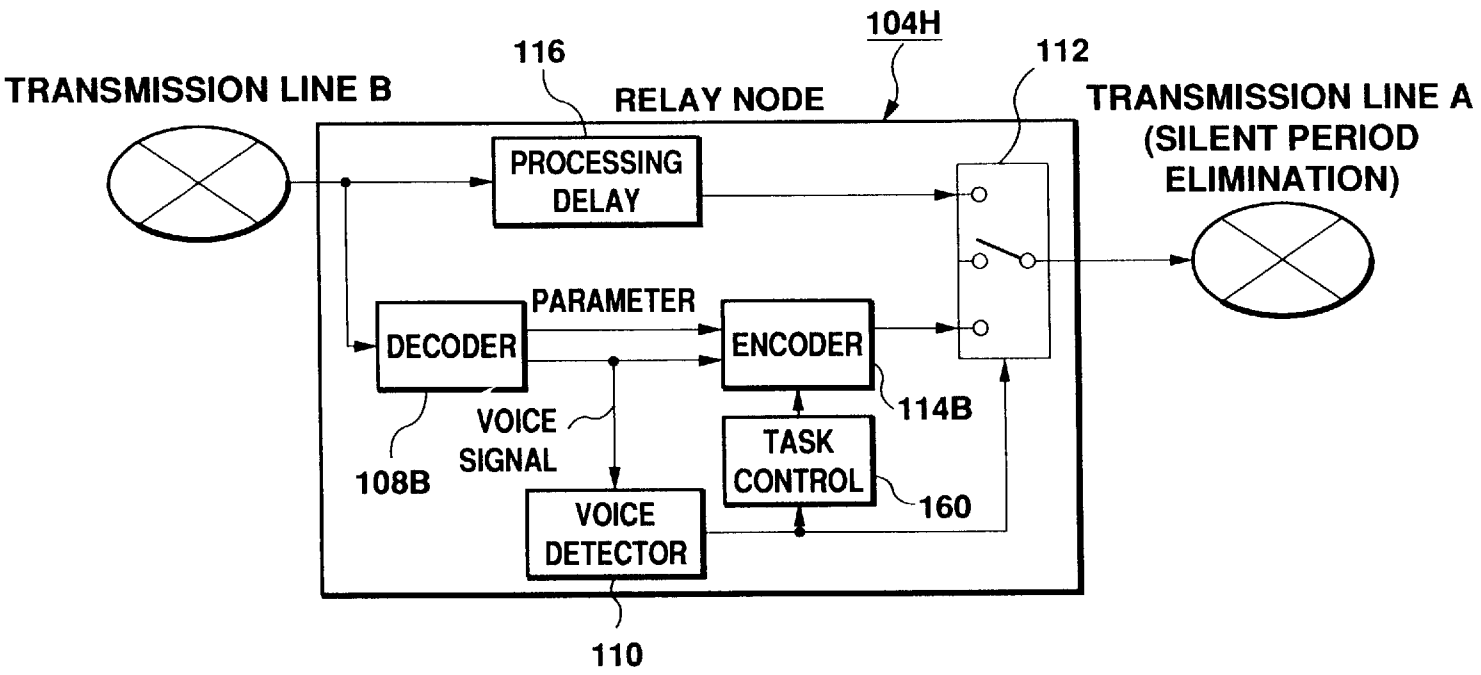
FIG. 11 is a block diagram of a relay node related to the eighth embodiment.

FIG. 11 is a block diagram of a relay node for explaining the eighth embodiment of the present invention. This embodiment is obtained by applying the same improvement as shown in the embodiment 2 to the relay node of the embodiment 7. That is, a relay decoder and a relay encoder use the decoder 108B and the encoder 114B having the same respective functions as those of the embodiment 2. The decoder 108B decodes a voice signal and outputs some of adaptive parameters. In the case of the encoder 114B, it is possible to omit the processing for generating the adaptive parameters. This improvement decreases the processing load and hardware scale of the relay node.

[Embodiment 9]

Figure 12:
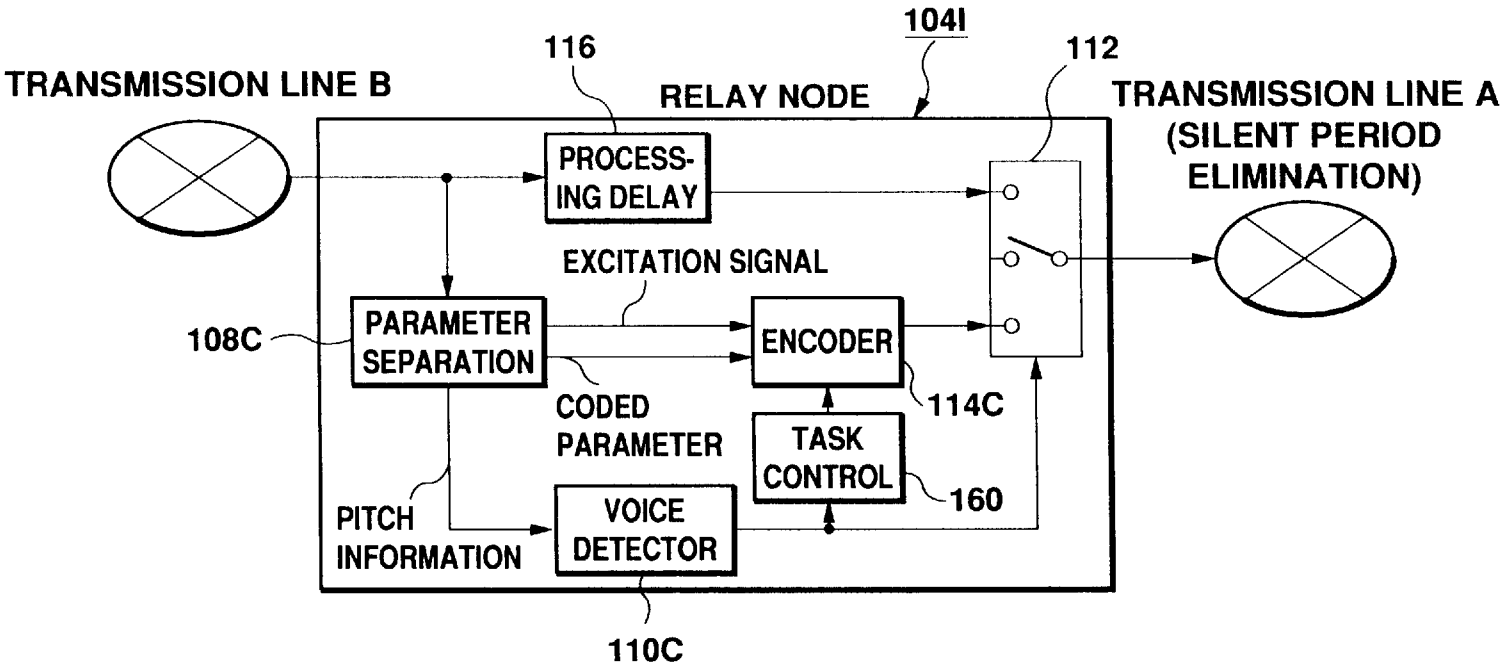
FIG. 12 is a block diagram of the voice coding-and-transmission system of the ninth embodiment.

FIG. 12 is a block diagram of the voice coding-and transmission system of the ninth embodiment of the present invention. This embodiment is obtained by further applying the same improvement as that shown in the embodiment 3 to the relay node of the embodiment 7. That is, a relay decoder, relay encoder, and voice detector use the parameter separator 108C, encoder 114C, and voice detector 110C having the same respective functions as in embodiment 3. The parameter separator 108C fetches only some of the adaptive parameters included in a voice signal and generates, instead of a complete voice signal, a voice code in accordance with the fetched adaptive parameters. This improvement further decreases the processing load and hardware scale of the relay node. As described above, the embodiments 1 to 9 basically perform synchronous resetting between a relay encoder of a relay node and a reception decoder of a reception node at start of voicing.

[Embodiment 10]

Figure 13:
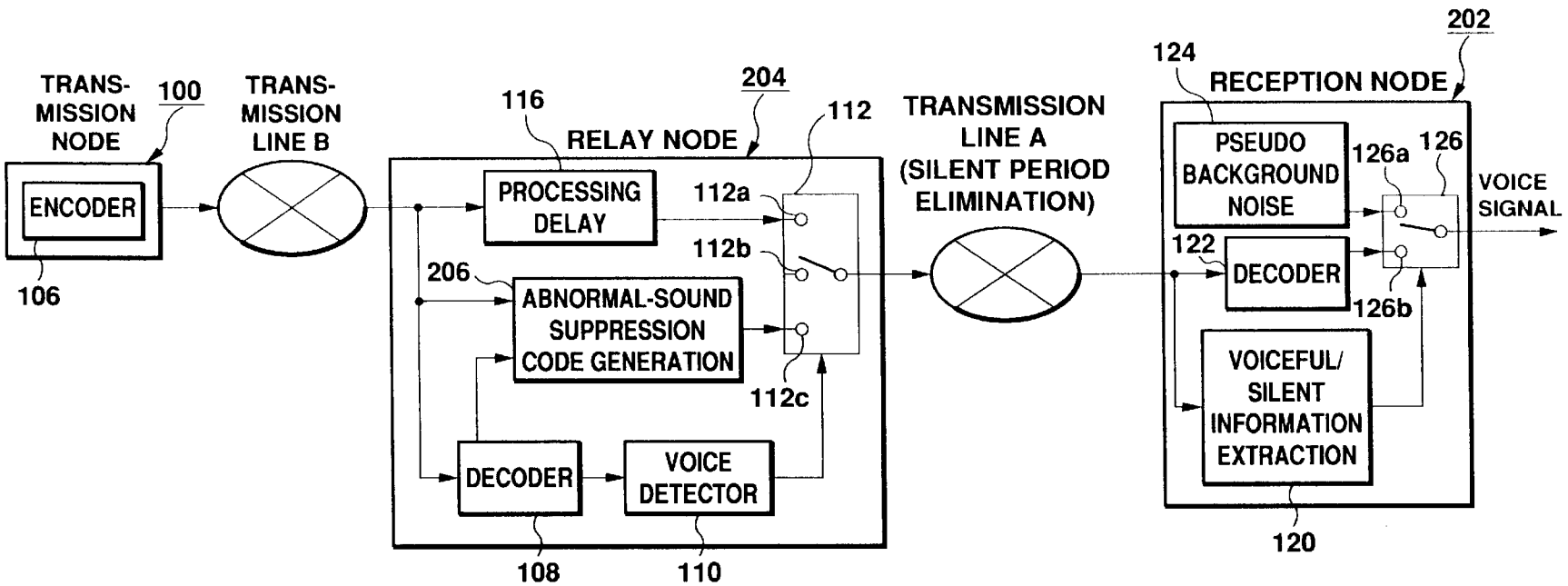
FIG. 13 is a block diagram of the voice coding-and-transmission system of the tenth embodiment.

FIG. 13 is a block diagram of the voice coding-and-transmission system of the tenth embodiment of the present invention. This embodiment does not perform the above synchronous resetting between a relay encoder and a reception decoder at start of voicing, but most components of this embodiment are common to those of the embodiments 1 to 9. Therefore, in FIG. 13 as well, in order to simply the description, a component having the same function as that described for the embodiment 1 is provided with the same symbol as in FIG. 1.

A relay node 204 has an abnormal-sound suppression code generator 206 instead of a relay encoder such as the encoder 114. The abnormal-sound suppression code generator 206 is also a form of encoder. However, the generator 206 is different from the encoder 114 in that it generates a voice code for suppressing abnormal sound when the abnormal sound may be produced. Because this embodiment does not perform synchronous resetting as described above, neither the relay node 204 nor the reception node 202 require any means for determining a reference value for differential coding/decoding at start of voicing, that is, the memories 118 and 128 of the embodiment 1, the pseudo background noise generators 140 and 144 of the embodiment 4, or the task controllers 160 and 162 of the embodiment 7.

Operations of the embodiment 10 are described below by referring to FIG. 13. In the relay node 204, the decoder 108 once decodes a voice code sent from the transmission node 100 as a voice signal. The voice detector 110 detects the presence or absence of a talk spurt in accordance with the voice signal and decides an operation mode of the relay node according to a detection result.

In this case, the coding/decoding system of the present invention has three operation modes. Description of these operation modes is omitted because the operation modes are the same as those described for the embodiment 1. First, the operation in mode 3 (voice state) is completely identical to that in mode 3 shown in the embodiment 1. In the relay node 204, when the voice detector 110 detects the change of operation modes from 3 to 1, it sends a control signal to the silent period eliminator 112. A changeover switch in the silent period eliminator 112 corresponds to the control signal to be switched to the terminal-112*b* side and the output of a voice code from the relay node 204 stops. The voice detector 110 is continuously operated because it is necessary to monitor the change of operation modes. However, the abnormal-sound suppression code generator 206 does not to be operated.

Moreover, in the reception node 202, the voice/silence information extractor 120 fetches mode information from a silent-period-vanished voice code transmitted from the transmission line A and outputs a control signal according to the change of operation modes from 3 to 1 to the changeover switch 126. The changeover switch 126 is switched to the terminal-126*a* side in accordance with the control signal, a pseudo background noise of the pseudo background noise generator 124 is output from the reception node 202, and a natural silent state is transferred to a receiver.

When the voice detector 110 detects the change of operation modes from 1 to 2, it sends the silent period eliminator 112 a control signal for notifying of the change from a silent state to a voiceful state. A changeover switch in the silent period eliminator 112 responds to the control signal to be switched to the terminal-112*c* side. Moreover, the abnormal-sound suppression code generator 206 starts operation in accordance with the control signal.

When operation modes change from 1 to 2, the internal state of the encoder 106 of the transmission node 100 is different from that of the decoder 122 of the reception node 202 as described for the prior art. Therefore, when an output of the encoder 16 is directly relayed and input to the decoder 122, abnormal sound may be produced as described for the prior art. In this case, the abnormal-sound suppression code generator 206 serves as a unit for outputting a corrected voice code obtained by correcting a high-efficiency voice code output from the encoder 106. The corrected voice code is an optimized voice code which causes little abnormal sound, even if it is input to a decoder 122 having a different internal state.

If the internal state of the encoder 106 coincides with that of the decoder 122, no abnormal sound is produced even if any voice signal is input to the encoder because the stability of the coding/decoding system is assured. However, because the internal states of the encoder and decoder are different form each other under the condition of mode 2, the probability is very high that the coding/decoding system is an unstable system. When a voice signal with a large gain value is input to the encoder 106, the unstable system causes sudden divergence of the gain value and produces abnormal sound such as "gya" or "bu" (phonetic). One of the methods for preventing such abnormal sound is to moderate the divergence rate by attenuating the gain value of a voice signal input to the unstable coding/decoding system. The incoincidence between the internal states of the encoder 106 and the decoder 122 tends to converge under the condition of mode 2. Therefore, it is possible to suppress abnormal sound due to divergence of the system by setting an attenuated gain value so that the divergence rate is sufficiently more moderate than the convergence rate.

A case in which a high-efficiency coding system according to ITU Recommendation G.728 is described below as a specific structure of the abnormal-sound suppression code generator 206 (see FIG. 28). One of the methods for attenuating the gain value of a voice signal is a method of noticing the value of a gain codebook. The abnormal-sound suppression code generator 206 always monitors the power of a voice signal input to the encoder 106 by using a voice signal decoded by the decoder 108 of the relay node 204. When the generator 206 detects the input of a high-gain voice signal, it limits the value of a gain code. That is, when the abnormal-sound suppression code generator 206 selects a gain code having the threshold value or more, it forcibly replaces the gain code with a gain code having the threshold value or less in the period of mode 2. The replaced gain code is returned to the encoder 106 and used for the adaptive operation of a local decoder.

In the reception node 202, the voice/silence information extractor 120 fetches mode information from a silent-period-vanished voice code transmitted through the transmission line A and outputs a control signal according to the change of operation modes from 1 to 2 to the changeover switch 126. The changeover switch 126 is switched to the terminal-126*b* side in accordance with the control signal. High-efficiency-coded data input to the decoder 122 does not require special processing because it is already abnormal-sound-suppressed.

When the voice detector 110 decides mode 3, it switches a changeover switch in the silent period eliminator 112 to the terminal-112*a* side and directly outputs a high-efficiency voice code sent from the encoder 106 of the transmission node 100 to the transmission line A. Operations of the reception node 202 are the same as those in mode 2.

As described above, the present voice coding-and-transmission system avoids abnormal sound by suppressing gain in the transient period immediately after start of voicing which may cause abnormal sound, the biggest factor of voice quality degradation. Because the system is realized only by adding simple circuits such as a power monitor and a limiter, it is possible to decrease the processor processing load and hardware scale compared to the other embodiments above. Moreover, because operations are performed in a short transient period immediately after start of voicing and an output of the encoder 106 is directly transmitted in a voice period (mode 3) after the transient period, it is possible to avoid quality degradation and fully realize the performance of a high-efficiency voice coding system.

[Embodiment 11]

Figure 14:
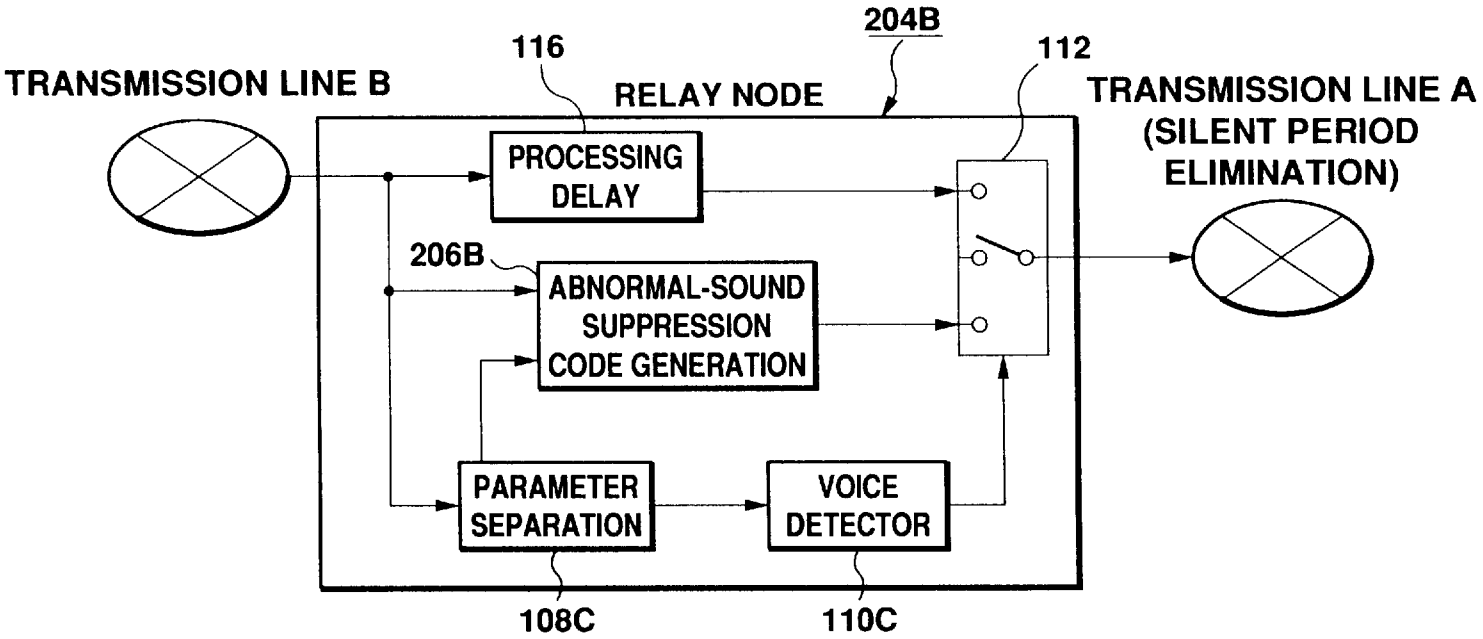
FIG. 14 is a block diagram of a relay node related to the eleventh embodiment.

FIG. 14 is a block diagram of a relay node for explaining the eleventh embodiment of the present invention. This embodiment is obtained by applying the improvement similar to that shown in the embodiment 3 to the relay node of the embodiment 10. In FIG. 14, the transmission node 100 and the reception node 202 are not illustrated because they are the same as those described for the embodiment 10 and only the relay node is shown. Moreover, in FIG. 14, a component having the same function as that described for the embodiment 10 is provided with the same symbol as in FIG. 10 and its description is not repeated. In the case of a modified component, the character B is added to the symbol in FIG. 10 so that the corresponds once with the components of the embodiment 10 can easily be understood. This embodiment is different from the embodiment 10 in that a relay decoder and a voice detector use the parameter separator 108C and the voice detector 110C having the same respective functions as in embodiment 3 and an abnormal-sound suppression code generator 206B corresponding to the separator 108C and the detector 110C. The parameter separator 108C fetches only some of the adaptive parameters included in a voice signal and outputs them to the abnormal-sound suppression code generator 206B. The fetched adaptive parameters include gain codes. The abnormal-sound suppression code generator 206B generates a voice code instead of a complete voice signal in accordance with the fetched voice parameters. The parameter separator 108C outputs, for example, pitch information (or excitation signal information) to the voice detector 110C. The voice detector 110C detects voice in accordance with the pitch information (or the excitation signal information). This improvement further decreases the processing load and hardware scale of the relay node.

[Embodiment 12]

Figure 15:
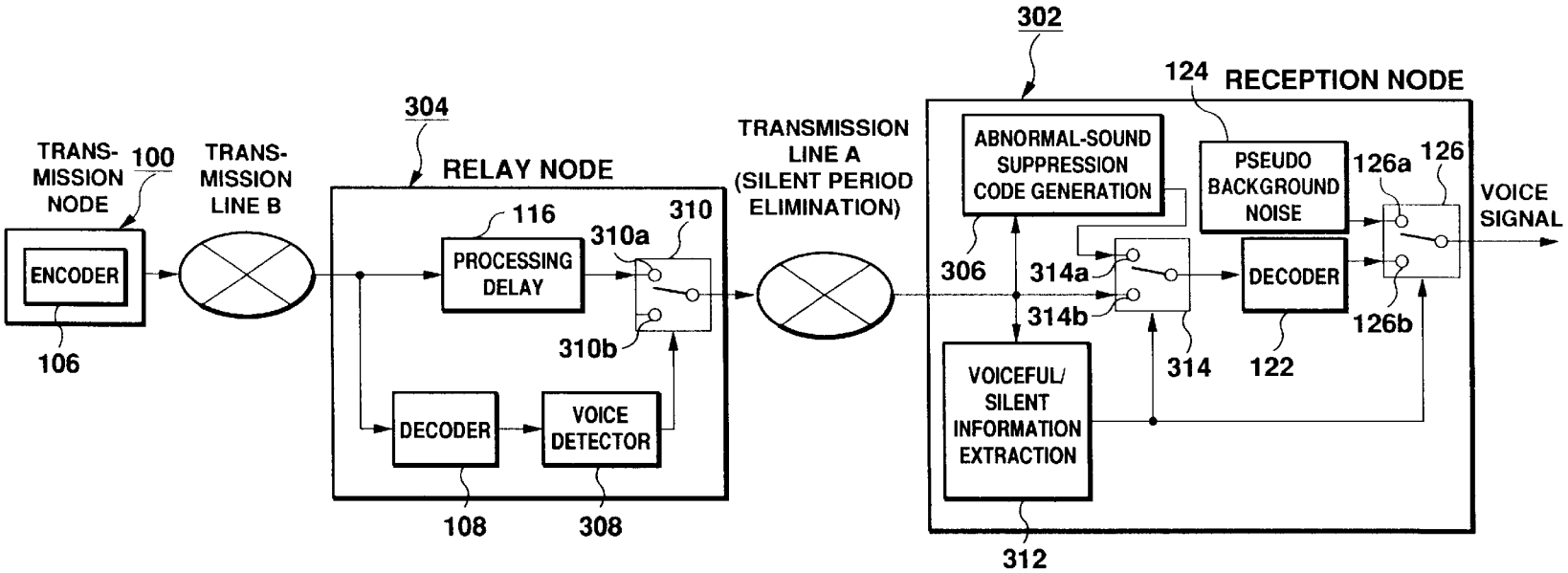
FIG. 15 is a block diagram of the voice coding-and-transmission system of the twelfth embodiment.

FIG. 15 is a block diagram of the voice coding-and transmission system of the twelfth embodiment of the present invention. Many components of this embodiment are common to those of the embodiment 1. Therefore, in FIG. 15, a component having the same function as that described for the embodiment 1 is provided with the same symbol as in FIG. 1.

This embodiment is a system using an abnormal-sound suppression code generator the same as the embodiment 10 does. However, this embodiment has an abnormal-sound suppression code generator 306 having the same function as the abnormal-sound suppression code generator 206 of the embodiment 10 at the reception node 302 side. A relay node 304 operates in the same way in both mode 2 and mode 3. That is, a voice detector 308 of the relay node 304 generates a control signal corresponding to a voice period or a silent period in accordance with a voice signal decoded by the decoder 108. A silent period eliminator 310 has a built-in changeover switch having two switching terminals corresponding to the voice period or silent period. A voice/silence information extractor 312 of the reception node 302 outputs control signals corresponding to three operation modes. A changeover switch 314 connects the abnormal-sound suppression code generator 306 or transmission line A to the decoder 122 in accordance with the control signals.

Operations of the embodiment 12 are described below. In mode 1, a change over switch of the silent period eliminator 310 is connected to the terminal-310*b* side but there are no connections to the transmission line A. That is, silent-period-eliminating is performed. In this case, in the reception node 302, the changeover switch 126 is connected to the terminal-126*a* side and a pseudo background noise is output to a receiver.

In modes 2 and 3, that is, in a full voice period, a changeover switch in the silent period eliminator 310 is connected to the terminal-310*a* side in accordance with a control signal from the voice detector 308 and a high-efficiency voice code is directly transmitted to the transmission line A from the transmission node 100.

Thus, though mode 2 and mode 3 are not distinguished in the relay node 304, they are distinguished in the reception node 302. This point is opposite from the case of the embodiment 10. In the reception node 302, when operation modes change from 1 to 3, the changeover switch 314 is switched to the terminal-314*a* side in accordance with a control signal from the voice/silence information extractor 312 and the changeover switch 126 is switched to the terminal-126*b* side. Thereby, in mode 2, the abnormal-sound suppression code generator 306 converts a silent-period-vanished voice code to a corrected voice code in which similar gain adaptation of the voice code is performed as in the case of the embodiment 10 and the decoder 122 decodes the corrected voice code to generate a voice signal and output it to a receiver. Abnormal sound is suppressed because gain adaptation of the voice code is performed and it is possible to prevent abnormal sound, even if the present operation mode thereafter changes to operation mode 3, because shifting between the internal states of the encoder 106 and decoder 122 of the transmission node is performed gradually.

In the reception node 302, when the voice detector 308 decides mode 3, the changeover switch 314 is switched to the terminal-314*b* side in accordance with a control signal from the voice/silence information extractor 312 and the decoder 122 receives a high-efficiency voice code generated by the transmission node 100 from the transmission line A.

By using this method, an advantage preferable for practical use, in addition to the advantages of the embodiment 10, is obtained because it is possible to house an existing relay node without improving it.

[Embodiment 13]

Figure 16:
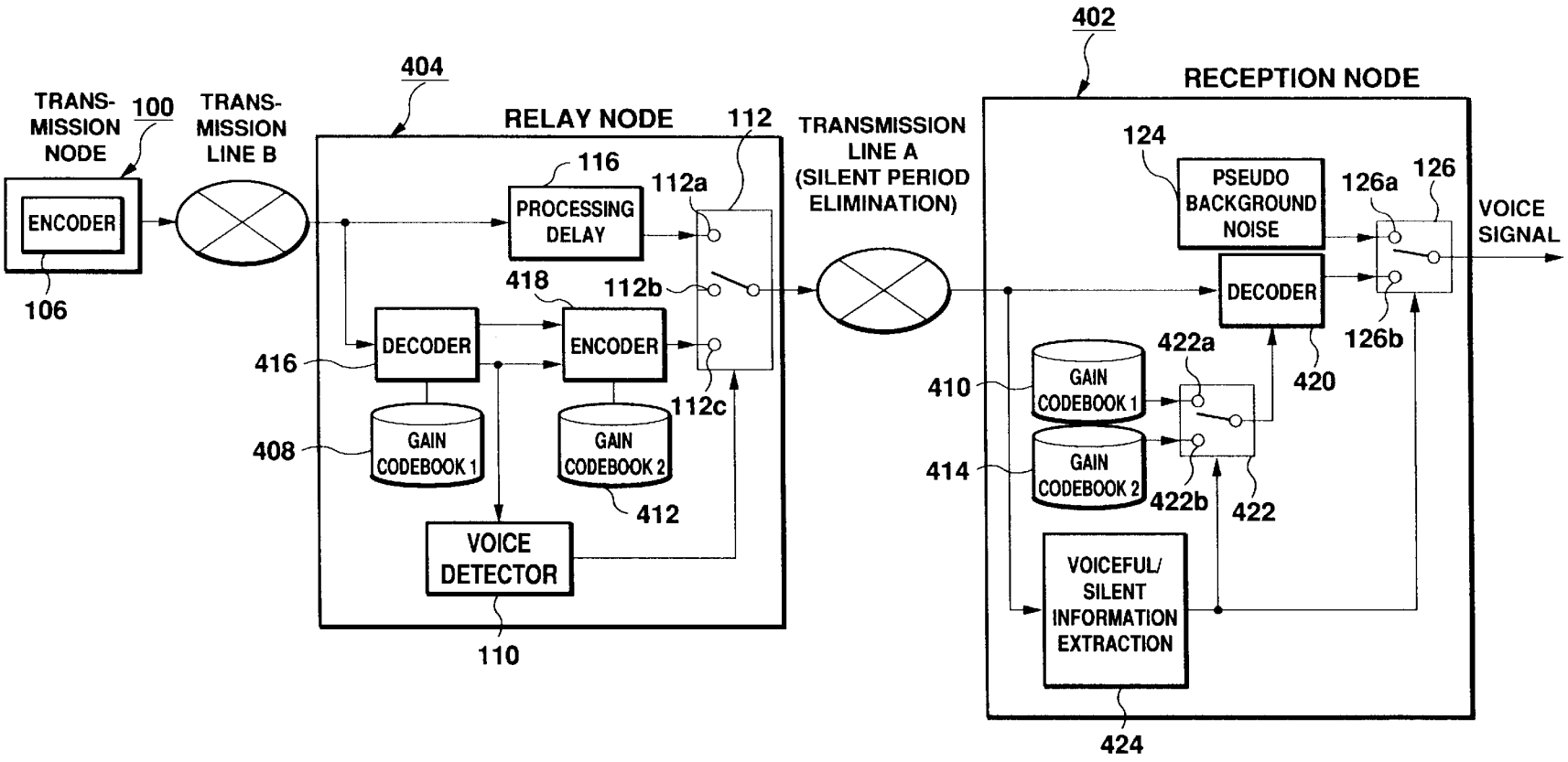
FIG. 16 is a block diagram of the voice coding-and-transmission system of the thirteenth embodiment.

FIG. 16 is a block diagram of the voice coding-and-transmission system of the thirteenth embodiment of the present invention. In FIG. 15, a component having the same function as that described for the embodiment 1 is provided with the same symbol as in FIG. 1. This embodiment uses the high-efficiency voice coding system according to ITU Recommendation G.728 . However, a high-efficiency coding system applicable to the present invention is not restricted to the above voice coding system.

This embodiment is described below by referring to FIG. 16. In a relay node 404, coding/decoding related to gain is performed by using a gain codebook. The gain codebook makes one gain correspond to every several ranges provided for the gain value of a voice signal as a quantized value. A gain code is made to correspond to the quantized value. In FIG. 16, standard gain codebooks 408 and 410 are the same normally used codebooks. Specifically, he standard gain codebooks 408 and 410 are memories storing gain codebooks specified by ITU Recommendation G.728. Suppressed gain codebooks 412 and 414 are memories storing gain codebooks having only quantized gain values causing no divergence, even for an unstable coding/decoding system, by attenuating the quantized values of he standard gain codebooks 408 and 414. That is, a suppressed gain codebook and a standard gain codebook have the same range section (gain value range) for gain values. In the same range, for example, the quantized gain value of the suppressed gain codebook is given a value further attenuated than that of the standard gain codebook, that is, a smaller value. An attenuation degree is set to a larger value for a gain value range at a higher position. It is also possible to used a suppressed gain codebook having a gain value range different from that of a standard gain codebook. For example, it is possible that the lower limit of the highest gain value range of a suppressed gain codebook is smaller than that of a standard gain value codebook. In this case, it is possible to set the quantized gain value corresponding to the highest gain value range of the suppressed gain codebook to a quantized gain value attenuation degree higher than the above case of having the same gain value range and thereby, obtain a suppressed gain codebook having a high abnormal-sound suppression effect, as will be mentioned later.

A decoder 416 performs decoding by using the standard gain codebook 408, an encoder 418 performs coding by using the suppressed gain codebook 412, and a decoder 420 performs decoding by switching the standard gain codebook 410 and the suppressed gain codebook 414. Gain codebooks to be connected to the decoder 420 are switched by a changeover switch 422. The changeover switch 422 is switched by a control signal sent from a voice/silence information extractor 424. The coding/decoding system of the present system has three operation modes described for the embodiment 1. The voice/silence information extractor 424 outputs control signals corresponding to these three operation modes in the same way as the voice/silence information extractor 312 of the embodiment 12.

Operations of this embodiment are described below by referring to FIG. 16. In the relay node 404, the decoder 416 once decodes a high-efficiency voice code sent from the transmission node 100 as a voice signal and the voice detector 110 detects presence or absence of a talk spurt in accordance with the voice signal to decide an operation mode of the relay node 404 in accordance with a detection result. The operation in mode 3 (voice state) is completely identical to that in mode 3 shown in the embodiment 1.

When the voice detector 110 in the relay node 404 detects the change of operation modes from 3 to 1, it sends a control signal to the silent period eliminator 112. A changeover switch in the silent period eliminator 112 is switched to the terminal-112*b* side by responding to the control signal but no data is output to the transmission line A. That is, the line A is silent-period-vanished. It is permitted that the encoder 418 is in an indefinite state.

In the reception node 402, the voice/silence information extractor 424 fetches mode information from a silent-period-vanished voice code transmitted from the transmission line A, extracts the information for notifying the change of operation modes from 3 to 1, and sends a control signal reflecting the information to the changeover switch 126. The changeover switch 126 is switched to the terminal-126*a* side in accordance with the control signal and a pseudo-background noise is output to a receiver. In this case, it is permitted that the decoder 420 is in an indefinite state.

In the relay node 404, when the voice detector 110 detects the change of operation modes from 1 to 2, it generates a control signal and a changeover switch in the silent period eliminator 112 is switched to the terminal-112*c* side in accordance with the control signal. A high-efficiency voice code output from the encoder 418 is output to the transmission line A from the relay node 404 and transmitted to the reception node 402.

In the reception node 402, the voice/silence information extractor 424 detects the change of operation modes from 1 to 2 and generates a control signal. In accordance with the control signal, the changeover switch 126 is switched to the terminal-126*b* side. Moreover, the changeover switch 422 is switched to the terminal 422*b* to connect the decoder 420 with the suppressed gain codebook 414. The decoder 420 decodes a silent-period-vanished voice code sent from the transmission line A by using the suppressed gain codebook 414 and outputs a voice signal to a receiver. In this case, the internal state of the decoder 420 of the reception node 402 is different from the internal state of the encoder 418 of the relay node 404. However, abnormal sound can be avoided because the selected suppressed-gain codebook 414 is optimized so that no divergence occurs, even in an unstable coding/decoding system.

In the period of mode 2, a voice signal output from the decoder 420 is not very faithful to the original voice signal input to the encoder 106 because the encoder 418 and decoder 420 are different in internal state. That is, the S/N ratio tends to get lower than the normal S/N ratio. However, a voice signal coded/decoded in mode 2 is in many cases a consonant part at the head of a talk spurt. If the voice waveform of a consonant part is very noisy, the acoustic property of an original voice signal is not lost, even for a low S/N ratio. Therefore, even in the case of the simple structure shown in FIG. 16, no abnormal sound is produced and it is possible to reproduce voices with a relatively small degradation of voice quality.

The incoincidence between the internal states of the encoder 106 and the decoder 420 tends to converge under the condition of mode 2 as described for the embodiment 1.

Therefore, no abnormal sound is thereafter produced, even when switching the changeover switch 112 to the terminal 112*a* and the changeover switch 422 to a terminal 422*a* and thereby changing the operation mode from 2 to 3.

Therefore, to suppress abnormal sound, the present voice coding-and-transmission system uses a method of changing coding tables used for a transient period, so that a voice code causing divergence of the system is not output instead of using a method of readapting a voice code output, from the encoder 106. This embodiment has an advantage preferable for practical use that the embodiment can easily be executed because the embodiment requires a fewer control signals be added and has few units for performing complex processing as compared to the above embodiments.

[Embodiment 14]

Figure 17:
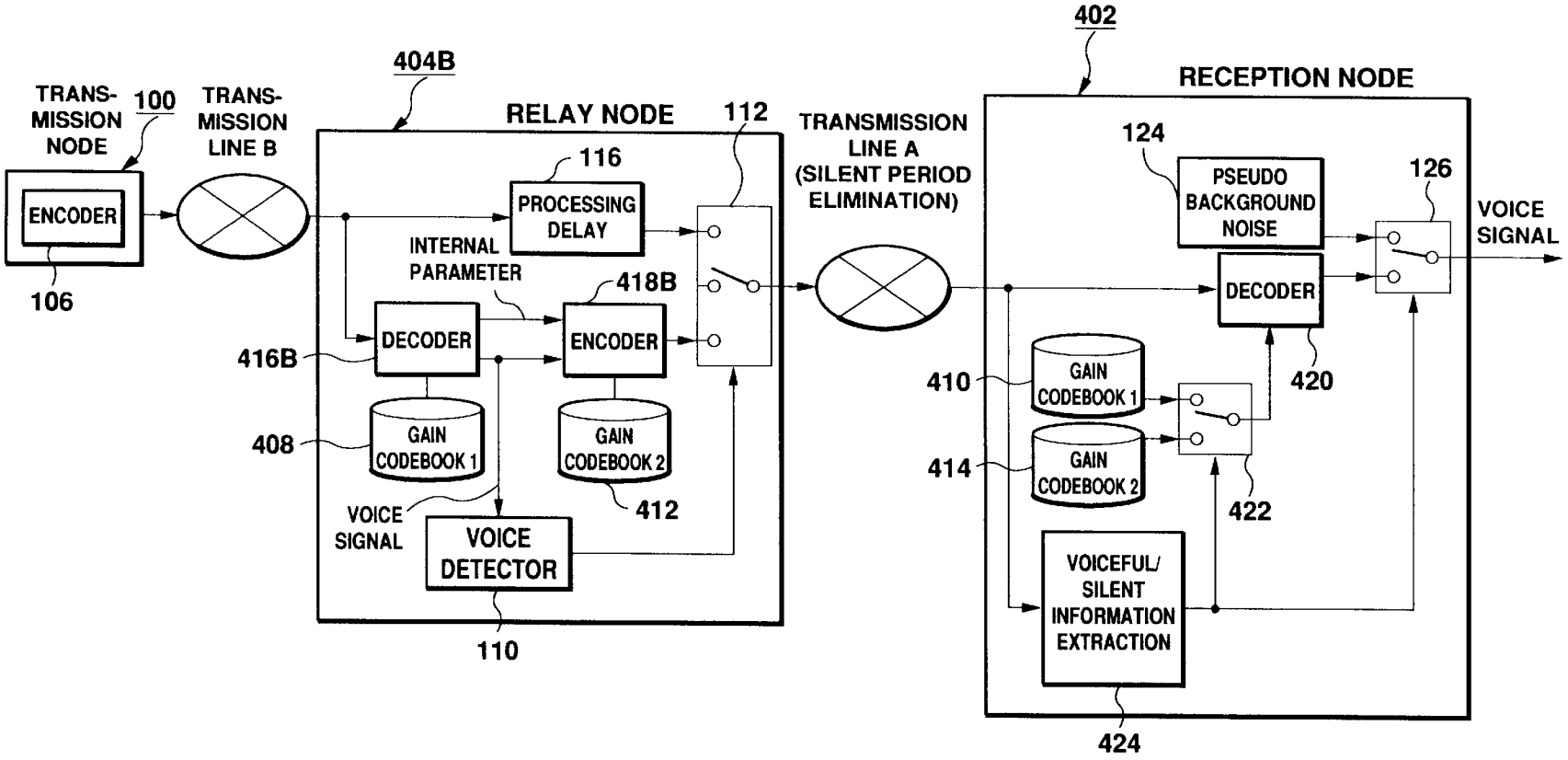
FIG. 17 is a block diagram of the voice coding-and-transmission system of the fourteenth embodiment.

FIG. 17 is a block diagram of the voice coding-and-transmission system of the fourteenth embodiment of the present invention. This embodiment is obtained by applying the same improvement as that shown in the embodiment 2 to the relay node of the embodiment 13. In FIG. 17, a component having the same function as that described for the embodiment 13 is provided with the same symbol as in FIG. 16.

This system is slightly different from the embodiment 13 in its relay decoder and relay encoder. A decoder 416B decodes a voice signal and outputs some of the adaptive parameters. An adaptive parameter is generated in high-efficiency coding such as ADPCM and serves as a voice parameter for constituting a voice signal. An encoder 418B receives the voice signal and adaptive parameters. In the case of the encoder 418B, it is possible to omit the processing for generating adaptive parameters input. In this case, it is necessary to select parameters to be supplied causing no abnormal sound in accordance with a high-efficiency coding system because supply of some adaptive parameters from the decoder 416B to the encoder 418B results in the partial admittance of incoincidence between the internal states of the encoder 418B and the decoder 420 of the reception node as described for the embodiment 2. This improvement decreases the processing load and hardware scale of the relay node.

[Embodiment 15]

Figure 18:
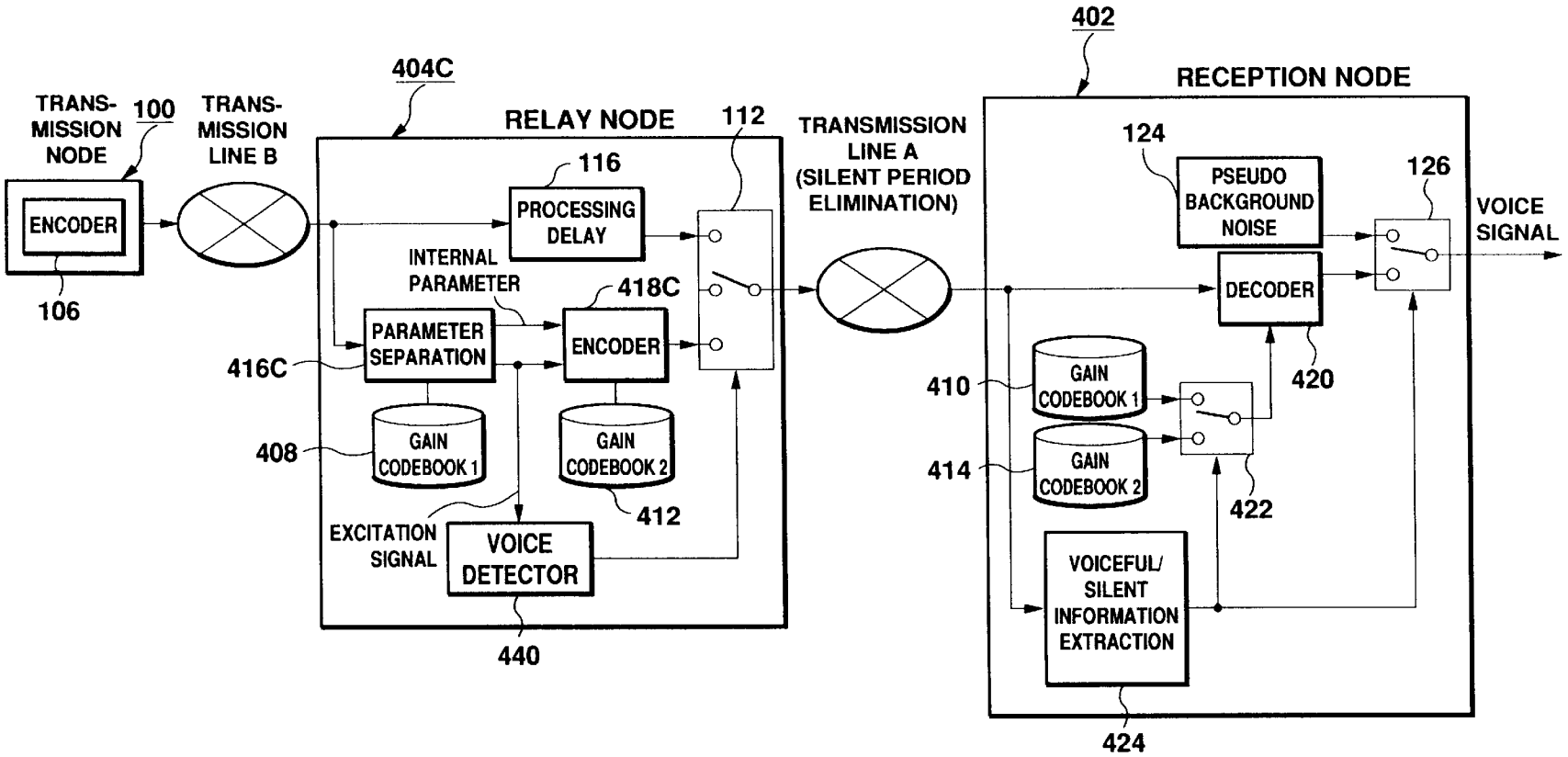
FIG. 18 is a block diagram of the voice coding-and-transmission system of the fifteenth embodiment.

FIG. 18 is a block diagram of the voice coding-and-transmission system of the fifteenth embodiment of the present invention. This embodiment is obtained by applying the same improvement as that shown in the embodiment 3 to the relay node of the embodiment 13. In FIG. 18, a component having the same function as that described for the embodiment 13 is provided with the same symbol as in FIG. 16.

This system is slightly different from the embodiment 13 in relay decoder, relay encoder, and voice detector. A parameter separator 416C is constituted by omitting some processing from the decoder 416B in FIG. 17. The parameter separator 416C is not provided with a function for decoding a voice signal in the complete form and is only provided with a parameter extracting function. The parameter separator 416C outputs an excitation signal and an coding parameter to the encoder 418C and excitation signal information to a voice detector 440. The voice detector 440 detects voice in accordance with the excitation signal information. Other operations of this voice coding-and-transmission system are the same as those of the embodiment 13. This improvement further decreases the processing load and hardware scale of the relay node.

[Embodiment 16]

Figure 19:
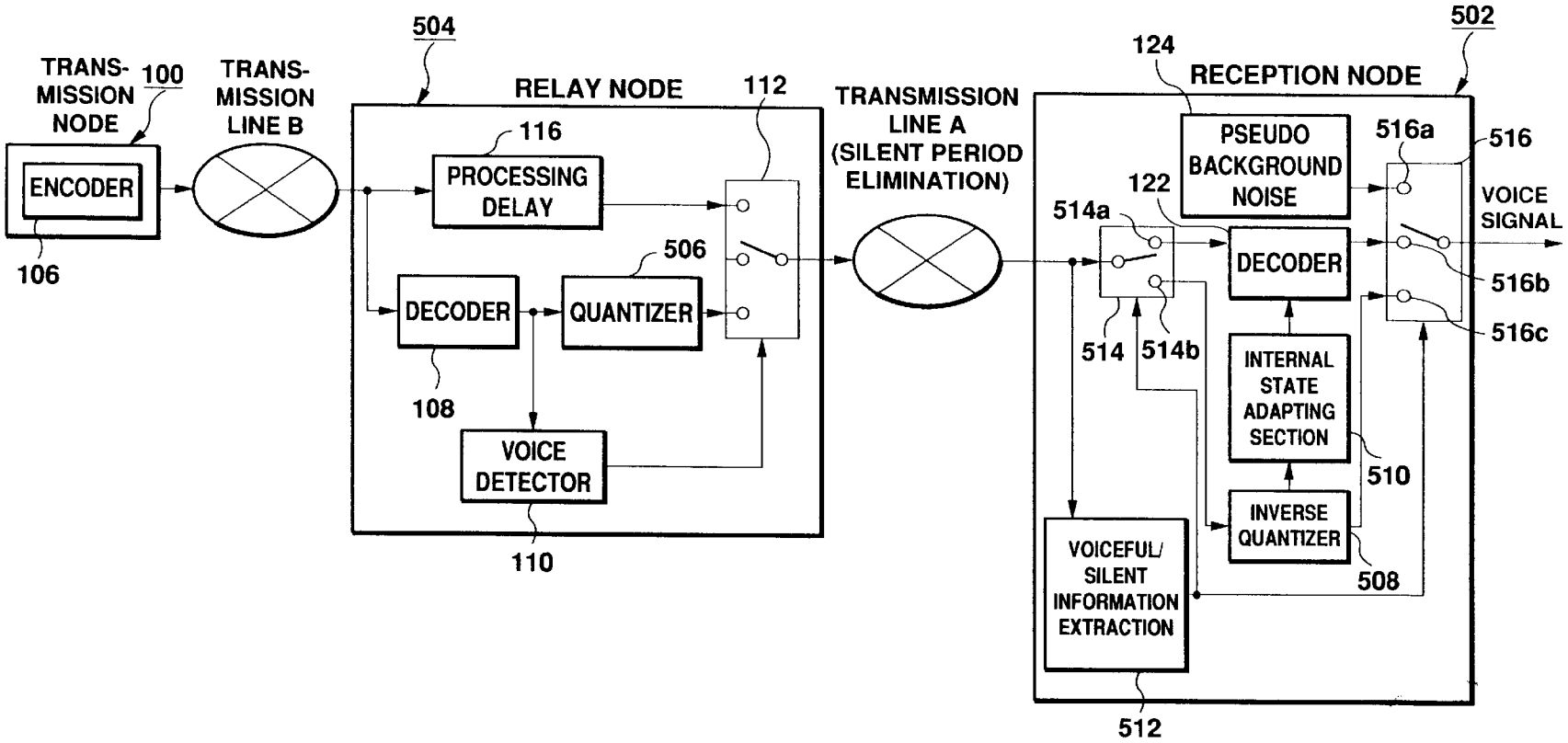
FIG. 19 is a block diagram of the voice coding-and-transmission system of the sixteenth embodiment.

FIG. 19 is a block diagram of the voice coding-and-transmission system of the sixteenth embodiment of the present invention. In FIG. 19, a component having the same function as that described for the embodiment 1 is provided with the same symbol as in FIG. 1.

This embodiment is described below by referring to FIG. 19. This embodiment uses a quantizer 506 as a relay encoder and a reception node 502 is provided with an inverse quantizer 508 correspondingly to the quantizer 506. An internal state adapting section 510 codes a voice signal sent from the inverse quantizer 508 by the differential coding system used for the encoder 106 and outputs the coded voice signal to the decoder 122. The internal state adapting section 510 has functions for reflecting the processing in the inverse quantizer 508 on the internal state of the decoder 122 and adapting the reference value for the differential coding in the decoder 122 to that of the encoder 106 of the transmission node 100. The coding/decoding system of the present system has three operation modes as described for the embodiment 1. The voice detector 110 discriminates between these operation modes in a relay node 504. Moreover, in a reception node 502, a voice/silence information extractor 512 discriminates between the silent-period-eliminated voice code sent from the relay node 504 and outputs a control signal corresponding to each operation mode. Changeover switches 514 and 516 are switched in accordance with a control signal sent from the voice/silence information extractor 512. Operations of this embodiment are described below by referring to FIG. 19. In the relay node 504, the decoder 108 once decodes a voice code sent from the transmission node 100 as a voice signal. The voice detector 110 detects presence or absence of a talk spurt in accordance with the voice signal and decides an operation mode of the relay node in accordance with the detection result.

The coding/decoding system of the present invention has three operation modes. However, description of these operation mode is omitted because they are the same as those described for the embodiment 1.

Operations of mode 3 (voiceful state) and mode 1 are the same as those of modes 3 and 1 shown in the embodiment 1 except that the changeover switch 514 is connected to the terminal-514*a* side. In this connection, the changeover switch 516 is switched to a terminal 516*a* in mode 1 to use an output sent from the pseudo background noise generator 124 as an output of the reception node 502 and, moreover, it is switched to a terminal 516*b* in mode 3 to use a voice signal sent from the decoder 122 as an output of the reception node 502. In the relay node 504, the voice detector 110 detects the change of operation modes from 1 to 2 and sends a control signal to the silent period eliminator 112. By receiving the control signal, a changeover switch in the silent period eliminator 112 is switched to the terminal-112*c* side. The quantizer 506 re-quantizes a voice signal decoded by the decoder 108 for every sample and outputs the re-quantized voice signal. The re-quantized voice signal is substituted for a voice code. The re-quantized voice signal is output to the transmission line A from the relay node 504.

Moreover, in the reception node 502, the voice/silence information extractor 512 fetches mode information from a voice code (quantized voice signal) transmitted from the transmission line A and outputs a control signal according to the change of operation modes from 1 to 2 to the changeover switch 516. In accordance with the control signal, the changeover switch 516 is connected to a terminal 516*c* and the changeover switch 514 is connected to a terminal 514*b*. The inverse quantizer 508 inversely quantizes the voice code transmitted from the transmission line A to generate a voice signal and outputs the voice signal to a receiver via the changeover switch 516. In this case, because the processings performed by the quantizer 506 and the inverse quantizer 508 are not based on a difference, an operation such as synchronous resetting is unnecessary in mode 2. To continuously perform operations in mode 3 after mode 2, however, it is necessary to make the internal state of the encoder 106 of the transmission node 100 coincide with that of the decoder 122 of the reception node 502. The internal state adapting section 510 is the means for the above purpose. The inversely-quantized voice signal is also supplied to the internal state adapting section 510 which supplies a calculated adaptive parameter to the decoder 122 to perform the operation for adapting the internal state of the decoder 122.

In this case, it is necessary for the quantizer 506 to perform quantization at the number of quantization steps adapted to the transmission line A and the high-efficiency coding system used for the present system. For example, when the coding system currently used is the system according to ITU Recommendation G.728 (transmission rate of 16 kbit/s) and the transmission rate per channel of the transmission line A is constant, 2 bits are assigned to each sample as the number of quantization bits.

It is described for the embodiment 13 that an input signal in mode 2 mainly has a consonant part. Because the voice waveform of a consonant part is a noisy signal, it is almost the same as the acoustic characteristic of a quantized noise and the period of mode 2 is very short, i.e. hundreds of milliseconds at most. Therefore, acoustic deterioration is relatively small. Because the dynamic range of voice signals input during the above period is relatively small, it is possible to completely express the value of the signal even if the number of quantization steps is small.

Moreover, when the transmission line A can handle a variable-speed transmission signal, increasing the assignment of a transmission rate by a necessary value in the period and increasing the number of quantization steps of the quantizer 506, improves the voice quality in the mode by a value equivalent to the increased number of quantization steps and a preferable result can be obtained.

Figure 20:
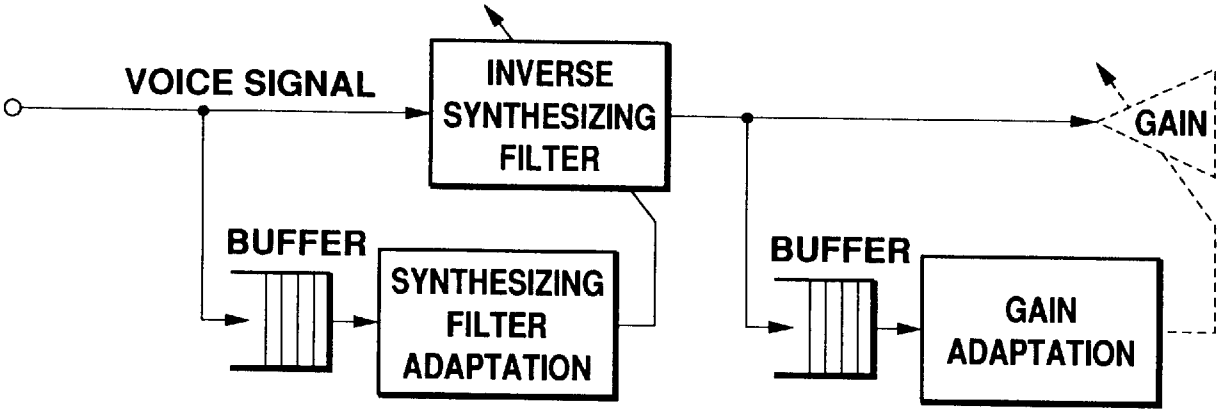
FIG. 20 is a block diagram showing a structure of the internal-state adapting section of the sixteenth embodiment.

FIG. 20 is a block diagram showing a structure of the internal state adapting section 510. This is an example of the internal state adapting section 510 when ITU Recommendation G.728 is used for a high-efficiency voice coding system. This example has the forward structure shown in FIG. 20 in order to perform adaptation by using a voice signal as an input. As a form, the structure is opposite to that of the decoder shown in FIG. 28.

Immediately after mode 1 changes to mode 2, the internal state of the encoder 106 of the transmission node 100 no longer coincides with that of the decoder 122 of the reception node 502. However, when the adaptive operation of the decoder 122 is continued in accordance with a voice signal in mode 2, the internal state of the encoder 106 of the transmission node 100 approaches that of the decoder 122 of the reception node 502 as explained in the embodiment 1. Therefore, no abnormal sound is produced, even if operation modes thereafter change from 2 to 3.

[Embodiment 17]

Figure 21:
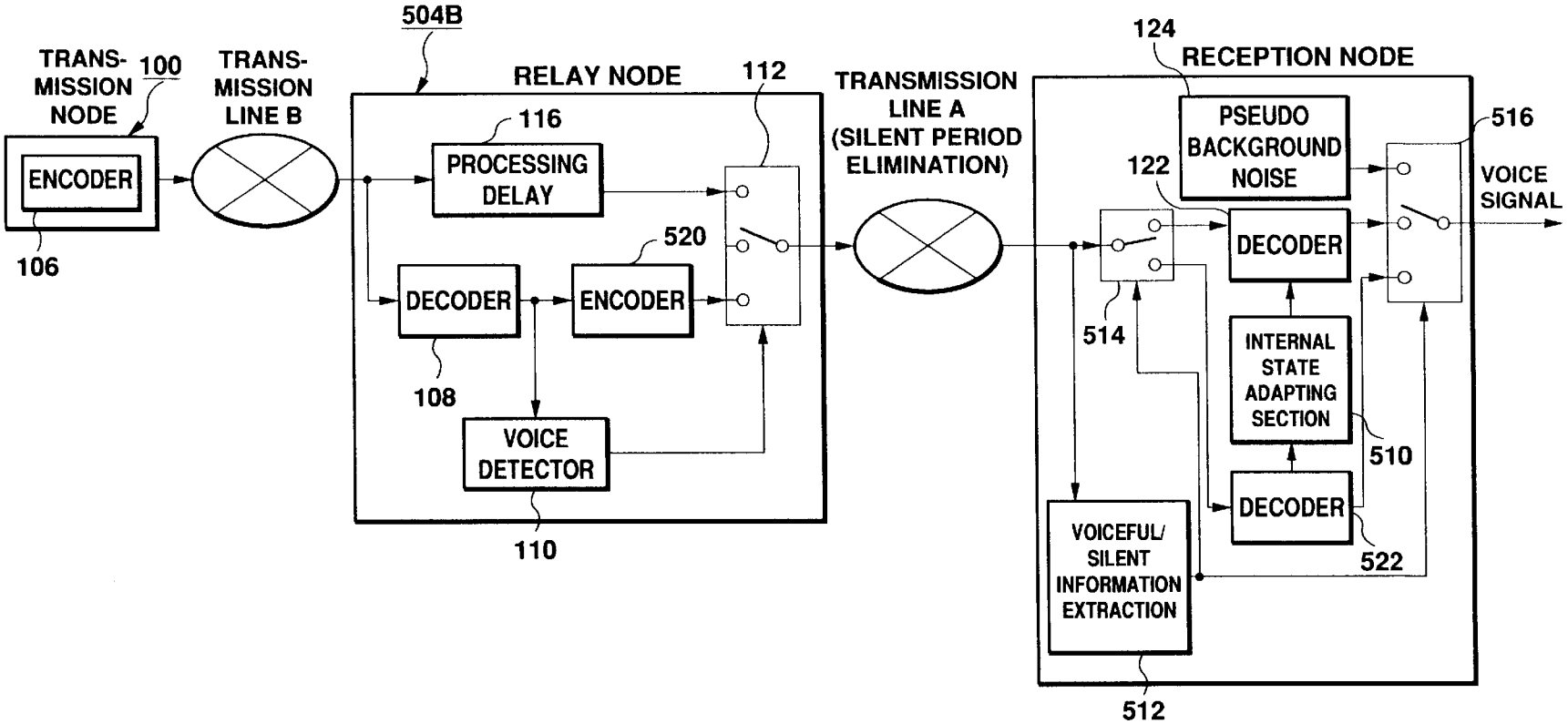
FIG. 21 is a block diagram of the voice coding-and-transmission system of the seventeenth embodiment.

FIG. 21 is a block diagram of the voice coding-and-transmission system of the seventeenth embodiment of the present invention. Because this embodiment is obtained by improving the embodiment 16, both embodiments use many common components. Therefore, in FIG. 21, a component having the same function as that described for the embodiment 16 is provided with the same symbol as in FIG. 16. This embodiment uses a relatively simple second high-efficiency coding/decoding system instead of the quantizer/inverse quantizer used for the embodiment 16. That is, the encoder 520 and the decoder 522 use an coding/decoding system not based on differential processing so as to disuse the operation such as synchronous resetting in mode 2 and performs the adaptive operation of the decoder 122 by using the internal state adapting section 510 so that operation in mode 3 can be performed. By this improvement, a preferable voice quality can be obtained compared to the case of the embodiment 17, though the processing load slightly increases.

[Embodiment 18]

Figure 22:
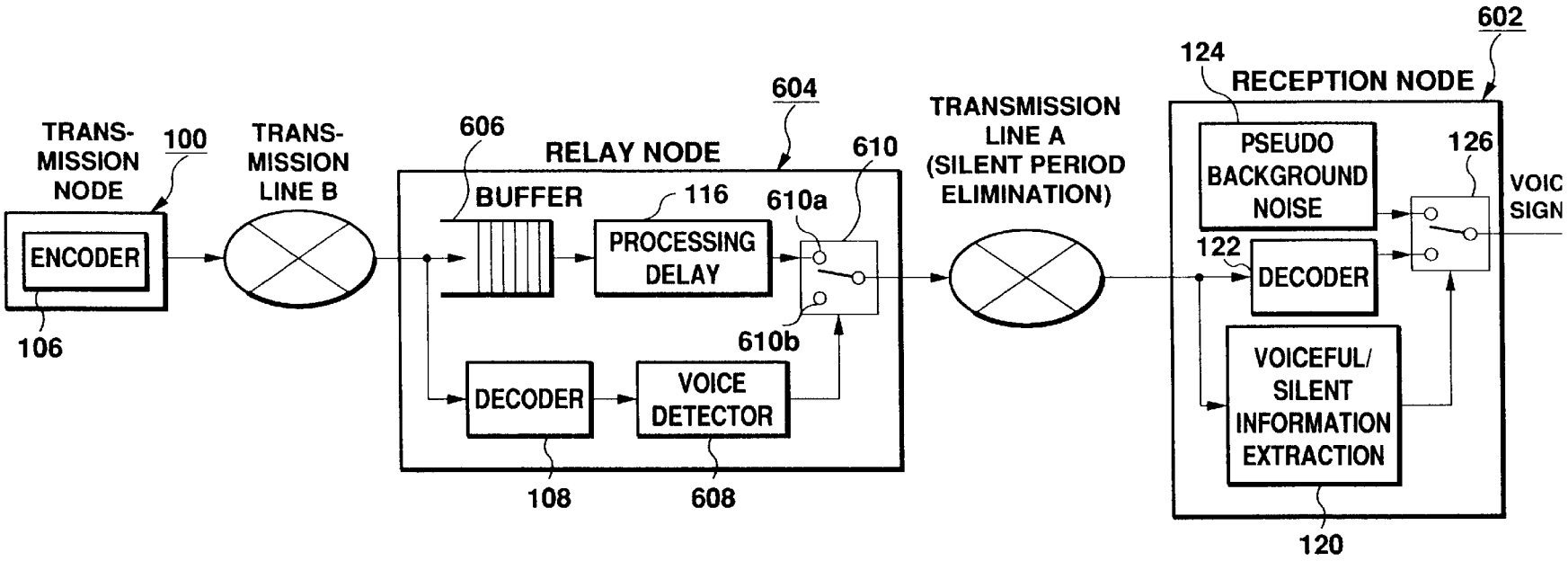
FIG. 22 is a block diagram of the voice coding-and-transmission system of the eighteenth embodiment.

FIG. 22 is a block diagram of the voice coding-and-transmission system of the eighteenth embodiment of the present invention. This embodiment and the embodiment 1 use many common components. Therefore, in FIG. 22, a component having the same function as that described for the embodiment 1 is provided with the same symbol as in FIG. 1 and its description is omitted. In the case of this embodiment, a buffer 606 is provided in a route for relaying a voice code to the transmission line A from the transmission line B. Though operations of this embodiment are described later, the tandem connection for the embodiment 1 or synchronous resetting between an encoder used for the tandem connection and a decoder of a reception node is not performed. Therefore, this voice coding-and-transmission system is not provided with a relay encoder, means for determining an coding reference value, or means for determining a decoding reference value. A voice detector 608 of a relay node 604 generates a control signal corresponding to a voice period or silent period in accordance with a voice signal decoded by the decoder 108. A silent period eliminator 610 has a built-in changeover switch having two switching terminals corresponding to the voice period or silent period.

Figure 23:
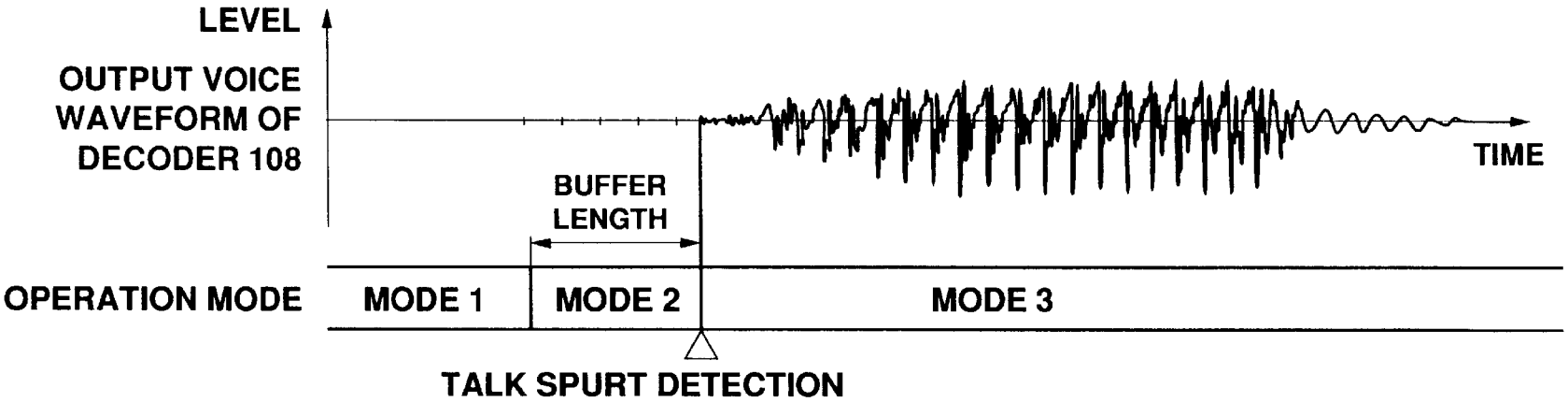
FIG. 23 is a waveform diagram of a voice signal for explaining operation modes of the eighteenth to twenty-first embodiments.

In this case, the coding/decoding system of the present invention has three operation modes. These operation modes are described below by referring to FIG. 23. FIG. 23 is a waveform diagram of a voice signal output from the decoder 108. Y axis represents signal level and x axis represents time. The voice detector 608 divides the voice signal into three periods (sections) and operates the relay node 604 in a different operation mode corresponding to each period. Mode 1' corresponds to a period excluding ten msec among periods at the tail in which no talk spurt is detected. Mode 2' corresponds to a period of tens of milliseconds (referred to as a hangover period) excluded from the tail of the period of mode 1'. Finally, mode 3' corresponds to a period in which a talk spurt is detected. In the case of this embodiment, the period corresponding to mode 1' is referred to as a silent period and the periods corresponding to modes 2' and 3' are referred to as a voice period. Operations of the embodiment 18 are described by referring to FIG. 22. First, it is necessary to find the change point from a silent period to a voiceful period. However, it is very difficult to foresee presence or absence of a talk spurt directly from a voice code list. Therefore, the present system accumulates high-efficiency voice codes input to the relay node 604 in the buffer 606 which is a FIFO buffer in order to delay them. Thereby, a time difference equivalent to the buffer length occurs between the transmission lines B and A. That is, detection of a talk spurt by the voice detector 608 preceded by a time equivalent to the buffer length in accordance with a voice code and thereby, the change point from mode 11' to mode 2' can be obtained.

Figure 30:
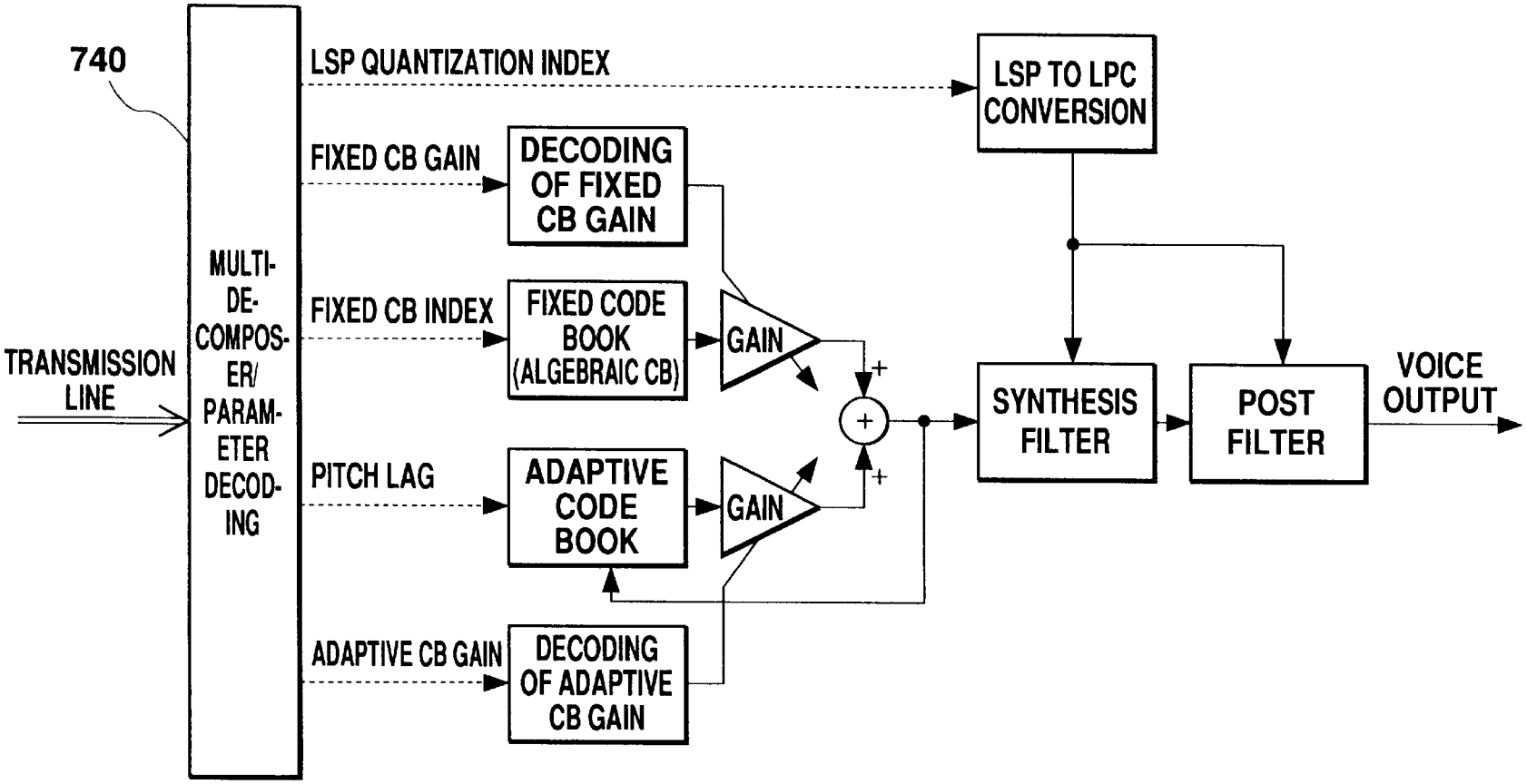
FIG. 30 is a block diagram of a decoder based on an ITU Recommendation G.729 method.

Operations of the present system are almost the same as those of the prior art shown in FIG. 30. However, the present system is essentially different from the prior art at the point that the buffer 606 is set to the relay node 604 to generate a delay separately from the delay by the processing delay unit 116 so that the change from a silent period to a voice period can be detected in advance. When the voice detector 608 detects "presence" of a talk spurt, it switches a changeover switch in the silent period eliminator 610 to the terminal-610 a side and transmits a voice code sent from the transmission node 100 to the transmission line A. In this case, the voice code is delayed by the buffer 606 and a silent overhang period is included in the head of a silent-period-eliminated voice code to be transmitted to the transmission line A. When the voice detector 608 detects "absence" of a talk spurt, it switches a changeover switch in the silent period eliminator 610 to the terminal-610*b* side but it does not transmit any data to the transmission line A. A control signal sent from the voice detector 608 at the end of voicing is delayed longer than the hangover period. Thereby, it is possible to prevent the tail of the voice code delayed by the buffer 606 from pausing. In a reception node 602, the voice/silence information extractor 120 outputs a control signal corresponding to presence or absence of a talk spurt to the changeover switch 126 the same as the voice detector 608 does. The changeover switch 126 is switched to the decoder 122 side in a voiceful period and to the pseudo-background-noise-generator-124 side in a silent period.

As described above, abnormal sound is produced due to divergence of a system when the following two conditions occur at the same time.

(1) A high-efficiency coding/decoding system is unstable.

(2) A high-level signal is input to the system.

When accelerating the change from a silent period to a voiceful period, little high-level signal is input because the change point is actually silent. Therefore, even if a voice coding/decoding system is unstable due to internal-state incoincidence, the probability of abnormal sound occurrence is decreased considerably compared to the case of the prior art because a signal level to be input is low.

It is preferable that the duration of mode 2' be approximately tens to hundreds of milliseconds, in which time the difference between the internal states of the encoder 106 and the decoder 122 completely converges. However, because degradation factors due to delay also occur when the duration is over-lengthened, it is necessary to set a duration most suitable for a system to which mode 2' is applied by adequately considering the even balance between the duration and factors.

As described above, it is possible to suppress abnormal sound by setting the buffer 606 to the relay node 604 to delay voice transmission and setting a hangover period without accelerating the change from a silent period to a voiceful period. Though a transmission delay occurs and the silent period elimination efficiency slightly lowers compared to the above embodiments, a preferable advantage is obtained that suppression of abnormal sound can very easily be realized only by adding the buffer 606.

[Embodiment 19]

Figure 24:
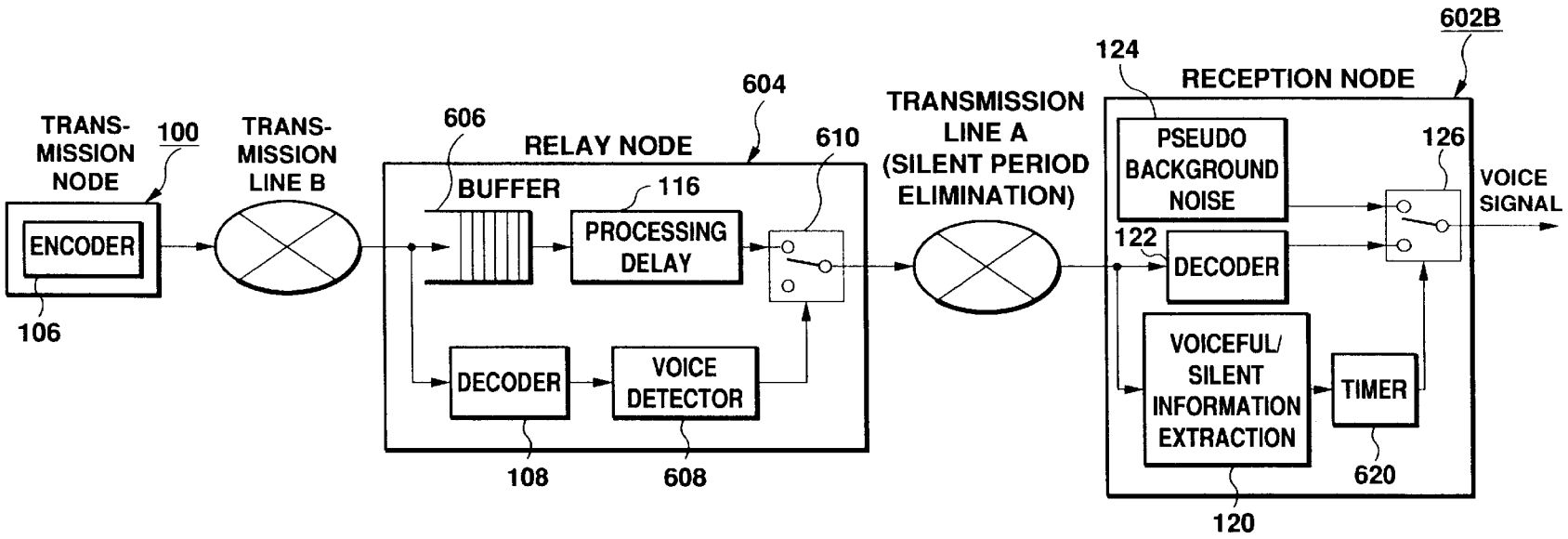
FIG. 24 is a block diagram of the voice coding-and-transmission system of the nineteenth embodiment.

FIG. 24 is a block diagram of the voice coding-and-transmission system of the nineteenth embodiment of the present invention. This embodiment is obtained by improving the reception node of the embodiment 18. Therefore, in FIG. 24, a component having the same function as that described for the embodiment 18 is provided with the same symbol as in FIG. 22 and its description is omitted. The present system is constituted so as to output pseudo background noises continuously after mode 1' by setting a timer 620 for counting delay time of the buffer 606 to a reception node 602B and connecting the changeover switch 126 to the terminal-126*a* side in mode 2' (hangover period). As described for the embodiment 18, though the possibility of occurrence of abnormal sound is low in mode 2', the possibility is completely eliminated in mode 2' by using the structure of the present system.

[Embodiment 20]

Figure 25:
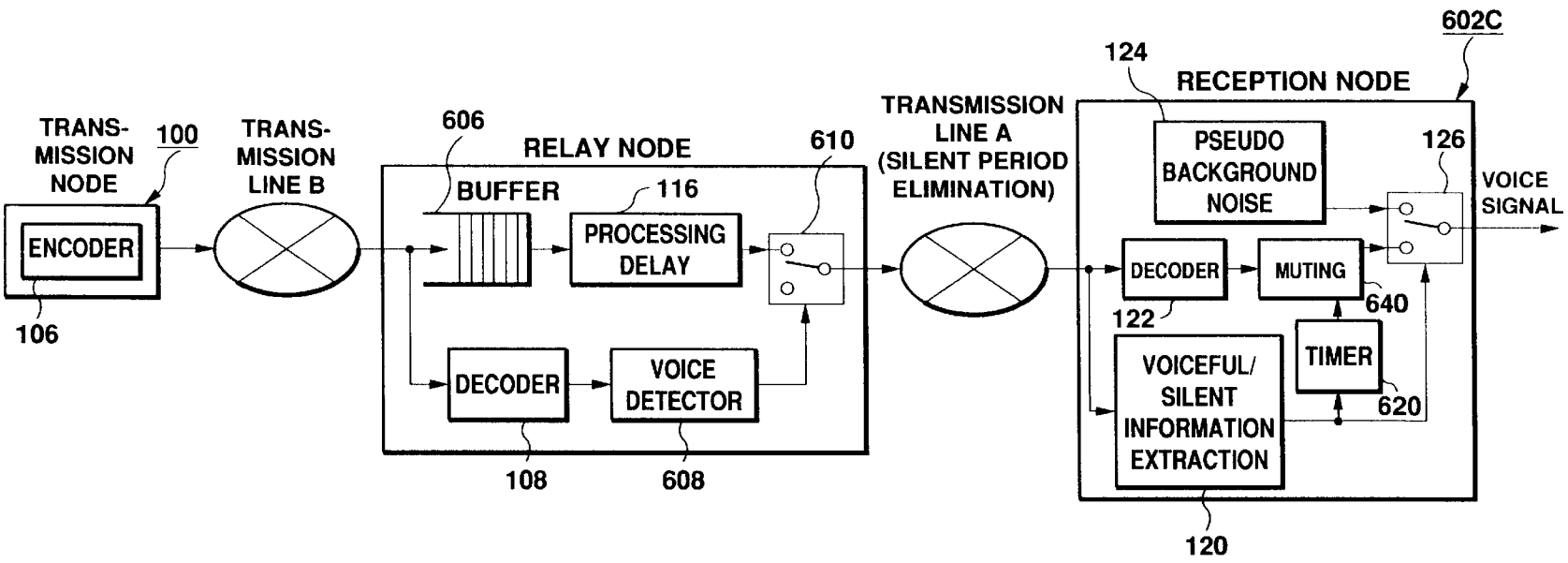
FIG. 25 is a block diagram of the voice coding-and-transmission system of the twentieth embodiment.

FIG. 25 is a block diagram of the voice coding-and-transmission system of the twentieth embodiment of the present invention. This embodiment is another embodiment obtained by improving the reception node of the embodiment 18. Therefore, in FIG. 25, a component having the same function as that described for the embodiment 18 is provided with the same symbol as in FIG. 22 and its description is omitted. A reception node 602C of the present system is provided with the timer 620 for counting the delay time of the buffer 606, as in embodiment 19, a voice muting circuit 640, and is constituted so as to output a muted voice signal by driving the voice muting circuit 640 while the timer 620 is in mode 2' (hangover period). As described for the embodiment 18, though the possibility of abnormal sound occurrence is already low in mode 2', this possibility is completely eliminated by using the structure of the present system.

[Embodiment 21]

Figure 26:
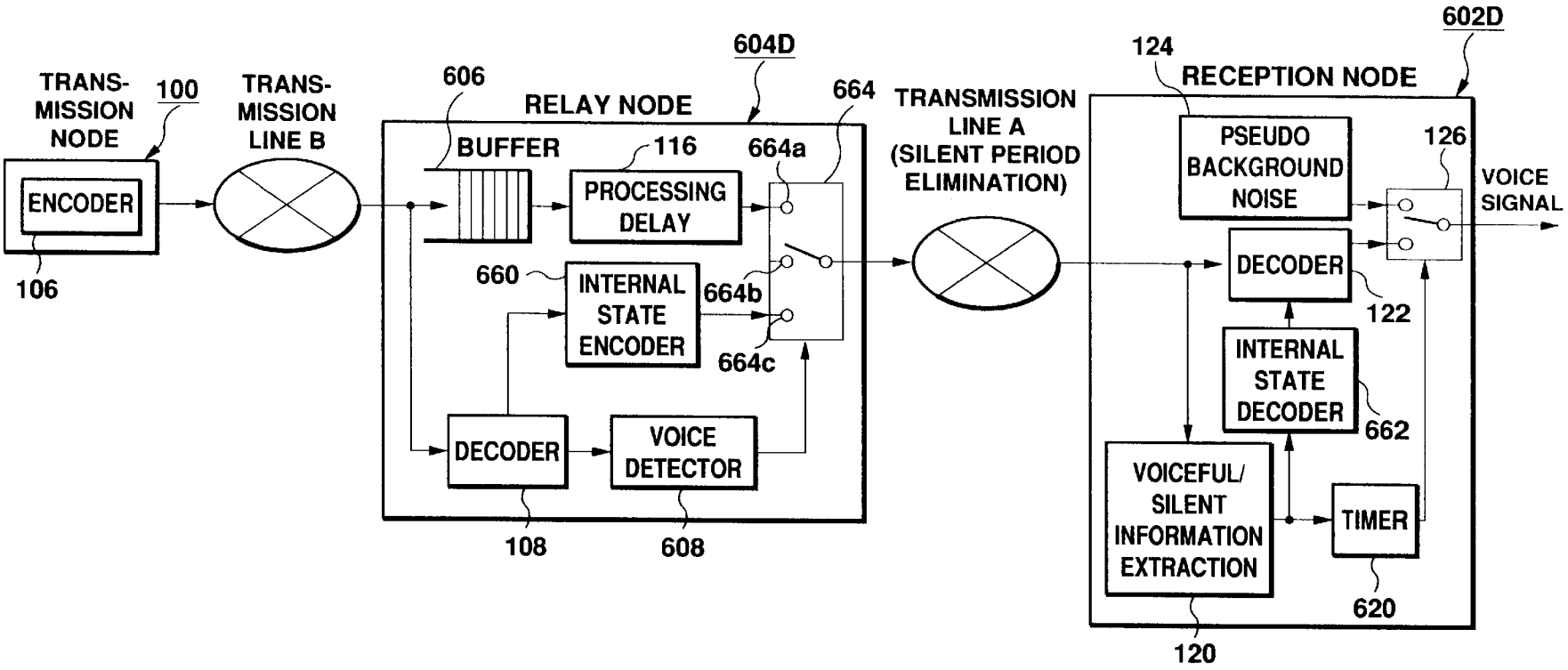
FIG. 26 is a block diagram of the voice coding-and-transmission system of the twenty-first embodiment.

FIG. 26 is a block diagram of the voice coding-and-transmission system of the twenty-first embodiment of the present invention. This embodiment is obtained by improving the embodiment 19. Therefore, in FIG. 26, a component having the same function as that described for the embodiment 19 is provided with the same symbol as in FIG. 24 and its description is omitted.

The embodiment 21 is characterized in that a relay node 604D is provided with an internal state encoder (reference state encoder) 660 having a function of referring to internal parameters of the decoder 108 and coding them and a reception node 602D is provided with an internal state decoder (reference state decoder) having a function of decoding internal parameters coded by the internal state encoder 660 and setting the values of the parameters to a proper memory area of the decoder 122.

In modes 1' and 3', operations of this embodiment are the same as those of the embodiment 19. In mode 2' (hangover period), the relay node 604D connects a changeover switch in a silent period eliminator 664 to a terminal 664C and transmits an output of the internal state encoder 660 to the transmission line A. The reception node 602D immediately decodes the coded signal and sets a parameter reflecting the internal state of the encoder 106 to the decoder 122. The present system directly transmits internal parameter information and forcibly makes the internal state of the encoder 106 coincide with that of the decoder 122. Therefore, it is possible to shorten the duration of mode 2' compared to the method of waiting for the internal states of the encoder 106 and decoder 122 to slowly converge while continuing input of high-efficiency voice codes as used for the embodiments 18 to 20. Though processing is complex compared to the case of the embodiment 18, a preferable advantage is obtained that the transmission delay is decreased.

[Embodiment 22]

Figure 27:
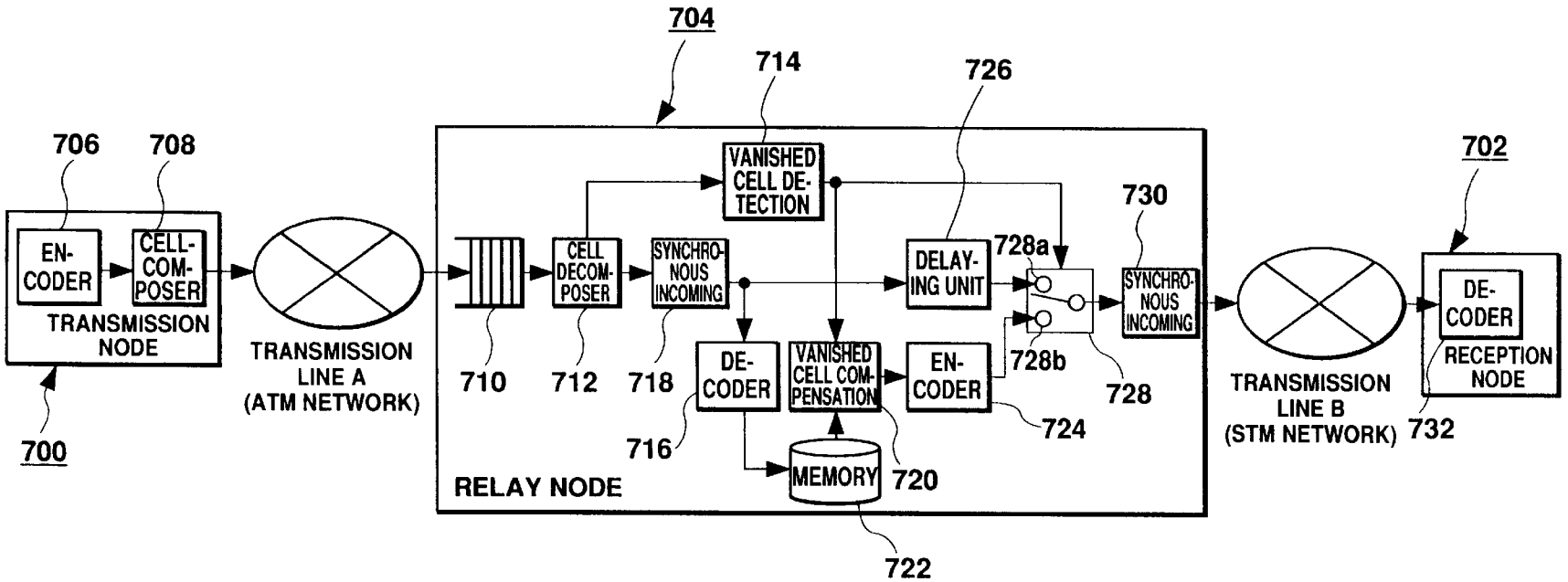
FIG. 27 is a block diagram of the voice coding-and-transmission system of the twenty-second embodiment.

The twenty-second embodiment of the present invention is described below by referring to the accompanying drawing. FIG. 27 is a block diagram of the voice coding-and-transmission system of this embodiment. According to the voice coding-and-transmission system, a transmission node 700 divides an original voice code obtained by coding a voice signal into cells and outputs these cells to a transmission line A. The transmission line A is an ATM transmission network. On the other hand, a transmission line B in which a reception node 702 is connected is an STM transmission network. A relay node 704 is an ATM-STM relay node for connecting these two transmission networks, receives a cell transferred in a asynchronous transfer mode from the transmission node 700, extracts the original voice code and outputs the voice code to the transmission line B in a synchronous mode. The reception node 702 decodes the voice code transferred in the synchronous mode and outputs a voice signal.

The transmission node 700 has an encoder (coding unit) 706 for digitizing the voice signal inputted and for coding with high compression rate. Any coding method may be applied to the embodiment of the present invention. For example, the voice code outputted from the transmission node 700 may be the high efficiency voice code applied the differential-coding described in the above embodiment, or be a voice code applied the silent-period-elimination. A cell composer 708 divides a sequential original voice code generated in the encoder 706, and assorts the original voice code into the cell. Namely, each cell includes a fragment of the original voice code. The voice signal is transmitted through the transmission line A which is the ATM network in a burst mode per cell unit.

The cell is transmitted from the transmission node 700 to the relay node 704 through the transmission line A. Fluctuation in a reached timing induced by a different transmission path though which the cell passes is absorbed in a FIFO buffer 710. A cell decomposing portion 712 decomposes the cell received and generates the sequential original voice code. An vanished cell detector 714 is a relay control means of detecting a dead cell (vanished cell) due to a disuse or a delay in the ATM network, and of generating a control signal (relay control signal) for controlling operations of each portion in the relay node 704.

The original voice code is branched into two parts. One part is inputted to a decoder (relay decoder) 716. The decoder 716 decodes the voice code extracted from the cell into an original digital sampling voice signal. A synchronous incoming unit 718 has a function of mating an operation timing between the decoder 706 and the decoder 716. A vanished cell compensator 720 compensates a voice signal for the vanished cell based on an output from the decoder 716. A memory 722 consists of a memory or the like and temporarily stores a latest voice signal used for compensating the vanished cell. An encoder (relay encoder) 724 performs the same coding as the encoder 706 does and generates a voice code (relay voice code).

Other part of the original voice code branched is inputted to a delaying unit 726. A delay time belonging to the delaying unit 726 is equal to a delay time in a compensation processing of the vanished cell performed by the decoder 716, the vanished cell compensator 720 and the encoder 724. A selector switch 728 is controlled by the relay control signal and outputs either the original voice signal outputted from the delaying unit 726 or the relay voice code outputted from the encoder 724. The voice code outputted from the selector switch 728 is sent to the transmission line B which is the STM network through a synchronous incoming unit 730. In the reception node 702, a decoder 732 is the same as the decoder 716.

Operations of the present embodiment will be described referring to FIG. 27. In the transmission node 700, the encoder 706 codes based on a high efficiency coding algorithm, and generates a voice code (original voice code). The original voice code is changed to a cell in the cell composer 708, and is sent asynchronously to the transmission line A in a burst mode.

The relay node 704 receives the cell from the transmission line A. The cell in which fluctuation in a reached timing is absorbed by the buffer 710 is decomposed in the cell decomposing unit 712, and the original voice code is extracted therefrom. In the synchronous incoming unit 718, a coding timing of the original voice code mates with that of the encoder 706 at the reception node. So far this is the same as the conventional voice relay transmission system using a tandem method.

The voice code retimed, in other words timed again, is branched into two parts as described above. One part is inputted to the decoder 716, and is decoded to a digitized voice signal, for example a PCM voice signal, based on an algorithm in accordance with the encoder 706. The voice signal decoded is stored in the memory 722 for a predetermined period. When the cell vanishing is detected, the vanished cell compensator 720 compensates the vanished cell based on the voice signal information stored in the memory 722 receiving the relay control signal from the vanished cell detector 714. Whenever the vanished cell is detected in the relay node, it is needed that the decoder 716 is operated continuously and the latest voice signal information is always inputted to the memory 722 so as to compensate the vanished cell.

In case of detecting the cell vanishing in the vanished cell detector 714 (hereinafter referred to as an abnormal condition), the voice signal is compensated for the vanished cell based on the information in the memory 722. A compensation method such as a linear interpolation/a repeat interpolation based on a pitch cycle/an extrapolation with a linear prediction/a mute has been devised. However, according to the present invention, the compensation method is not limited. The voice signal compensated for the vanished cell information is inputted to the encoder 724, coded based on the same algorithm as that of the encoder 706 at the reception node, and then sent to the selector switch 728.

In contrast, in case of not detecting the cell vanishing in the vanished cell detector 714 (hereinafter referred to as a normal condition), the other original voice code outputted from the synchronous incoming unit 718 is inputted to the selector switch 728 through the delaying unit 726. Timings of the original voice code passing through the normal condition route and the voice code (relay voice code) passing through the abnormal condition route, in other words a route including the decoder 716, the vanished cell compensator 720, and the encoder 724, are mated by the delaying unit 726.

The selector switch 728 selects and outputs either one of the above two inputs based on the relay control signal in accordance with a determination of the vanished cell detector 714. In other words, the switch is switched to a terminal 728*a* under the normal condition and the voice code received from the ATM network is sent to the STM network side as it is. On the other hand, the switch is switched to a terminal 728*b* under the abnormal condition and the voice code compensated the vanished cell by the vanished cell compensator 720 is sent to the STM network side. The voice code outputted from the selector switch 728 is mated with an inherent timing of the transmission line B (STM network) in the synchronous incoming portion 730 and is then outputted to the transmission line B.

As described above, major features of the present embodiment are in that a relay based on a digital-one-link connection which produces no accumulation of quantization errors is performed under the normal condition, and the vanished cell is compensated making a relay mode as a tandem connection under the abnormal condition.

The high efficiency voice code transmitted through the transmission line B is decoded to the voice signal in the decoder 732 at the reception node 702. At this time, an impact of the cell disuse generated in the transmission line A is removed in the relay node 704, therefore, an excellent voice signal prevented a degradation can be decoded without conducting any special processing in the reception node 702.

[Embodiment 23]

The twenty-third embodiment of the present invention is described below by referring to the accompanying drawing. FIG. 28 is a block diagram of the voice coding-and-transmission system of this embodiment. The present embodiment is obtained by improving the embodiment 22. With the improvement, a processor load caused by a coding processing, a decoding processing, an vanished cell compensation processing or the like in the relay node and a hardware size can be reduced. Moreover, in FIG. 28, components having corresponding function to a component described for embodiment 22 are provided with the same symbol as in FIG. 27 and their description is not repeated. For a modified component, the character B is added to its symbol in FIG. 27 so that how the component corresponds to the component of the embodiment 22 can be easily understood.

Figure 28:
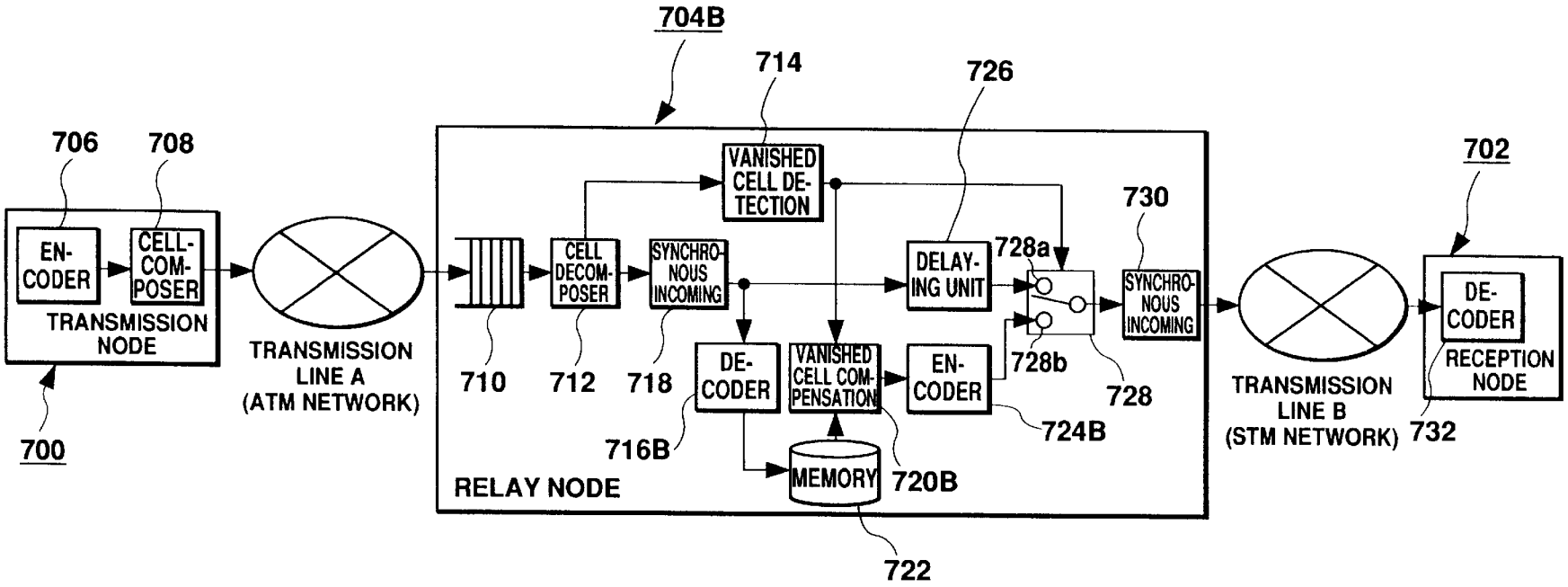
FIG. 28 is a block diagram of the voice coding-and-transmission system of the twenty-third embodiment.

In FIG. 28, the decoder 716B conducts a part of the decoding processing of the decoder 716. In other words, the decoder 716B does not generate a complete voice signal, instead thereof, analyzes the voice signal and extracts a voice parameter which is one portion of the voice information included in the voice signal. In accordance therewith, the encoder 724B has a function of converting the voice parameter extracted in the decoder 716B into the high efficiency voice signal again. In addition, the vanished cell compensator 720B operates with receiving the relay control signal and compensates the voice parameter of the voice signal included in the vanished cell.

Operations of the present embodiment will be described referring to FIG. 28. The operations of the present embodiment are almost same as that of the embodiment 22 as apparent from common configurations thereof shown in FIGS. 27 and 28. Different operations will be described.

A bit sequence including retimed voice code information is inputted to the decoder 716B. The decoder 716B analyze the bit sequence inputted and only extracts the voice parameter coded.

Figure 29:
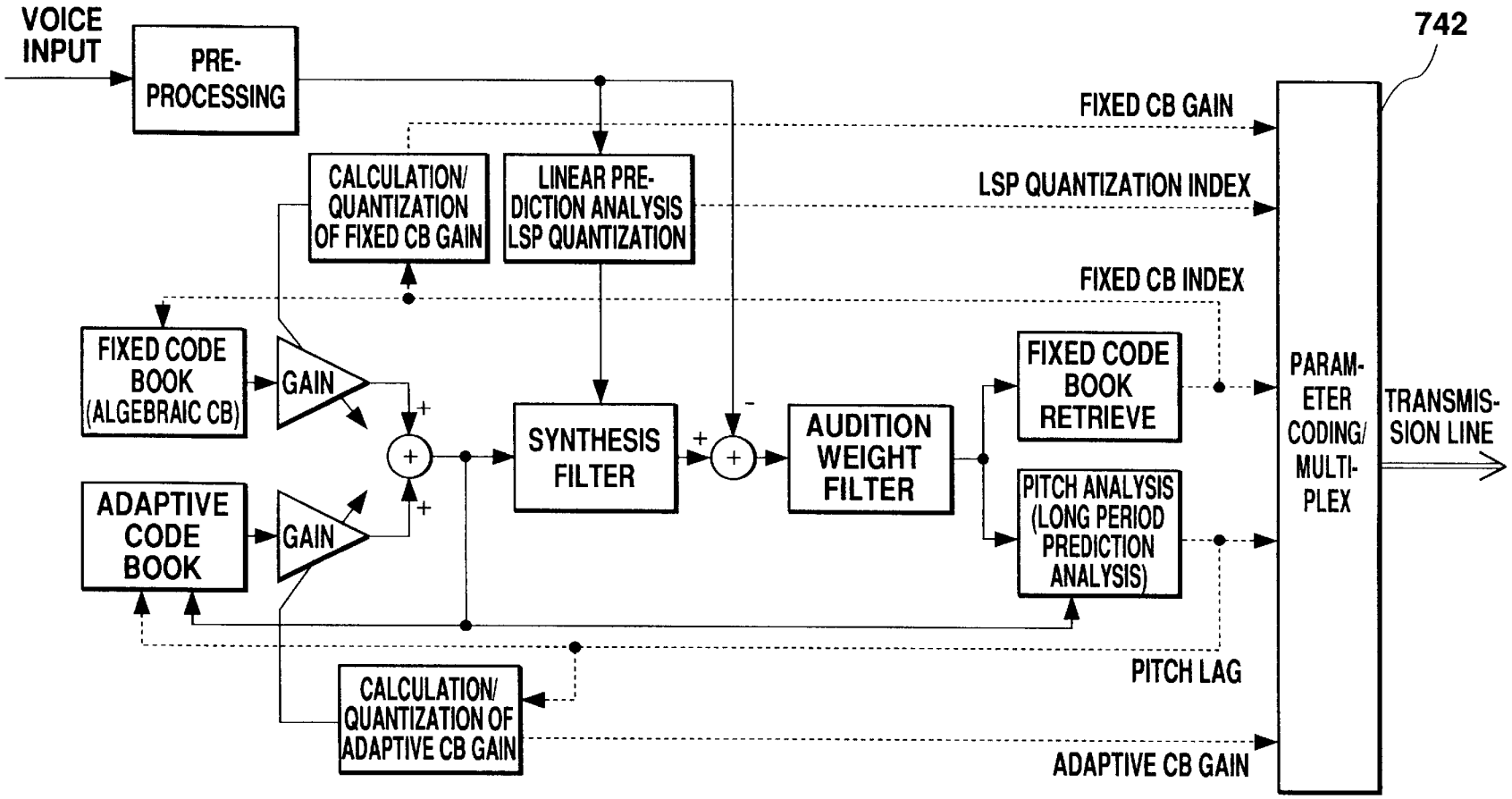
FIG. 29 is a block diagram of an encoder based on an ITU Recommendation G.729 method.

The parameter extracting operation will be described using an existing voice coding algorithm. For example, a case that an ITU Recommendation G.728 coding method (CS-ACELP method) is used as the high efficiency coding method will be described based on FIGS. 29 and 30. FIG. 29 is a block diagram of the encoder based on the ITU Recommendation G.728 method, and FIG. 30 is a block diagram of the decoder according to the method. Detail algorithm of the CS-ACELP method is described in ITU-T Recommendation G.729, "Coding of Speech at 8 kbit/s Using Conjugate-structure Algebraic-Code-Excited Linear-Prediction (CS-ACELP)."

Inner structure of the encoder 706 at the transmission node 700 is shown in FIG. 29. The encoder 706 analyzes the voice signal inputted and extracts a parameter which characterizes the voice signal. In other words, the ITU Recommendation G.729 extracts LSP (line spectrum pair) information corresponding to a synthesis filter coefficient, an adaptive code book index and a fixed code book index corresponding to a waveform of an excitation sound source, adaptive code book gain information and fixed code book gain information corresponding to power of the excitation sound source. As to these parameters, the excitation sound source expresses vocal vibration information and the LSP information expresses tone mechanism information corresponding to a throat or a palato comparing to a human vocalization. Each parameter is quantized based on a specific algorithm, is converted to a bit sequence, is multiplexed, and is then outputted from the encoder 706.

The multiplexed bit sequence inputted to the decoder 716B is converted into each parameter regarding the voice information by a function including the multi separation/parameter decoder 740 shown in FIG. 30. Each parameter extracted in the decoder 716B is stored in the memory 722. The vanished cell compensator 720B operates receiving the relay control signal outputted from the vanished cell detector 714 when the cell vanishing is detected, in other words under the abnormal condition, and compensates the vanished cell based on the voice parameter stored in the memory 722. Whenever the vanished cell is detected in the relay node, the decoder 716B is operated continuously so as to be capable of compensating the voice signal information included in the vanished cell. Namely, the voice parameter stored in the memory 722 is continuously updated. Moreover, the older the stored past parameter is, the less its validity for the compensation processing is. A stored parameter in the memory 722 is normally updated with a FIFO processing.

A linear interpolation, a repeat interpolation, an extrapolation by a linear interpolation, an attenuation of a gain or the like has been devised as the compensation method. The compensation processing of the present invention is realized using these compensation methods and other compensation methods. The compensated parameter for the vanished cell information and represented a characteristic amount of the voice signal is inputted to the encoder 724B. The encoder 724B codes the parameter compensated by performing same processings as a parameter coding/multiplexor 742 in the encoder 706 at the reception node, and sends the voice code (relay voice code) to the selector switch 728.

In contrast, in case of detecting no cell vanishing in the vanished cell detector 714 (normal condition), the voice code outputted from the synchronous incoming unit 718 is inputted to the selector switch 728 through the delaying unit 716. Timings of the voice code (original voice code) passing through the normal condition route and the voice code (relay voice code) passing through the abnormal condition route, in other words a route including the decoder 716, the vanished cell compensator 720 and the encoder 724B are mated by the delaying unit 726.

The selector switch 728 selects and outputs either one of the above two inputs based on the relay control signal outputted from the vanished cell detector 714. In other words, the switch is switched to a terminal 728*a* under the normal condition and the voice code received from the ATM network is sent to the STM network side as it is. On the other hand, for the abnormal conditions switch is switched to a terminal 728*b* and the voice code compensating for the vanished cell by the vanished cell compensator 720B is sent to the STM network side. The voice code outputted from the selector switch 728 is mated with an inherent timing of the transmission line B (STM network) in the synchronous incoming portion 730 and is then outputted to the transmission line B. Processings thereafter are identical to the embodiment 22.

In case of using the ITU Recommendation G.729 as the voice coding algorithm, the decoder 716 in the relay node of the embodiment 22 needs to perform entire decoding processing of the decoder shown in FIG. 30, and the encoder 724 in the relay node needs to perform entire coding processing of the encoder shown in FIG. 29, respectively. However, in case of using the relay node constituted according to the present invention, any decoder 716B only performing a processing done by the multi separation/parameter decoder 740 among the decoding processings shown in FIG. 30 can be applied and any encoder 724B only performing a processing done by the parameter coding/multiplexor 742 among the coding processings shown in FIG. 29 can be applied. In other words, for example, if these processings are implemented using a multi-purpose processor, a DSP (digital signal processor), or the like, amount of computing can be remarkably reduced. Thereby, power consumption can be reduced and a small-sized device can be obtained. In addition, if these processings are implemented in the hardware based on a wired logic, the processings become simple, thereby enabling reductions in circuit scale and power consumption. Moreover, the vanished cell compensation inhibits lessening of quality of regenerated voices at the reception node 702, similar to the embodiment 22.

[Embodiment 24]

Figure 31:
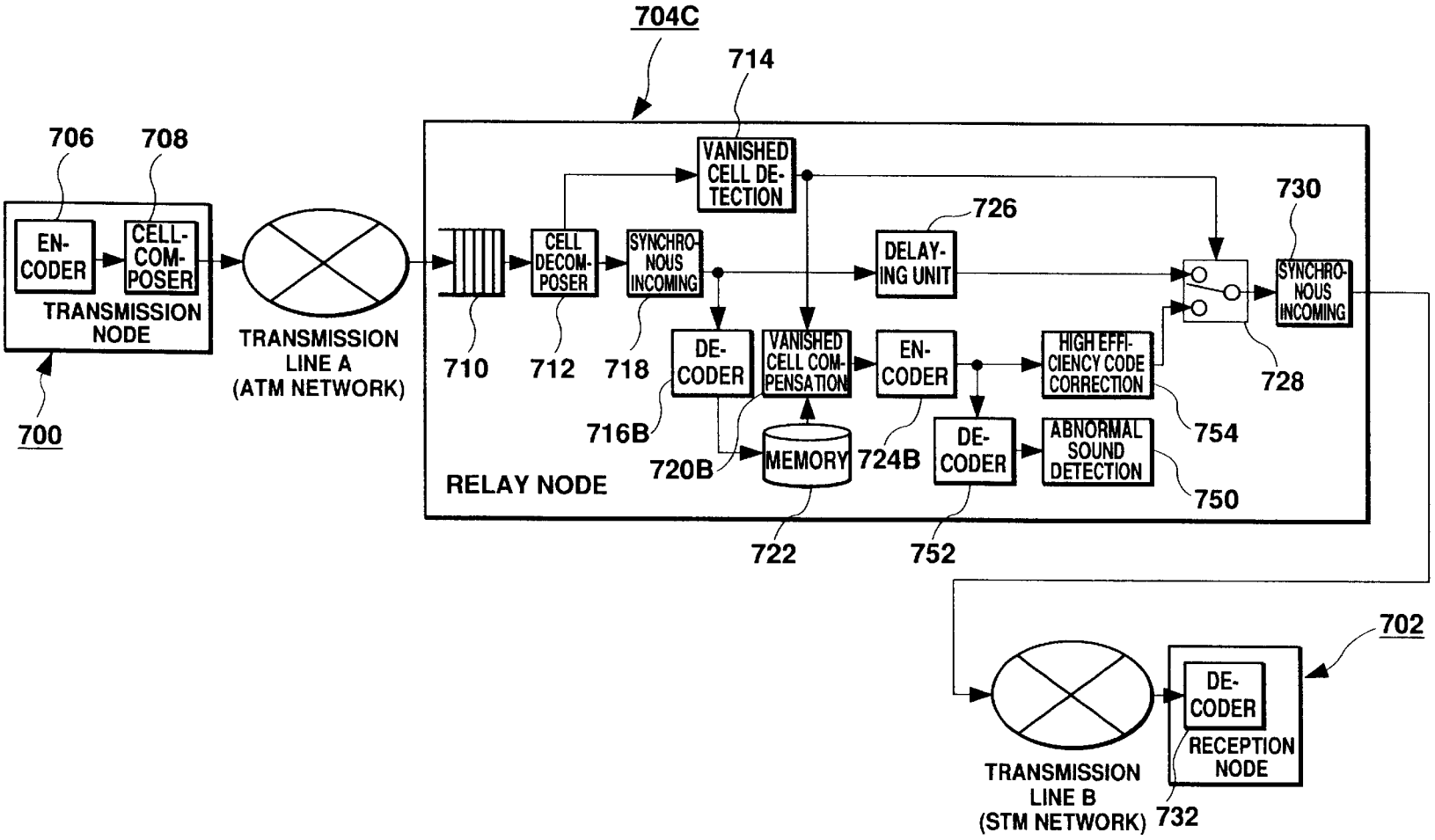
FIG. 31 is a block diagram of the voice coding-and-transmission system of the twenty-fourth embodiment.

The twenty-fourth embodiment of the present invention is described below by referring to the accompanying drawing. FIG. 31 is a block diagram of the voice coding-and-transmission system of this embodiment. The present embodiment is obtained by further improving the embodiment 23.

As described above, the vanished cell compensation processing using only the voice parameter which is a part of the voice signal information does not decode the voice entirely, and therefore exhibiting an effect such as relieving a processing load in embodiment 23. Apart from the advantage, in the vanished cell compensation using the voice parameter, an abnormal sound may be generated caused by a mismatch of internal statuses between the relay node 704 and the reception node 702 under the coding processing or the decoding processing.

An object of the relay node in the present embodiment is to prevent generating the abnormal sound in the regenerated voice at the reception node and to reduce a listener's discomfort by adding further functions to the relay node shown in FIG. 28.

In FIG. 31, components having corresponding functions to those of a component described for the above embodiment are provided with the same symbol as in FIGS. 27 and 28 and their description is not repeated. For a modified component, the character C is added to its symbol in FIGS. 27 and 28 so that correspondence of the component to the component of the above embodiment can be easily understood.

In FIG. 31, a generated abnormal sound detector (abnormal sound sensor) 750 monitors a voice signal outputted from a decoder (inspection decoder) 752 and detects the abnormal sound. A high efficiency coding corrector (voice code rectifier) 754 corrects a generated voice code in the encoder 724B by receiving a notice of the abnormal sound detection from the generated abnormal sound detector 750.

Operations of the present embodiment will be described referring to FIG. 31. The operations of the present embodiment is almost same as that of the embodiment 23 as is apparent from common configurations thereof shown in FIGS. 28 and 31. Descriptions of these same portions are not repeated and different operations will be described.

According to the present embodiment, further processing not existing in embodiment 23 is applied to a voice code obtained through a recoding processing of the encoder 724B. After compensation for the vanished cell from the encoder 724B, the voice code is inputted to the decoder 752. The decoder 752 has the same functions as the decoder 716, which is used as the relay decoder at the relay node 704 in the embodiment 22. However, in the relay node 704C, the decoder 752 is used for processing the inspection of the voice code after compensating for the vanished cell and has a different usage from the decoder 716. In the decoder 752, a voice signal is decoded based on a predetermined decoding algorithm. The decoded voice signal is inputted to the generated abnormal sound detector 750. The generated abnormal sound detector 750 detects the abnormal sound or a discomfort sound based on the voice signal.

One example of the abnormal sound or the discomfort sound is a click sound such as "bu" or "gya" (phonetic) in the regenerated sound generated by a leading edge in which the voice signal gain rapidly rises for a short time. Another example is a phenomena wherein the decoded sound is distorted by sudden description of the periodicity or continuity of a voice signal wave and the regenerated sound sounds harsh to a listener. In addition, a phenomenon where loud volume is decoded suddenly by an oscillation of a synthesis filter or a gain adaptive filter build in the decoder can be induced. The generated abnormal sound detector 750 detects a specific alternation in the voice signal that does not exist in a normal voice, and produces an alert signal. However, other methods for detecting the abnormal sound and the discomfort sound may be applied thereto.

Once the high efficiency code corrector 754 receives an alert signal from the generated abnormal sound detector 750, the corrector 754 corrects the voice code compensated the vanished cell. As an example of the correction processing, muting the voice signal by lowering a gain parameter in case of using the above-mentioned ITU Recommendation G.729 CS-ACELP method. Such correction processing can remarkably reduce a frequency of generating the abnormal sound and give no discomfort to the listener, which is suitable for a practical use, although high fidelity of the voice regeneration is somewhat sacrificed.

[Embodiment 25]

Figure 32:
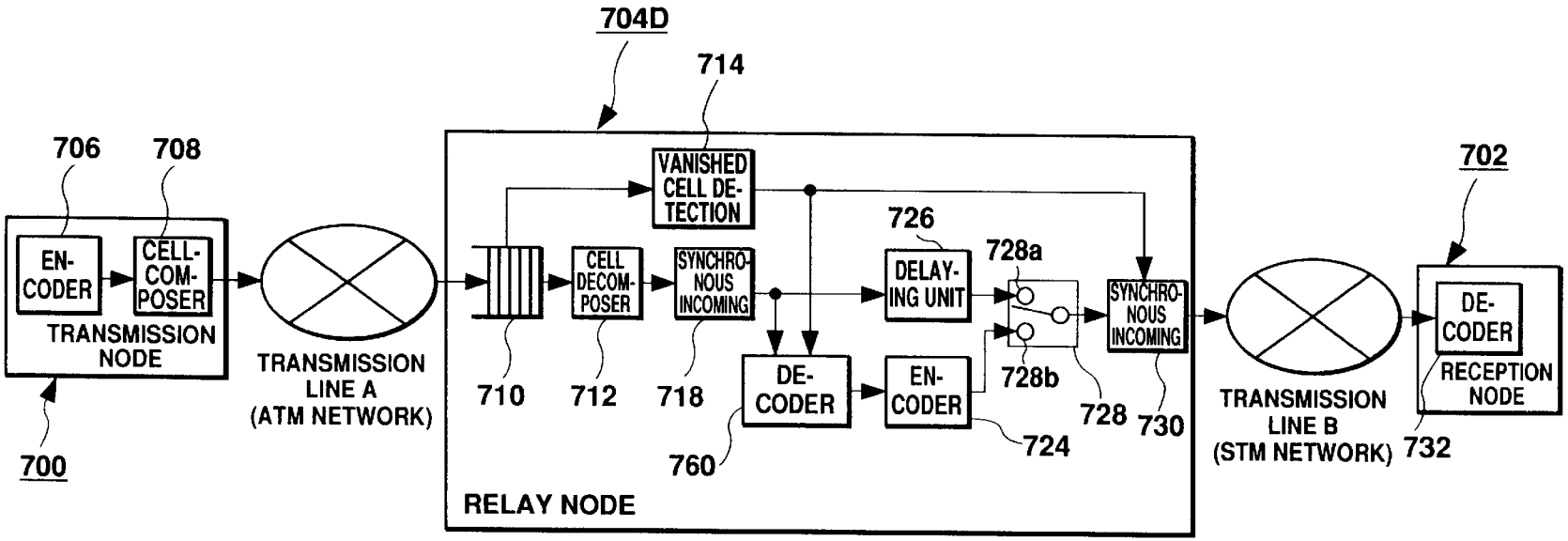
FIG. 32 is a block diagram of the voice coding-and-transmission system of the twenty-fifth embodiment.

The twenty-fifth embodiment of the present invention is described below by referring to the accompanying drawing. FIG. 32 is a block diagram of the voice coding-and-transmission system of this embodiment. The present embodiment is obtained by further improving the embodiment 22. In FIG. 32, a component having the same function as that of the component described for the above embodiment is provided with the same symbol and its description is not repeated. For a modified component, the character D is added to its symbol so that how the component corresponds to the component of the above embodiment can easily be understood.

In a relay node 704D in FIG. 32, a decoder 760 incorporates a decoding processing function corresponding to a coding algorithm adapted in the encoder 706 at the reception node 700 and a compensating processing function for burst vanishing of the coding data represented by the cell vanishing, thereby optimizing processing.

Operations of the present embodiment will be described referring to FIG. 32. The operations of the present embodiment is almost same as that of the embodiment 22 as apparent from common configurations thereof shown in FIGS. 27 and 32. Descriptions of corresponding portions are not repeated and different operations will be described.

Functions of the decoder 716 and the vanished cell compensator 720 in the embodiment 22 is performed by the decoder (relay decoder) 760. In other words, the decoder 760 has an vanished cell compensation function. When the relay control signal showing a result of detecting the cell vanishing as an output from the vanished cell detector 714 is inputted to the decoder 760, the decoder 760 performs a normal decoding processing and an vanished cell compensation processing as well. By operating the vanished cell compensation function build in the decoder 760, a degraded voice signal can be decoded if cell vanishing has occurred.

As a coding/decoding method including the vanished cell compensation function, for example, an ITU Recommendation G.727 Embedded ADPCM method, an ITU Recommendation G.728 Annex I method, or the like are cited. Detail algorithms thereof are described in ITU-T recommendation G.727, "5-, 4-, 3-, and 2 bits sample Embedded Adaptive Differential Pulse Code Modulation" and ITU-T Recommendation G.728 Annex I, "G.728 Decoder Modifications for Frame Erasure Concealment," respectively. The latter will be described as an example.

Figure 33:
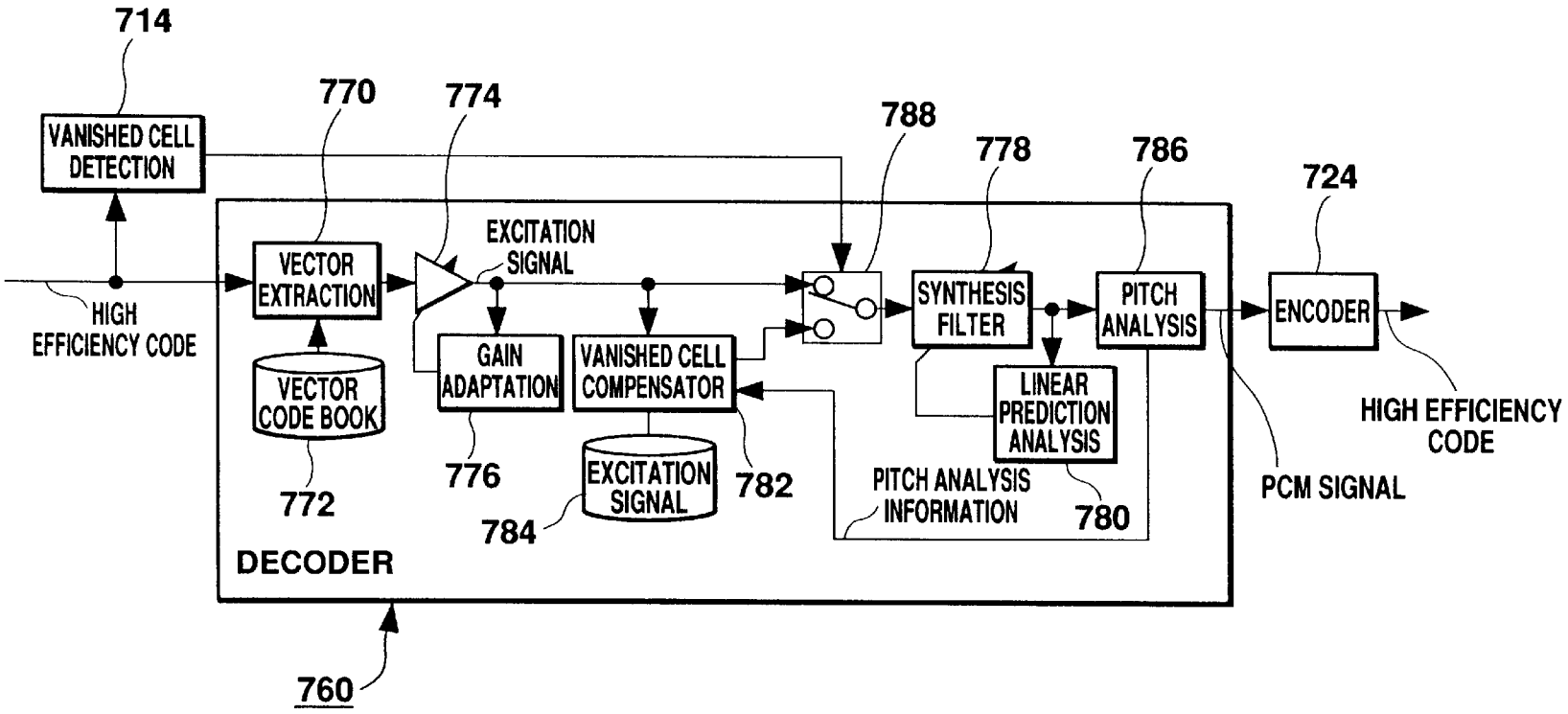
FIG. 33 is a block diagram of a processing system in a decoder based on an ITU Recommendation G.728 Annex I algorithm.

FIG. 33 is a block diagram showing a processing system in the decoder 760 based on the ITU Recommendation G.728 Annex I algorithm. The system performs decoding based on a normal ITU Recommendation G.728 LD-CELP algorithm under the normal condition. In other words, a vector extraction processing unit 770 extracts a waveform vector and a gain value index from the voice code inputted to the decoder 760 respectively, and retrieves and extracts an excitation signal vector from a vector code book 772 based on the index. A gain multiplier 774 multiply the extracted excitation signal vector by a gain value predicted adaptively in a gain adaptation unit 776. Thereafter, the excitation signal vector is provided to a synthesis filter 778. The synthesis filter 778 synthesizes a synthesis voice vector based on a coefficient determined adaptively in a linear prediction analyzer 780. The gain adaptation unit 776 and the linear prediction analyzer 780 perform a backward type adaptive processing by a procedure similar to the encoder, and determine a prediction gain and a synthesis filter coefficient, respectively. In addition, 144 sample nearest excitation signals outputted from the gain multiplier 774 are stored on the memory 784 against a processing of compensating the vanished cell information by extrapolating with an vanished cell compensator 782 when the cell is eliminated.

When the cell vanishing is detected and a normal high efficiency voice code is not inputted to the decoder 760, the vanished cell compensator 782 extrapolates based on a past excitation signal stored on the memory 784. The extrapolation processing is performed adaptively using an analyzed result in a pitch analyzing portion 786. In other words, in a voiceful portion of the voice signal, an excitation signal wave is to be a periodic pulse sound source, therefore a value of a long period prediction gain calculated in the pitch analyzing portion 786 is relatively large. The present system aims at the property. The vanished cell compensator 782 determines "voiceful" when the value of the long period prediction gain parameter exceeds a predetermined threshold value, extrapolates by repeating the excitation signal stored on the memory 784 using also the pitch cycle obtained through an analysis in the pitch analyzing portion 786, and compensates a blank period due to the cell vanishing. On the other hand, in a silent portion of the voice signal, the excitation signal does not exhibit the periodicity that the voiceful portion does, and is to be a predominant random waveform. The present system aimed at a noise of the excitation signal and uses the excitation signal rearranged randomly stored on the memory 407 as an extrapolation signal.

The relay control signal provided from the vanished cell detector 714 is used for controlling a selector switch 788 that a signal inputted to the synthesis filter 778 is switched to an excitation signal outputted from the gain multiplier 774 or to an excitation signal compensated by the vanished cell compensator 782. Under the normal condition, the selector switch 788 is switched so as to provide an unmodified output from the gain multiplier 774 to the synthesis filter 778. In contrast, under the abnormal condition that the cell is eliminated, the selector switch 788 is switched so as to provide an output from the vanished cell compensator 782 with the synthesis filter 778.

An output from the decoder 760 is sent immediately to the encoder 724 and is applied the coding processing. Operations thereafter is entirely same as that of the embodiment 22. According to the present embodiment, a system applied the ITU Recommendation G.728 Annex I is described as an example. However, it is understood that the present invention is not limited to a case using the coding system. The present invention can be applied to a system using any voice coding system capable of compensating and decoding a lost transmission signal in a burst mode such as the cell vanishing.

Moreover, in the above-described method of the present system, the parameter used for the vanished cell compensation is an internal parameter, which is not the voice code and the voice signal, generated in the course of the voice coding processing or the decoding processing. In such a method using the internal parameter, an interpolation method or an extrapolation method can be changed adaptively according to a voice status (voiceful or silent), thereby enabling high quality vanished cell compensation.

[Embodiment 26]

Figure 34:
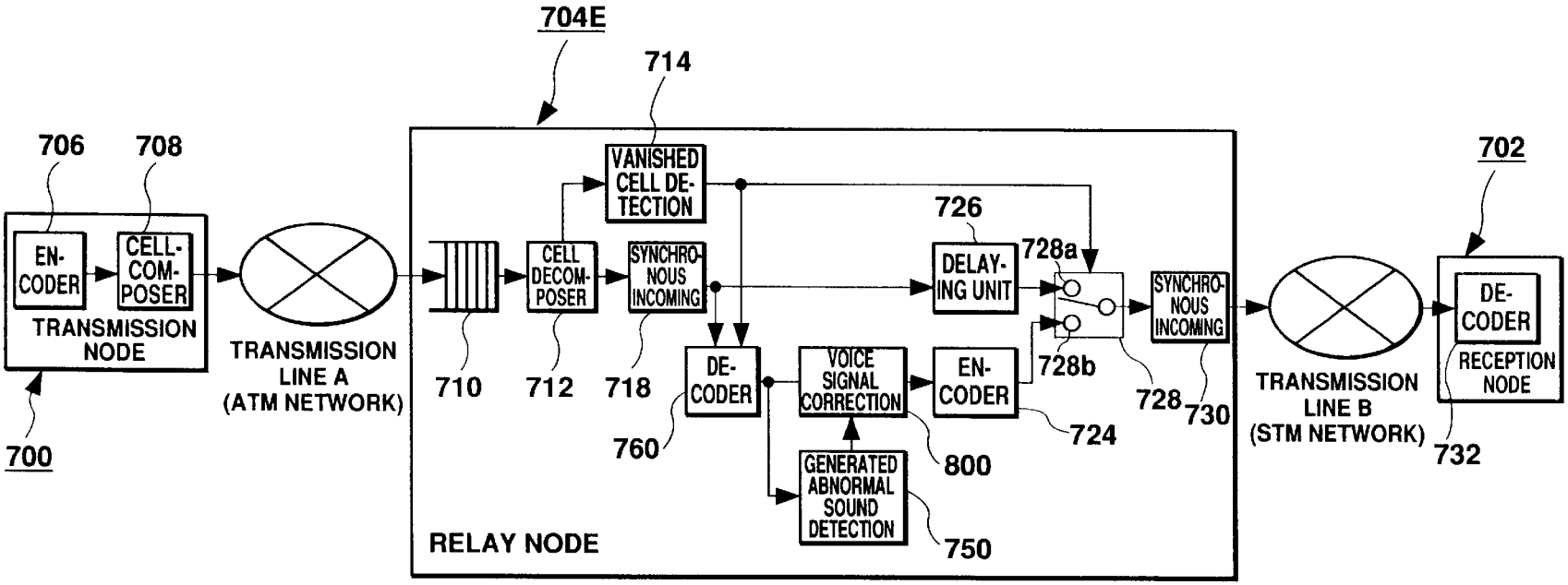
FIG. 34 is a block diagram of the voice coding-and-transmission system of the twenty-sixth embodiment.

The twenty-sixth embodiment of the present invention is described below by referring to the accompanying drawing. FIG. 34 is a block diagram of the voice coding-and-transmission system of this embodiment. In the present embodiment, a correction function for suppressing an abnormal sound is added to the relay node described in the embodiment 25. In FIG. 34, components having similar functions to components described in the above embodiment are provided with the same symbol and their description is not repeated. For a modified component, the character E is added to its symbol so that how the component corresponds to the component of the above embodiment can easily be understood.

In a relay node 704E in FIG. 34, the generated abnormal sound detector 750 receives a voice signal from the decoder 760, and detects the abnormal sound in the voice signal. A voice signal corrector (voice signal rectifier) 800 receives the abnormal sound detection from the generated abnormal sound detector 750, and corrects the voice signal from the decoder 760.

Operations of the present embodiment will be described referring to FIG. 34. The operations of the present embodiment is almost the same as that of the embodiment 25 as apparent from common configurations thereof shown in FIGS. 32 and 34. Descriptions of these same portions are not repeated and different operations will be described.

The present embodiment differs from embodiment 25 in that the voice signal is corrected using the generated abnormal sound detector 750 and the voice signal corrector 800 between the decoder 760 having the vanished cell compensation function and the decoder 724. The generated abnormal sound detector 750 produces an alert signal when detecting the abnormal sound and the discomfort sound in the voice signal inputted from the decoder 760. Once the voice signal corrector 800 receives the alert signal, the corrector 800 corrects the voice code through means such as gain suppression. Such correction processing can remarkably reduce abnormal sound generation, while causing no discomfort to the listener, thereby making this approach suitable for practical use, although high fidelity of the voice regeneration is somewhat sacrificed.

[Embodiment 27]

Figure 35:
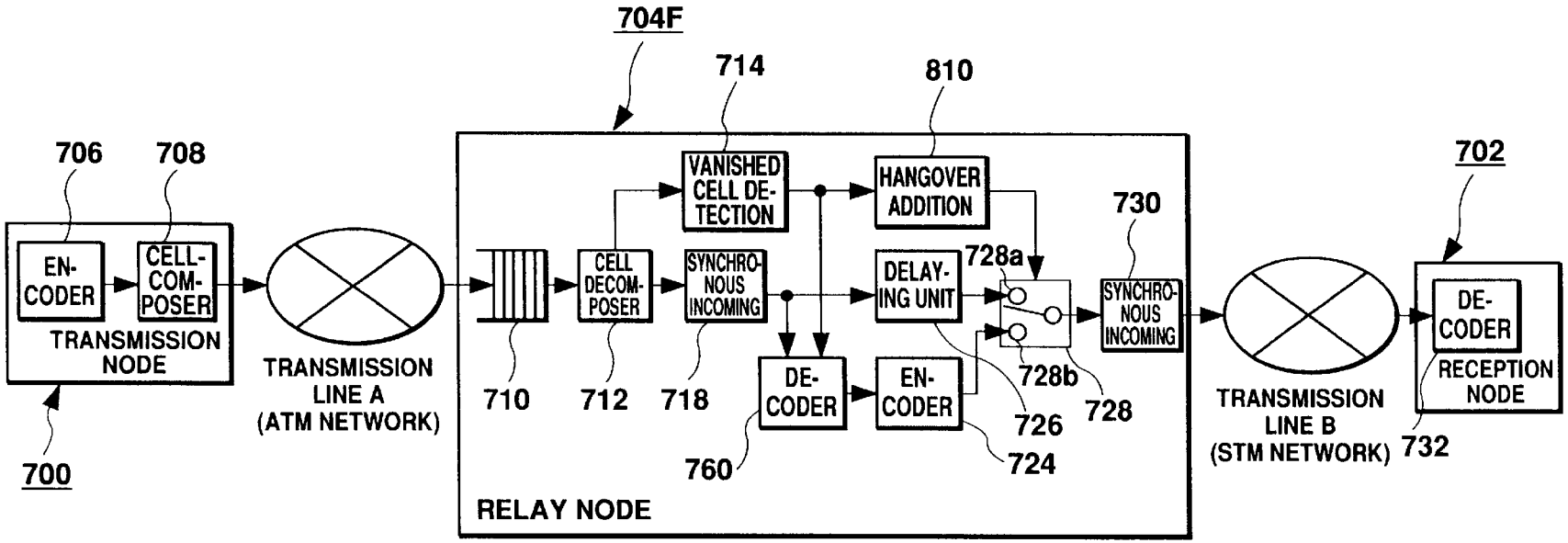
FIG. 35 is a block diagram of the voice coding-and-transmission system of the twenty-seventh embodiment.

The twenty-seventh embodiment of the present invention is described below by referring to the accompanying drawing. FIG. 35 is a block diagram of the voice coding-and-transmission system of this embodiment. The present embodiment is obtained by further improving the embodiment 25. In FIG. 35, a component having the same function as that of the component described for the above embodiment is provided with the same symbol and its description is not repeated. For a modified component, the character F is added to its symbol so that how the component corresponds to the component of the above embodiment can easily be understood.

In a relay node 704F in FIG. 35, a hangover adding unit (control signal delaying unit) 810 is a delaying unit for delaying the relay control signal outputted from the vanished cell detector 714, and is provided for delaying a signal of controlling an operation that the selector switch 728 is switched to the terminal 728*a*, in other words, to the digital one link connection.

Operations of the present embodiment will be described referring to FIG. 35. The operation of the present embodiment is almost the same as that of the embodiment 25, as apparent from common configurations thereof shown in FIGS. 32 and 35. Descriptions of these corresponding portions are not repeated and different operations will be described.

According to the present embodiment, the timing that the selector switch 728 is switched from the terminal 728*b* to the terminal 728*a*, in other words, the timing for switching from the tandem connection to the digital one link connection, is delayed to a return timing from "the abnormal condition (cell vanishing)" to "the normal condition (cell reception)" of determination in the vanished cell detector 714 by the hangover adding unit 810. In the embodiment 25, the selector switch 728 is switched from the terminal 728*b* to the terminal 728*a*, immediately after the determination in the vanished cell detector 714 is returned from "the abnormal condition" to "the normal condition."

The reason for delaying the return of the selector switch 728 to the digital one link connection mentioned above is described below. When the vanished cell detector 714 detects the cell vanishing, the decoder 760 and the encoder 724 compensate the coded voice information included in the vanished cell. However, completely restoring the eliminated voice code completely by a method such as extrapolation is impossible. Therefore, a mismatch occurs between internal statuses of the encoder 706 at the transmission node 700 and the decoder 732 at the reception node 702. In other words, immediately after the normal condition is restored after the time elapsed corresponding to the vanished cell, the internal statuses between the transmission node 700 and the reception node 702 may be mismatched. Accordingly, if the selector switch 728 is switched, and is returned to the digital one link immediately after the normal condition is restored, abnormal sound may be generated. For example, in a voice coding method using so called a backward adaptation represented by the coding method based on the ITU Recommendation G.728 that parameters such as an internal filter coefficient and a gain are adapted based on the past restored voice signal, it is known that past occurrences of mismatch of sending and a reception internal statuses directly affect the voice signal being decoded at present. Thus, if the selector switch 728 is switched immediately after the normal condition is restored, abnormal sound is thereby generated resulting in a low quality voice.

Consequently, in the present system, the selector switch 728 is kept at the terminal 728*b* for a while after the normal condition is restored to continue the tandem connection. Thus, by continuing the tandem connection, the internal statuses of the encoder 706 at the transmission node 700 and the decoder 732 at the reception node 702 are closed to each other. In other words, the relay voice code compensating for the vanished cell is closed to the original voice code receiving from the transmission node. When both internal statuses are sufficiently closed, switching the selector switch 728 prevents generation of the abnormal sound that is generated when the selector switch 728 is switched.

Moreover, a delay of switching timing to the digital one link as one feature of the present invention is explained by applying the relay node 704D of the embodiment 25 using the decoder 706 having the vanished cell compensation function. However, this feature can also be applied to other embodiments regarding other ATM-STM relay nodes, for example to the relay node 704 of the embodiment 22 and the relay node 704B of the embodiment 23 to exhibit similar abnormal sound suppression effect.

[Embodiment 28]

Figure 36:
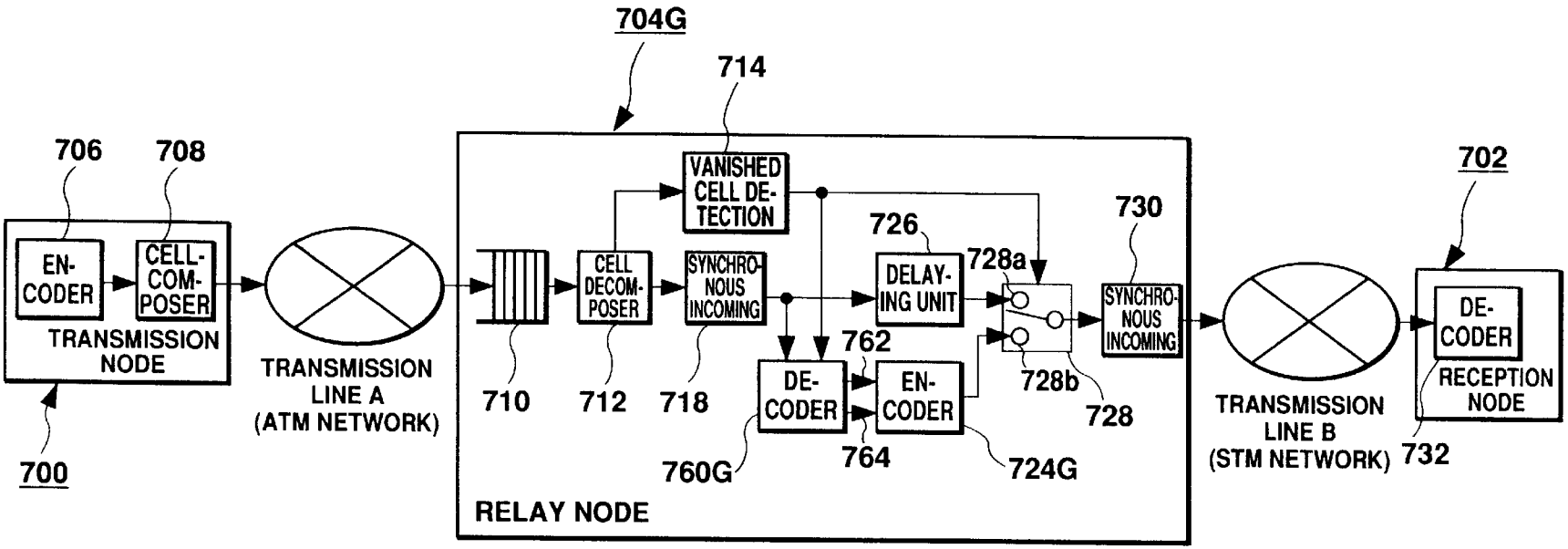
FIG. 36 is a block diagram of the voice coding-and-transmission system of the twenty-eighth embodiment.

The twenty-eighth embodiment of the present invention is described below by referring to the accompanying drawing. FIG. 36 is a block diagram of the voice coding-and-transmission system of this embodiment. The present embodiment is obtained by further improving the embodiment 25. In FIG. 36, components having the same function as those described for the above embodiment are provided with the same symbol and their description is not repeated. For a modified component, the character G is added to its symbol so that its correspondence to the component of the above embodiment can easily be understood.

In a relay node 704G in FIG. 36, a decoder 760G has the vanished cell compensation function similar to the decoder 760. The decoder 706G is different from the decoder 760 in view of outputting not only the voice signal 762, but also the coded voice parameter 764. The encoder 724G codes the voice signal utilizing the voice parameter from the decoder 760G.

Figure 37:
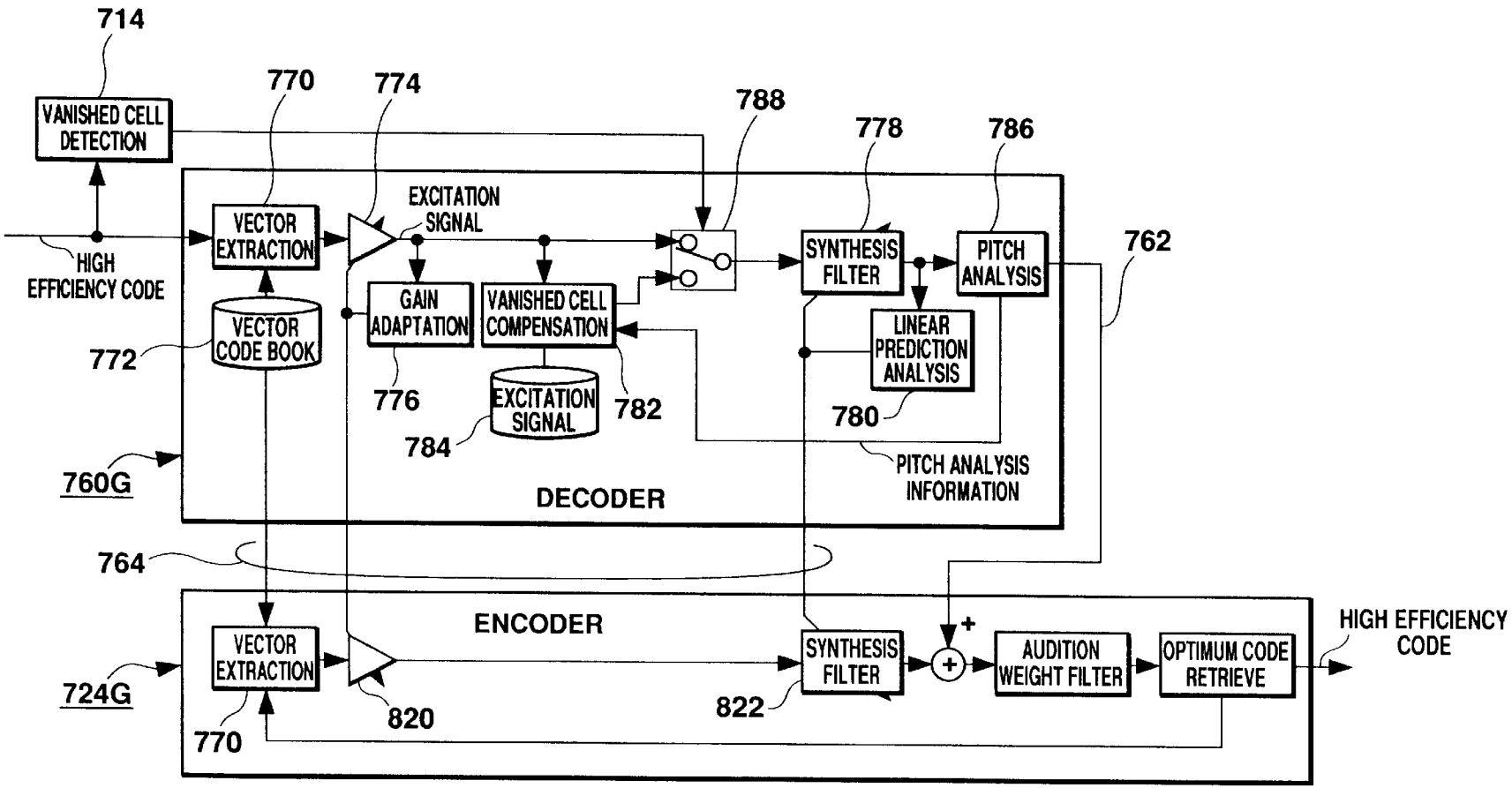
FIG. 37 is a block diagram showing one internal configuration in the decoder and the encoder included in the relay node of the twenty-eighth embodiment.

FIG. 37 is a block diagram showing one internal configuration of the decoder 760G and the encoder 724G included in the relay node 704G shown in FIG. 36.

Operations of the present embodiment will be described. The operations of the present embodiment is very similar to that of the embodiment 25 as apparent from common configurations thereof shown in FIGS. 32 and 36. Descriptions of these same portions are not repeated and specific operations will be described.

As described above, the decoder 760G sends the voice parameter that is the internal parameter thereof to the encoder 724G. FIG. 37 shows one example of a block configuration of the decoder 760G and the encoder 724G. A voice relay system using the aforementioned ITU Recommendation G.728 as the coding system is cited as an example, which is described referring to FIG. 37.

The decoder 760G and the encoder 724G perform the decoding processing and the coding processing respectively based on the same algorithm, therefore, the parameters used in both are basically common. In addition, values of these parameters are obtained by analyzing common voice signals. The values of both parameters are expected to be the same if quantization errors are ignored. For the ITU Recommendation G.728 coding method shown in FIG. 37, a value of an excitation gain provided to the gain multiplier 774 in the decoder 760G and a value of an excitation gain provided to a gain multiplier 820 in the encoder 724G may, strictly speaking, slightly differ, being affected by the quantization errors. However, these values are adapted with the same excitation signal and therefore are closed to each other very precisely. Similarly, a coefficient value of the synthesis filter 778 in the decoder 760G and a coefficient value of a synthesis filter 822 in the encoder 724 are adapted with a same voice signal and therefore are closed to each other.

In the present system, an adaptation operation of the parameter is executed at one side of either the decoder 760 or the encoder 724, and the rest of them processing is performed utilizing the resulting value. Thereby, the adaptation processing is reduced. In case of implementing the coding processing and the decoding processing, for example, using a multi-purpose processor such as a DSP, processing load and power consumption can be reduced.

Figure 39:
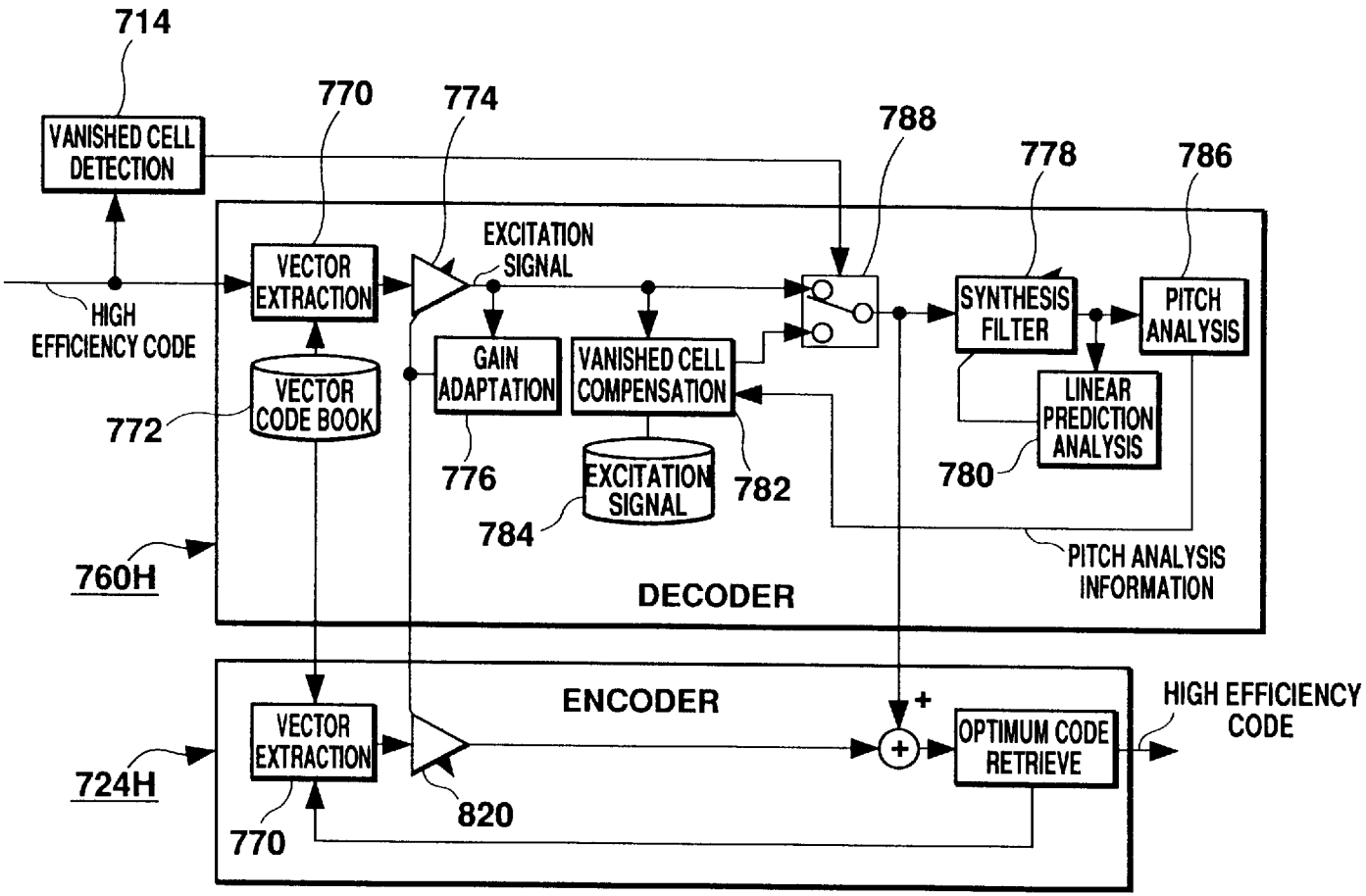
FIG. 39 is a block diagram showing one possible internal configuration in the decoder and the encoder included in the relay node of the twenty-ninth embodiment.

Concretely, the decoder 760G includes the gain adaptation unit 776, the vector code book 772, and the linear prediction analyzer 780 shown in FIG. 39. The excitation signal vector stored on the vector code book 772 is shared in each vector extractor 770 of the decoder 760G and the encoder 724G. In addition, the gain value predicted adaptively by the gain adaptation unit 776 is not only used at the gain multiplier 774 of the decoder 760G, but also provided to the gain multiplier 820 of the encoder 724G. Similarly, the coefficient determined in the linear prediction analyzer 780 is not only used at the synthesis filter 778 of the decoder 760G, but also provided to the synthesis filter 822 of the encoder 724G. The encoder 724G generates the high efficiency voice code using the parameter provided from the decoder 760G.

[Embodiment 29]

Figure 38:
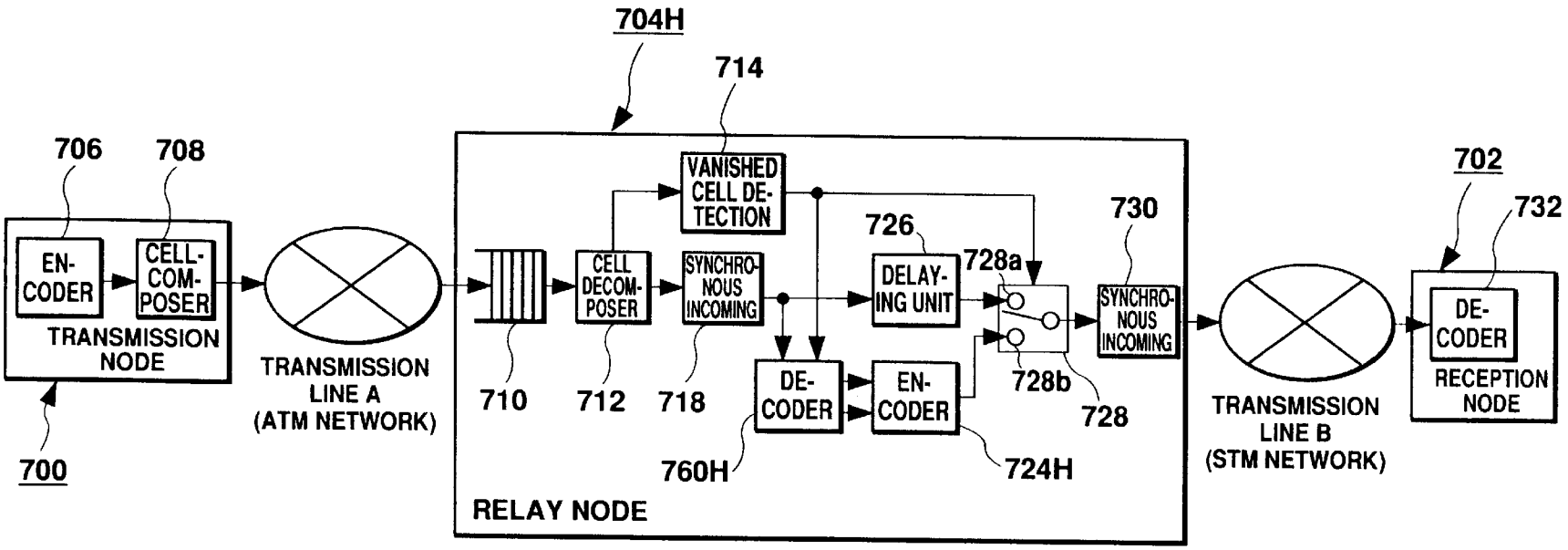
FIG. 38 is a block diagram of the voice coding-and-transmission system of the twenty-ninth embodiment.

The twenty-ninth embodiment of the present invention is described below by referring to the accompanying drawing. FIG. 38 is a block diagram of the voice coding-and-transmission system of this embodiment. The present embodiment is obtained by further improving the embodiment 28. An object of the present embodiment is to much lower the processing load at the relay node and to decrease the hardware size. In FIG. 38, a component having a corresponding function to one described in the above embodiment is provided with the same symbol and its description is not repeated. For a modified component, the character H is added to its symbol so that how the component corresponds to the component of the above embodiment can easily be understood.

In a relay node 704H in FIG. 38, a decoder 760H has the vanished cell compensation function similar to the decoder 760 and the decoder 760G. The decoder 706H is different from the decoder 760 and the decoder 760G in view of not outputting the voice signal and outputting only the voice parameter coded. The encoder 724H generates the voice code based on the voice parameter from the decoder 760H.

FIG. 39 is a block diagram showing one internal configuration of the decoder 760H and the encoder 724H included in the relay node 704H shown in FIG. 38.

Operations of the present embodiment will be described. The operations of the present embodiment are almost the same as that of the embodiments 25 and 28 as apparent from common configurations thereof shown in FIGS. 32, 36, and 38. Descriptions of these corresponding portions are not repeated and specific operations lain therebetween will mainly be described.

As described above, the decoder 760H sends the voice parameter that is an internal parameter thereof to an encoder 724H. FIG. 39 shows one example of a block configuration of the decoder 760H and the encoder 724H. A voice relay system using the aforementioned ITU Recommendation G.728 as the coding system is cited as an example, which is described referring to FIG. 39.

The G.728 method is for transmitting an excitation signal component corresponding to a human voice through vector quantization. Accordingly, it is not applicable that the voice cannot be coded unless the voice signal is decoded completely like the embodiment 28, theoretically. The present system utilizes the property. The decoder 760H outputs an excitation signal component extracted from the voice code, the encoder 724H codes the excitation signal component and the relay node 704H uses the coded component as an output when the cell is vanished. Moreover, the synthesis filter 778, the linear prediction analyzer 780 and the pitch analyzer 786 in FIG. 39 does not concerns directly with the extraction operation of the excitation signal. However, its existence is extremely important because parameters (long period prediction gain/pitch period or the like) obtained in relevant blocks thereof are needed for assuring a high quality compensation operation against the vanished cell.

In addition, according to the present method, the component corresponding to the voice parameter is directly quantized without using the synthesizing technique using an analysis, therefore quantization errors thereof may degrade the voice quality comparing to the system of the embodiment 28. On the other hand, the present system has more simplified structure and has an advantage of an easy realization comparing to the system of the embodiment 28. In other words, a processing amount is much lowered in the coding and decoding system as a processor. Compared to the system of the embodiment 24, the present system can improve the voice quality because the present system has a configuration that the vanished cell compensation function is built in the decoder 760H, thereby a method for compensating the vanished cell can be changed depending on the voice status being transmitted.

[Embodiment 30]

Figure 40:
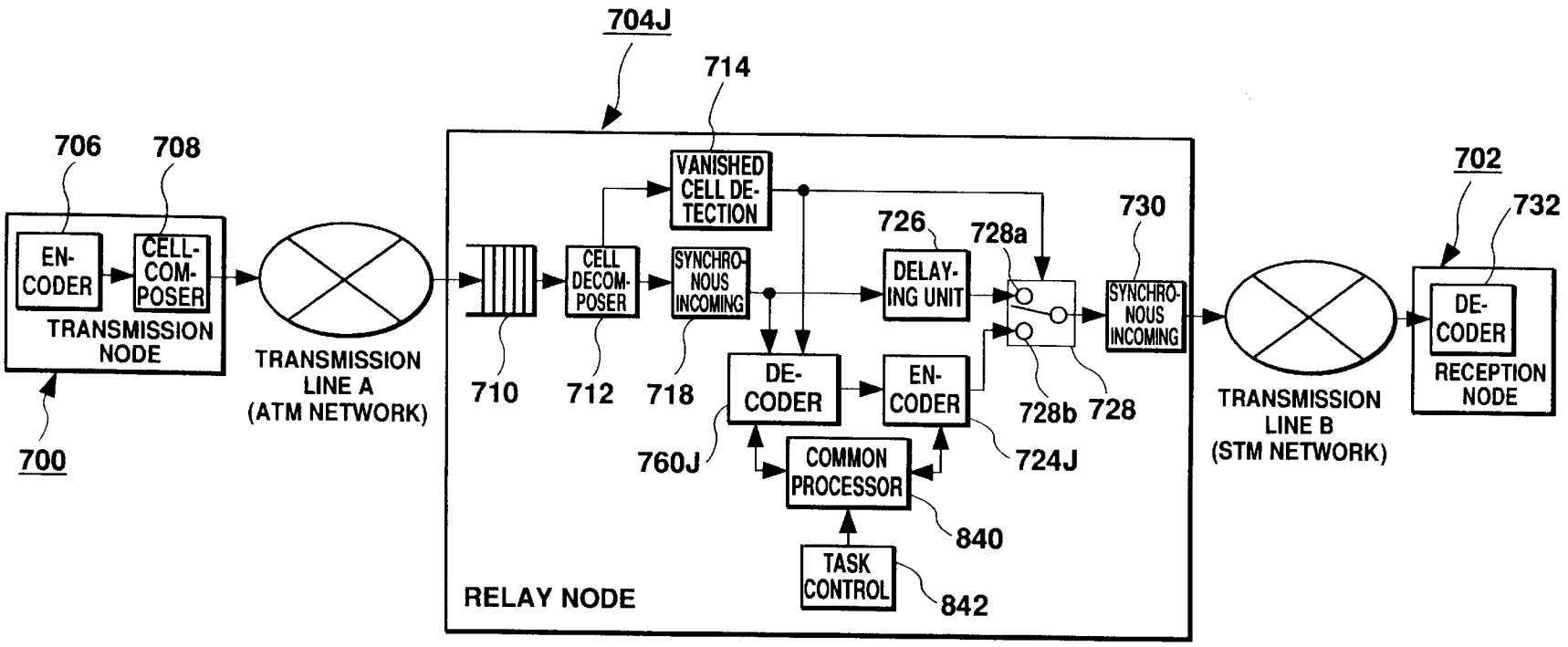
FIG. 40 is a block diagram of the voice coding-and-transmission system of the thirty embodiment.

The thirtieth embodiment of the present invention is described below by referring to the accompanying drawing. FIG. 40 is a block diagram of the voice coding-and-transmission system of this embodiment. The present embodiment is obtained by further improving the embodiment 28. In FIG. 40, a component having a corresponding function to one described in the above embodiment is provided with the same symbol and its description is not repeated. For a modified component, the character J is added to its symbol so that how the component corresponds to the component of the above embodiment can easily be understood.

In a relay node 704J in FIG. 40, a common processor 840 performs common internal processing for a decoder 760J and a encoder 724J. The decoder 760J and the encoder 724J perform the rest of the internal processing that subtracts the processing performed by the common processor 840 from processing of the decoder 760 and the encoder 724. The common processor 804 is connected to either one of the decoder 760J or the encoder 724J to provide its function. For switching the connection, a common processing switching unit (not shown in FIG. 40) is included thereto. A task controller (common processing controller) 842 is a controller for controlling the common processing switching unit.

Figure 41:
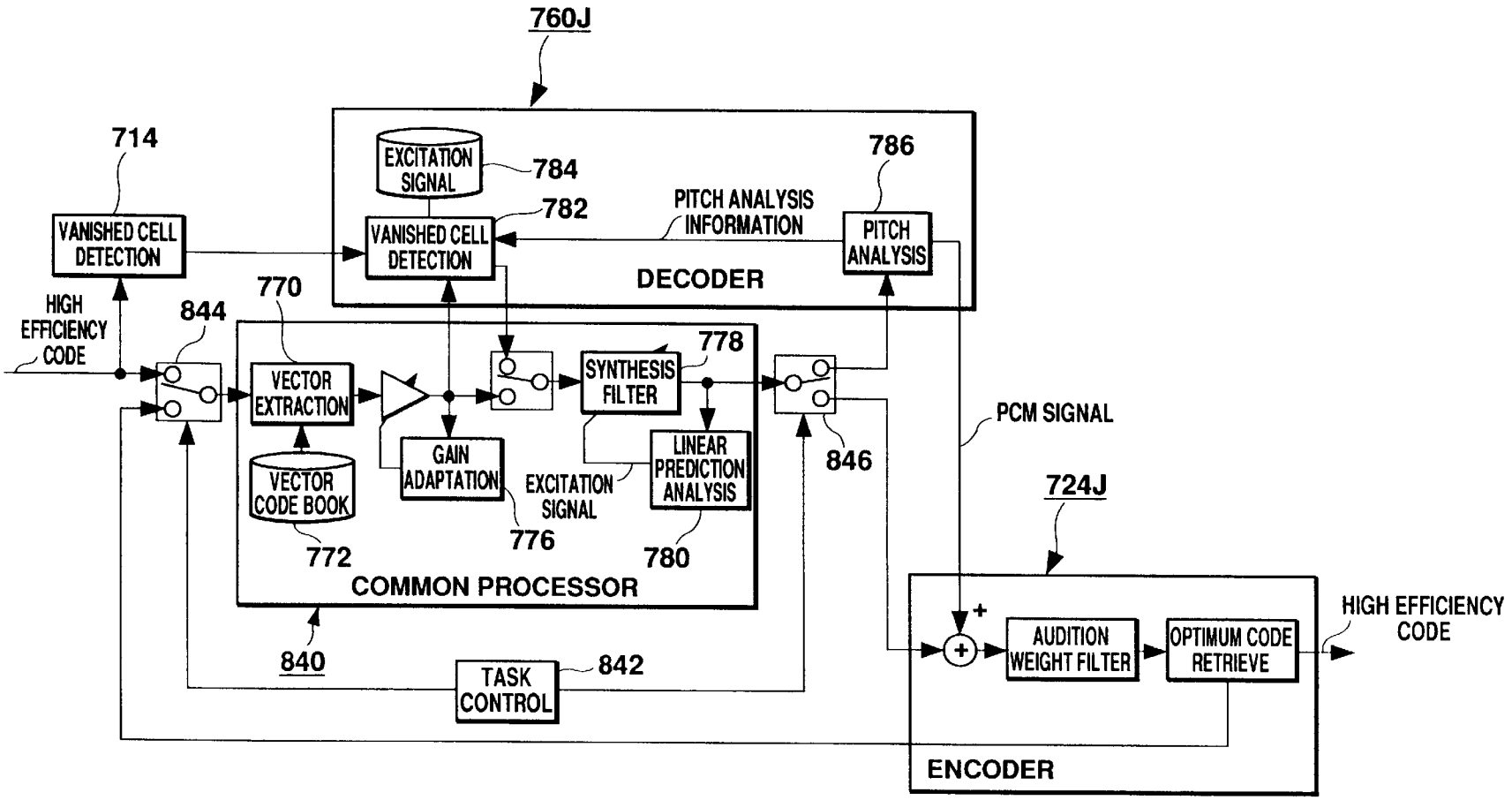
FIG. 41 is a block diagram showing one internal configuration in the decoder and the encoder included in the relay node of the thirtieth embodiment.

FIG. 41 is a block diagram showing one example of a detail construction of the decoder 760J, the encoder 724J and the common processor 840 included in the relay node 704J shown in FIG. 40. In FIG. 41, the aforementioned ITU Recommendation G.728 method is used as the coding method. The task controller 842 controls a switching of the common processing switching units 844, 846. By switching the common processing switching units 844, 846 and connecting the common processor 840 to the decoder 760J, the decoder 760J can perform the same functions as the decoder 760, then decodes the original voice code and compensate for the vanished cell to output a voice signal. The voice signal is inputted to the encoder 724J. Mating with the input timing, the task controller 842 switches the common processing switching units 844, 846, and connects the common processor 840 to the encoder 724J. Thereby, the encoder 724J can perform the same functions as the encoder 724, then code the inputted voice signal and generate the voice code to output the voice code.

In the ITU Recommendation G.728 method shown in FIG. 41, the common processor 840 includes, for example, the gain multiplier 774, the excitation gain adaptation unit 776, the synthesis filter 778 and the linear prediction analyzer 780.

According to the present system configuration, common parts of the coding processing and the decoding processing are unified in one module. Overlapping configuration in the processing portion can then be avoided, enabling to reductions hardware size.

[Embodiment 31]

Figure 42:
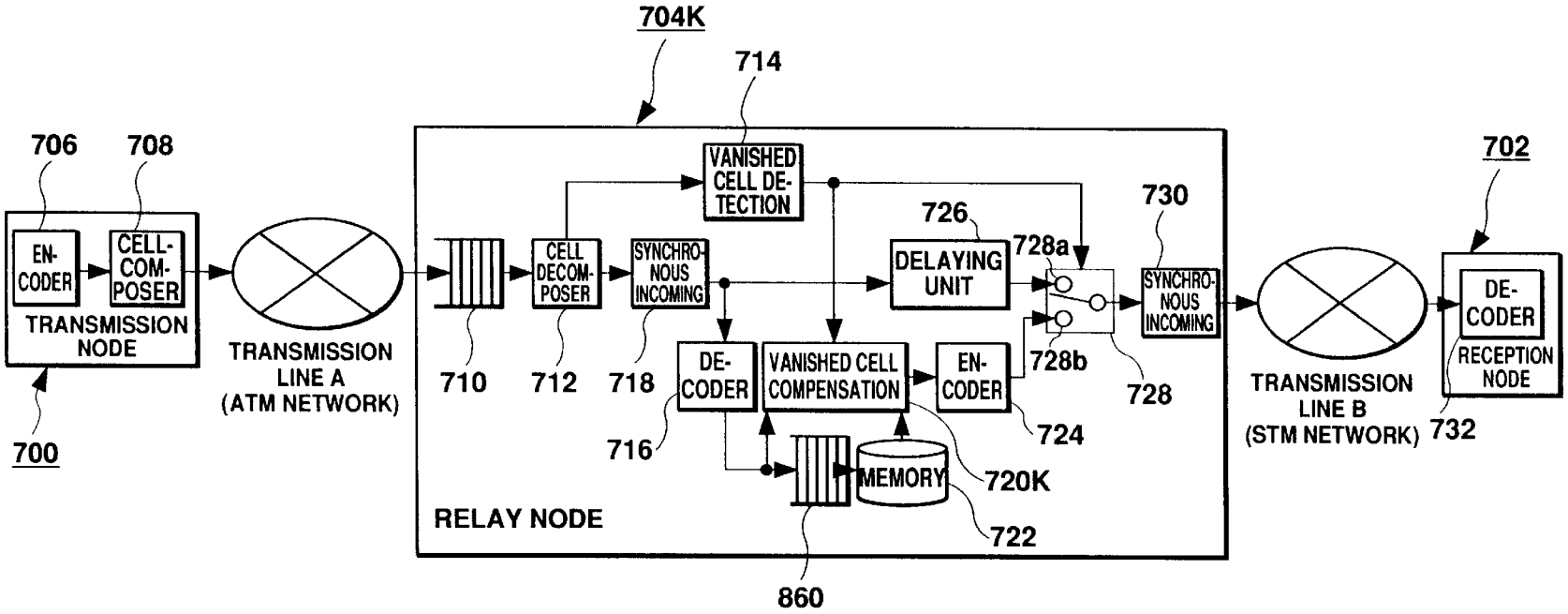
FIG. 42 is a block diagram of the voice coding-and-transmission system of the thirty-first embodiment.

The thirty-first embodiment of the present invention is described below by referring to the accompanying drawing. FIG. 42 is a block diagram of the voice coding-and-transmission system of this embodiment. In FIG. 42, a component having a corresponding function to one described in the above embodiment is provided with the same symbol and its description is not repeated. For a modified component, the character K is added to its symbol so that how the component corresponds to the component of the above embodiment can easily be understood.

In a relay node 704K in FIG. 42, a buffer (voice information delaying unit) 860 accumulated voice information from the decoder 716. The buffer has a size, for example, capable of accumulating the digital voice information of one cell. An vanished cell compensator 720K delays the compensation processing until the next cell is arrived after the vanished cell is detected. Namely, when the next cell is received normally, the vanished cell compensator 720K performs an interpolation processing to the vanished cell using both voice information included in a cell subsequent to the vanished cell and voice information accumulated in the buffer 860 before the vanished cell is detected, and compensates voice information included in the vanished cell. Therefore, in the present system, a transmission delay for one cell is generated in the relay node 704K. Consequently, a delay period of the delaying unit 726 must be increased for one cell according thereto.

According to the present system, the voice code in the vanished cell can be compensated for by interpolation instead of extrapolation, thereby realizing precise compensation processing.

[Embodiment 32]

Figure 43:
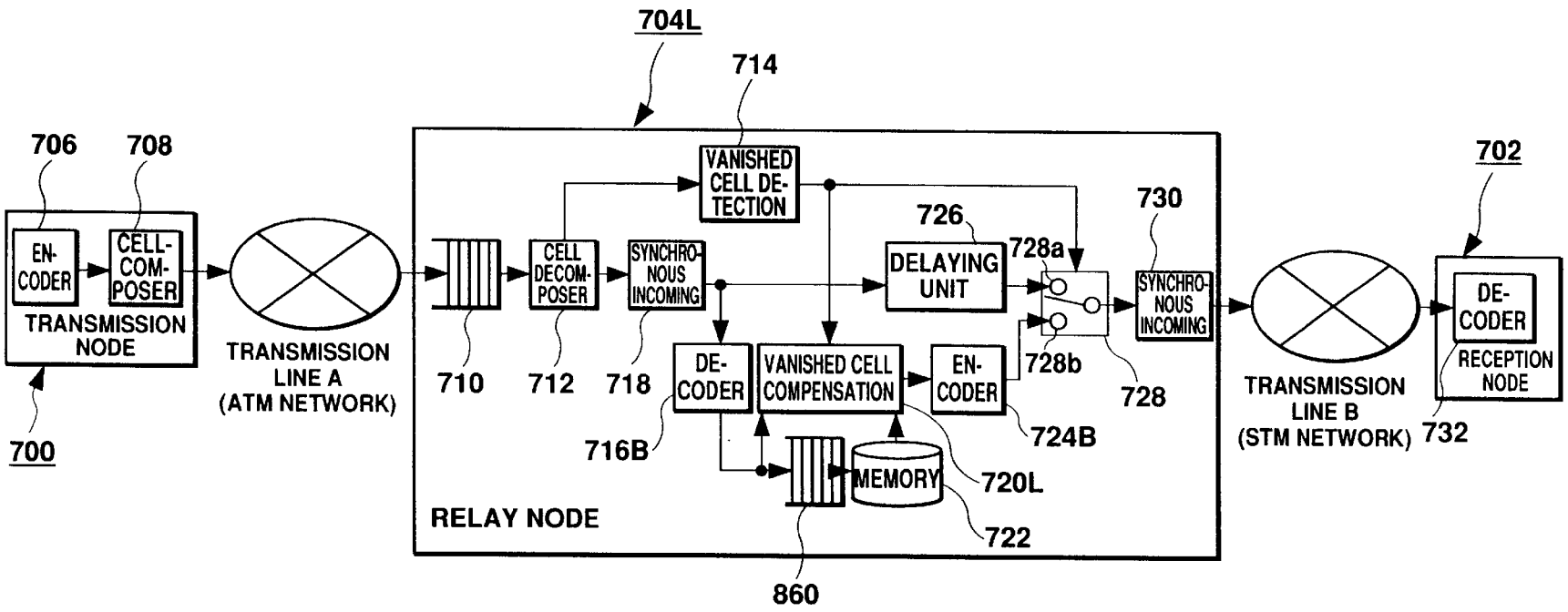
FIG. 43 is a block diagram of the voice coding-and-transmission system of the thirty-second embodiment.

The thirty-second embodiment of the present invention is described below by referring to the accompanying drawing. FIG. 43 is a block diagram of the voice coding-and-transmission system of this embodiment. In FIG. 43, a component having a corresponding function to a component described in the above embodiment is provided with the same symbol and its description is not repeated. For a modified component, the character L is added to its symbol so that how the component corresponds to the component of the above embodiment can easily be understood.

The present system is obtained by further improving the relay node 704B of the embodiment 23 by adding the improvement of the embodiment 31. An vanished cell compensator 720L compensates for the voice parameter corresponding to the voice code included in the vanished cell. Compensating by interpolation realizes a highly precise vanished cell compensation.

[Embodiment 33]

Figure 44:
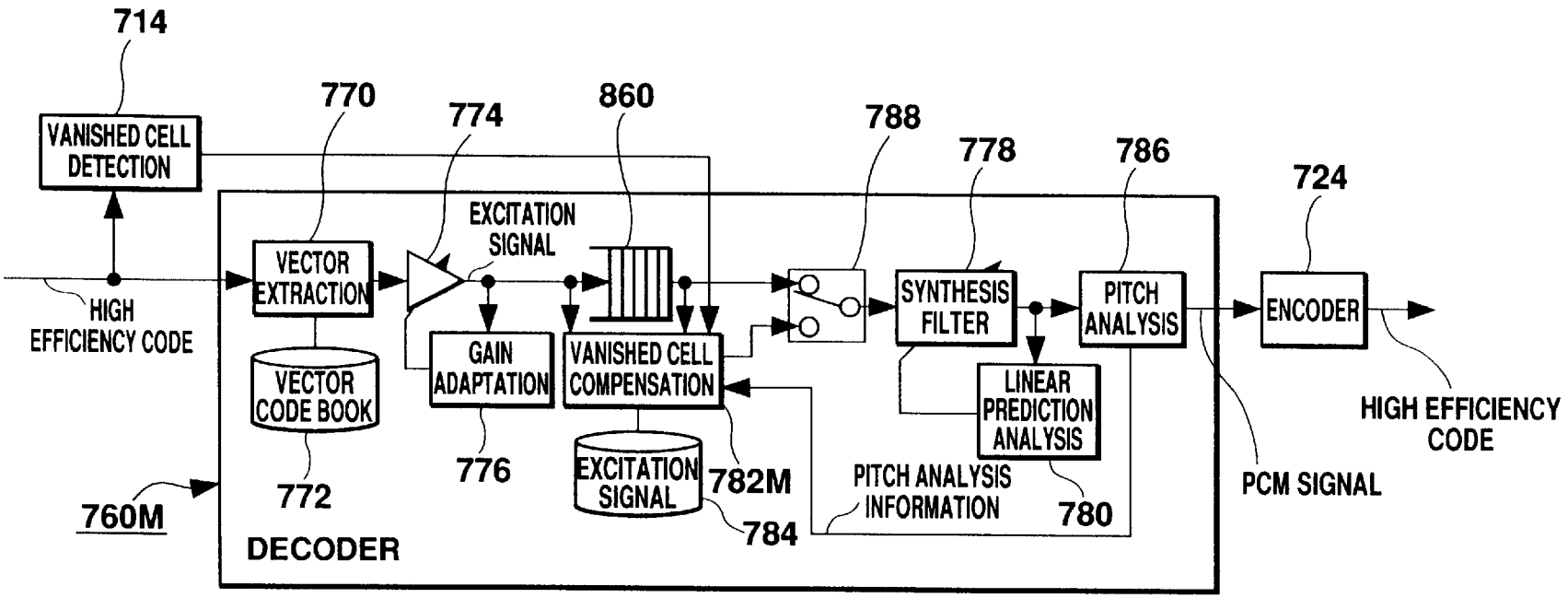
FIG. 44 is a block diagram showing a main portion in the relay node of the thirty-third embodiment.
Figure 45:
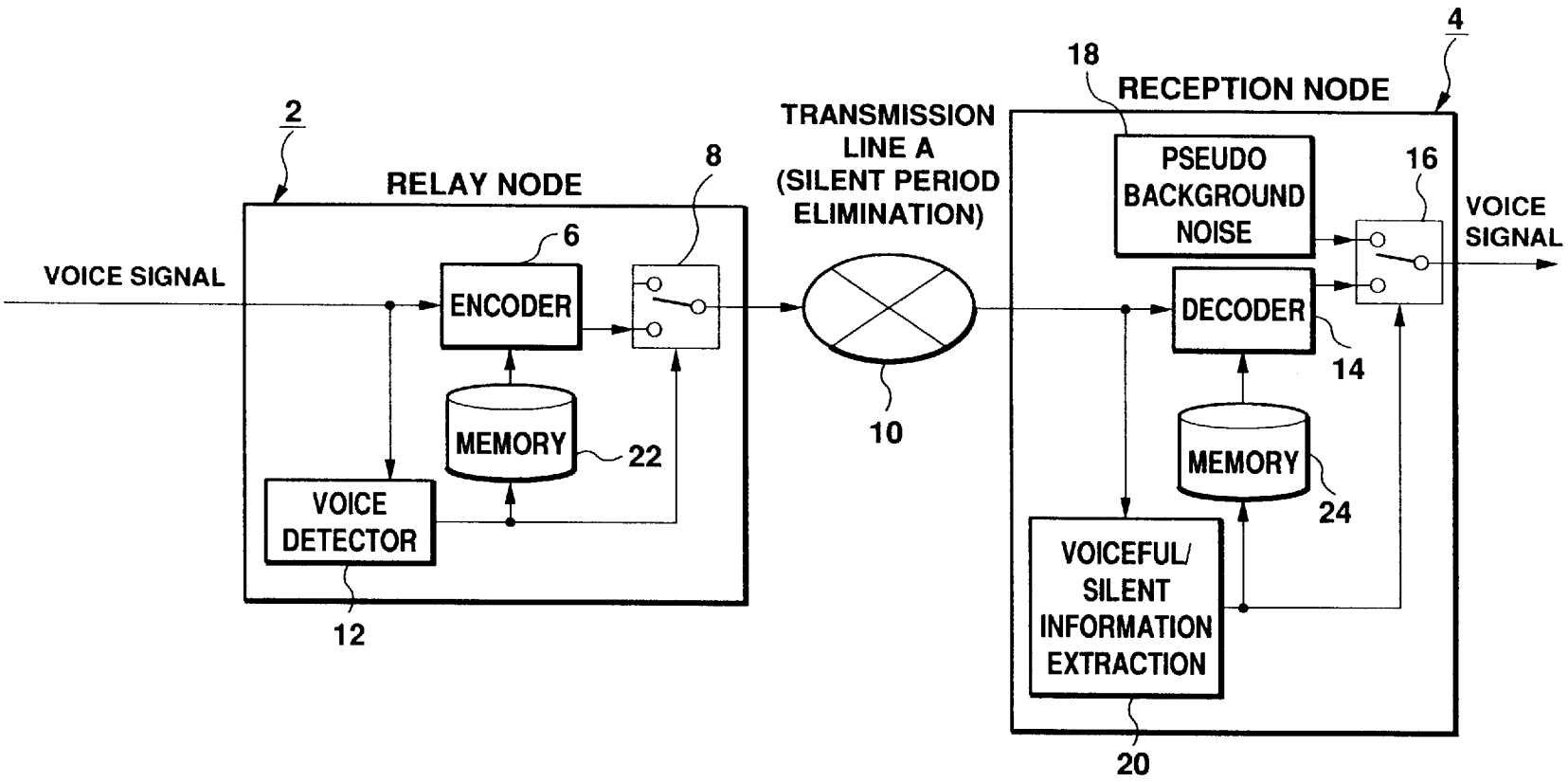
Fig. 45 PRIOR ART
FIG. 45 is a block diagram of a conventional voice coding-and-transmission system.
Figure 47:
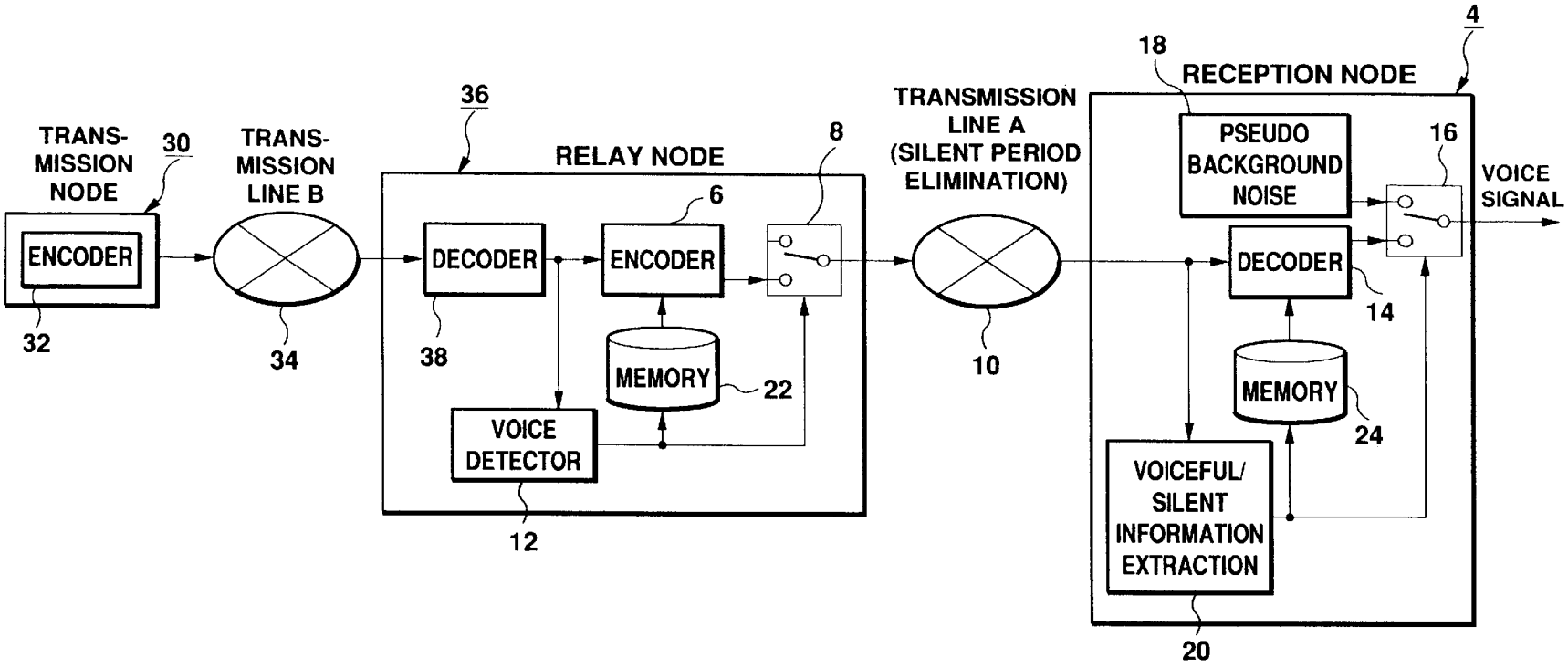
Fig. 47 PRIOR ART
FIG. 47 is a block diagram of a conventional voice coding-and-transmission system tandem-connected a silent-period-eliminating transmission network and a silent-period-not-eliminating transmission network.
Figure 48:
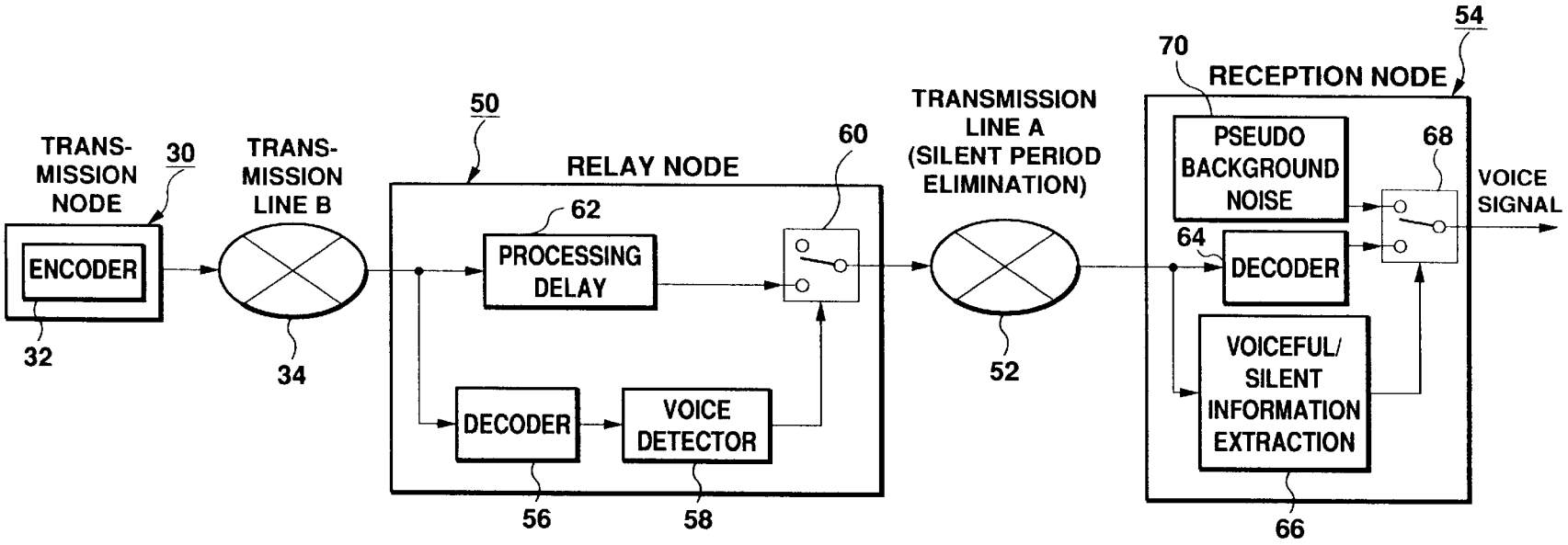
Fig. 48 PRIOR ART
FIG. 48 is a block diagram of a conventional voice coding-and-transmission system digital-one-link connected a silent-period-eliminating transmission network and a silent-period-not-eliminating transmission network.
Figure 49:
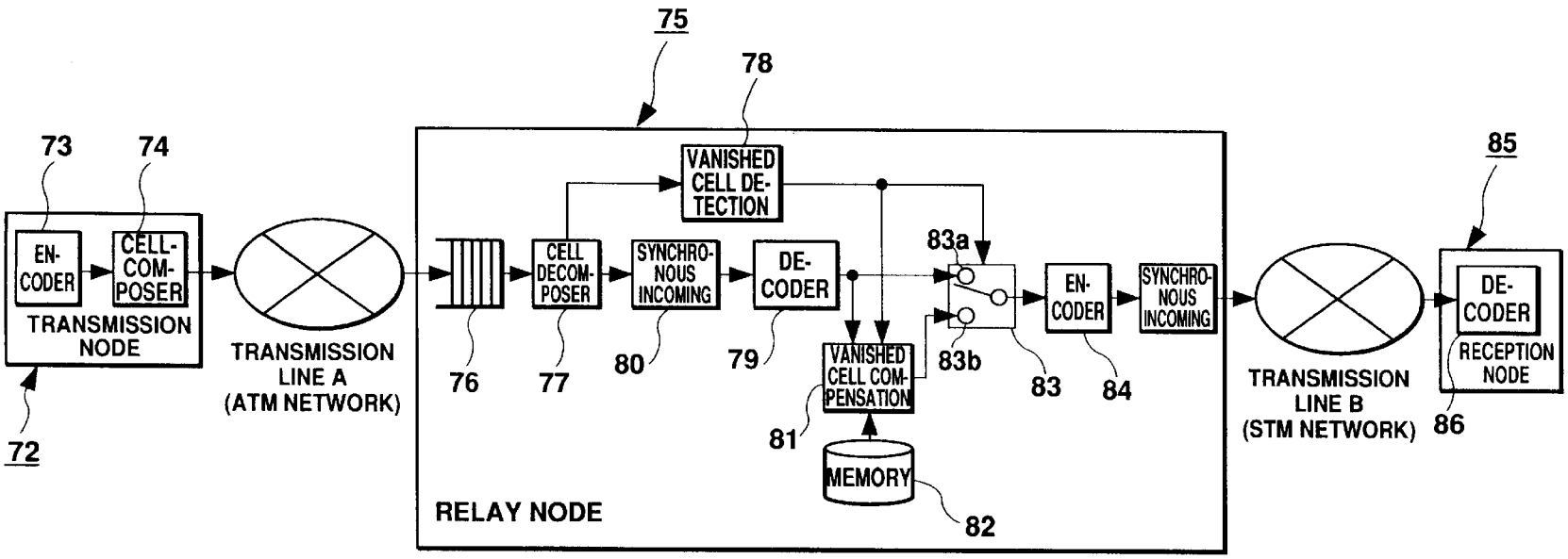
Fig. 49 PRIOR ART
FIG. 49 is a block diagram of a conventional transmission system tandem-connected an ATM network and a STM network.
Figure 50:
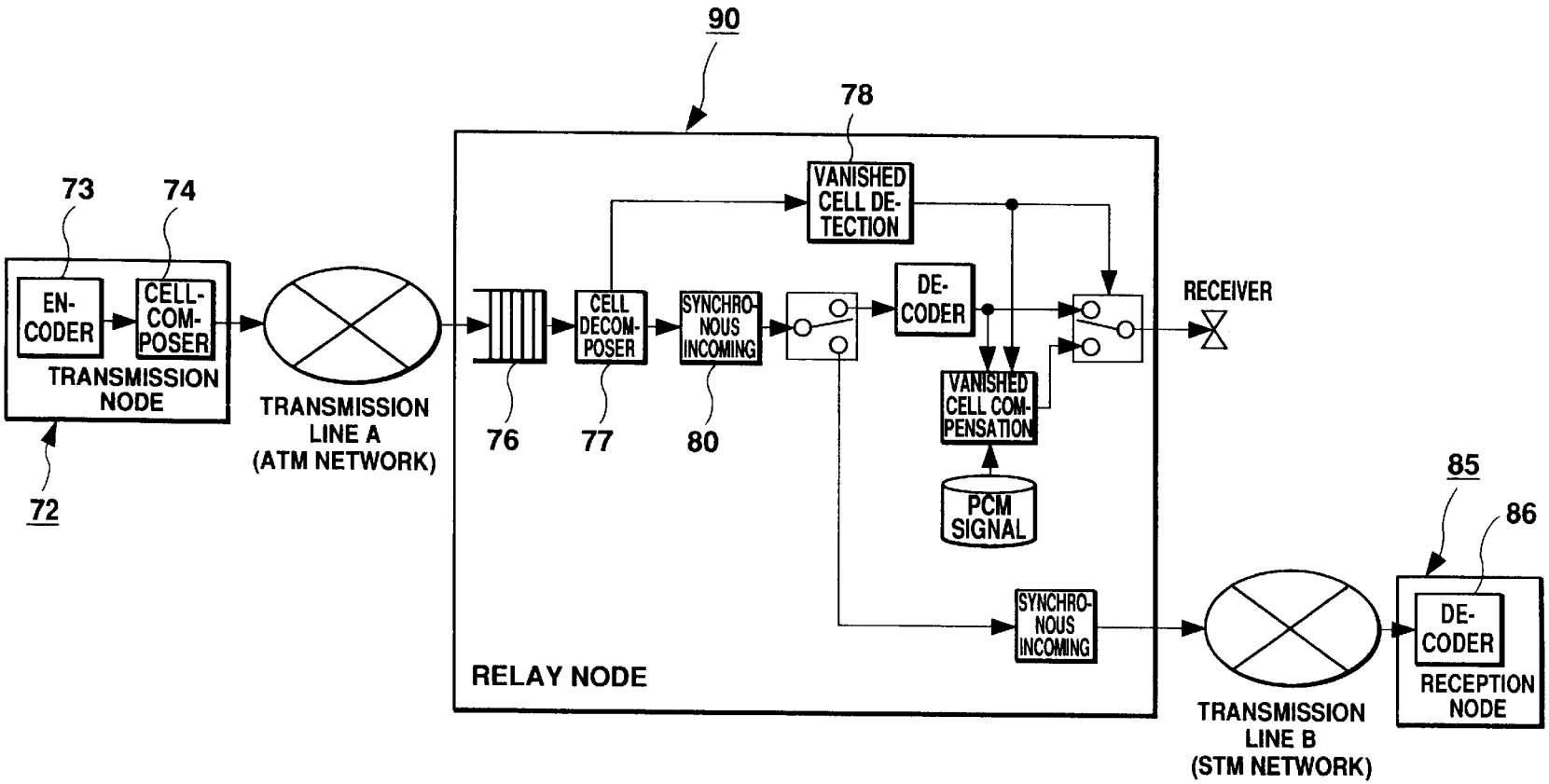
Fig. 50 PRIOR ART
FIG. 50 is a block diagram of a conventional transmission system digital-one-linked the ATM network and the STM network.

The thirty-third embodiment of the present invention is described below by referring to the accompanying drawing. FIG. 44 is a block diagram of the voice coding-and-transmission system of this embodiment. In FIG. 44, a component having a similar function to a component described in the above embodiment is provided with the same symbol and its description is not repeated. For a modified component, the character M is added to its symbol so that how the component corresponds to the component of the above embodiment can easily be understood.

The present system is obtained by further improving the relay node 704D of the embodiment 25 by adding the improvement of the embodiment 31, and compensates for the vanished cell through interpolation. In the present system, the buffer 860 is provided within a decoder 760M having the vanished cell compensation processing function. An vanished cell compensator 782M performs an interpolation processing using both of information inputted concurrently information included in a subsequent cell delayed by the buffer 860 and information included in a succeeding cell not delayed, and compensates voice information included in the vanished cell. Thus, compensation by interpolation realizes a very precise vanished cell compensation.

What is claimed is:

1. A voice coding-and-transmission system comprising: a transmission node for outputting an original voice code which is a voice code obtained by coding a voice signal to a first transmission line;

a relay node for performing silent period elimination by selecting only a voice code corresponding to a voiceful period of a voice signal in accordance with an original voice code received from said first transmission line and outputting it to a second transmission line; and a reception node for decoding a silent-period-eliminated voice code received from said second transmission line and outputting a voice signal; wherein said relay node includes:

a relay decoder for extracting voice information included in a voice signal from said original voice code;

a relay control circuit for discriminating between a voice period and a silent period of said voice signal in accordance with said voice information and outputting a relay control signal for controlling operations of a relay node in accordance with a discrimination result;

a coding reference value determination circuit for determining a reference value for said voice coding at the start of voicing which is the timing of the change from said silent period to said voiceful period in accordance with said relay control signal;

a relay encoder for starting said coding of said voice information in accordance with said reference value at the start of voicing and generating relay voice codes during at least a certain transient period; and a silent period elimination circuit for receiving said original voice code and said relay voice code and outputting said relay voice code during said transient period and said original voice code during a voice period after said transient period to said second transmission line in accordance with said relay control signal to synthesize said silent-period-eliminated voice code; and said reception node includes:

a reception control circuit for deciding the start of said voicing in accordance with said silent-period-eliminated voice code and outputting a reception control signal for controlling operations of a reception node in accordance with a discrimination result;

a decoding reference value determination circuit for determining a reference value for said decoding corresponding to said reference value for coding in accordance with said reception control signal at the start of said voicing; and a reception decoder for starting said decoding of said silent-period-eliminated voice code in accordance with said decoding reference value at the start of said voicing and outputting said voice signal.

2. The voice coding-and-transmission system according to claim 1, wherein said coding reference value determination circuit: includes a memory storing a predetermined reference value for said coding; and reads said reference value and uses it to set said relay encoder at the start of said voicing; and said decoding reference value determination circuit: includes a memory storing a predetermined reference value for said decoding;

and reads said reference value and uses it to set said reception signal decoder at the start of said voicing.

3. The voice coding-and-transmission system according to claim 1, wherein said relay encoder performs said coding by using voice parameters calculated by said relay decoder.

4. The voice coding-and-transmission system according to claim 1, wherein said relay decoder extracts only some of the voice parameters included in said voice signal;

said relay encoder performs said coding in accordance with an output of said relay decoder; and said relay control circuit discriminates between a voice period and a silent period of said voice signal in accordance with an output of said relay decoder.

5. The voice coding-and-transmission system according to claim 1, wherein said coding reference value determination circuit includes:

a pseudo-background-noise signal generator for outputting artificial noise; and a coded input switching unit for switching an input terminal of said relay encoder from said relay decoder to said pseudo-background-noise signal generator during said voice-signal silent period; and said decoding reference-value determination circuit includes:

a pseudo-background-noise signal generator;

a noise encoder for coding an output of said pseudo-background-noise signal generator; and a decoded input switching unit for switching an input terminal of said reception decoder from said second transmission line to said noise decoder.

6. The voice coding-and-transmission system according to claim 5, wherein said relay encoder performs said coding by using voice parameters calculated by said relay decoder.

7. The voice coding-and-transmission system according to claim 5, wherein said relay decoder extracts only some of the voice parameters included in said voice signal;

said relay encoder performs said coding in accordance with an output of said relay decoder; and said relay control circuit discriminates between a voice period and a silent period of said voice signal in accordance with an output of said relay decoder.

8. The voice coding-and-transmission system according to claim 1, wherein said coding reference value determination circuit has a task controller for controlling said relay encoder;

said decoding reference-value determination circuit has a task controller for controlling said reception decoder; and each of said task controllers stops said coding of each control object or decoding corresponding to said coding when said voice signal changes from a voice period to a silent period while making the coding or decoding hold its latest reference value, and restarts the processing of each control object when said voice signal changes from a silent period to a voice period.

9. The voice coding-and-transmission system according to claim 8, wherein said relay encoder performs said coding by using voice parameters calculated by said relay decoder.

10. The voice coding-and-transmission system according to claim 8, wherein said relay decoder extracts only some of the voice parameters included in said voice signal, said relay encoder performs said coding in accordance with an output from said relay decoder, and said relay control circuit discriminates between a voice period and a silent period of said voice signal in accordance with an output of said relay decoder.

11. A voice coding-and-transmission system comprising:

a transmission node for outputting an original voice code which is a voice code obtained by coding a voice signal to a first transmission line;

a relay node for performing silent period elimination by selecting only a voice code corresponding to a voice period of a voice signal in accordance with an original voice code received from said first transmission line and outputting it to a second transmission line; and a reception node for decoding a silent-period- eliminated voice code received from said second transmission line and outputting a voice signal; wherein said relay node includes:

a relay decoder for extracting voice information included in a voice signal from said original voice code;

a relay control circuit for discriminating between a voice period and a silent period of said voice signal in accordance with said voice information and outputting a relay control signal for controlling operations of a relay node in accordance with a discrimination result;

a voice code corrector for outputting a corrected voice code obtained by replacing the original voice code of a portion of a voice signal output from said reception node with a voice code for suppressing abnormal sound when said abnormal sound may be produced in said portion in accordance with said voice information; and a silent-period-elimination circuit for receiving said original voice code and said corrected voice code, outputting said corrected voice code within a predetermined transient period from the start of voicing which is the timing of the change from said silent period to said voiceful period and said original voice code during a voiceful period after said transient period to said second transmission line in accordance with said relay control signal to synthesize said silent-period-eliminated voice code.

12. The voice coding-and-transmission system according to claim 11, wherein said relay decoder extracts only some of the voice parameters included in said voice signal, said voice code corrector outputs said corrected voice code in accordance with an output of said relay decoder, and said relay control circuit discriminates between a voiceful period and a silent period of said voice signal in accordance with an output of said relay decoder.

13. A voice coding-and-transmission system comprising:

a transmission node for outputting an original voice code which is a voice code obtained by coding a voice signal to a first transmission line;

a relay node for performing silent period elimination by selecting only a voice code corresponding to a voiceful period of a voice signal in accordance with an original voice code received from said first transmission line and outputting it to a second transmission line; and a reception node for decoding a silent-period-eliminated voice code received from said second transmission line and outputting a voice signal; wherein said voice code includes a gain code made to correspond to gain information in voice information in accordance with a codebook which is a table for correlating a quantized gain value and a gain code, said relay node includes:

a relay decoder for extracting voice information included in a voice signal from said original voice code;

a relay control circuit for discriminating between a voiceful period and a silent period of said voice signal in accordance with said voice information and outputting a relay control signal for controlling operations of said relay node in accordance with a discrimination result;

a first suppression codebook;

a relay encoder for performing coding of said voice information by obtaining a gain code from said suppression codebook; and silent-period elimination circuit for receiving said original voice code and said relay control signal, outputting a relay voice code within a predetermined transient period from the start of voicing which is the timing of the change from said silent period to said voiceful period and said original voice code during a voiceful period after said transient period to said second transmission line in accordance with said relay control signal to synthesize said silent-period-eliminated voice code; and said reception node includes:

a reception control circuit for deciding the start of said voicing in accordance with said silent-period-eliminated voice code and outputting a reception control signal for controlling operations of said reception node in accordance with a decision result;

a second suppression codebook;

a standard codebook which is the same as the codebook used in said relay node; and a reception decoder connecting with said second suppression codebook within a predetermined transient period from the start of voicing and with said standard codebook after said transient period, performing said decoding of said voice signal by obtaining said gain information from these codebooks to output said voice signal; and the quantized gain values of said suppression codebooks are suppressed in comparison with the quantized gain values of said standard codebooks.

14. The voice coding-and-transmission system according to claim 13, wherein said relay encoder performs said coding by using voice parameters calculated by said relay decoder.

15. The voice coding-and-transmission system according to claim 13, wherein said relay decoder extracts only some of the voice parameters included in said voice signal, said relay encoder performs said coding in accordance with an output of said relay decoder, and said relay control circuit discriminates between a voiceful period and a silent period of said voice signal in accordance with an output of said relay decoder.

16. A voice coding-and-transmission system comprising:

a transmission node for outputting an original voice code which is a voice code obtained by coding a voice signal to a first transmission line;

a relay node for performing silent period elimination by selecting only a voice code corresponding to a voice period of a voice signal in accordance with an original voice code received from said first transmission line and outputting it to a second transmission line; and a reception node for decoding a silent-period-eliminated voice code received from said second transmission line and outputting a voice signal; wherein said reception node includes:

a reception control circuit for discriminating between start of voicing and end of voicing in accordance with said silent-period-eliminated voice code and outputting a reception control signal for controlling operations of a reception node in accordance with a discrimination result;

a voice code corrector for outputting a corrected voice code obtained by replacing a silent-period-eliminated voice code of a portion of a voice signal output from said reception node with a voice code for suppressing abnormal sound when said abnormal sound may be produced;

a decoded input selector for receiving said silent-period-eliminated voice code and said corrected voice code and outputting said corrected voice code within a predetermined transient period from the start of said voicing and said silent-period-eliminated voice code until said voicing terminates after said transient period; and a reception decoder for applying said decoding corresponding to said coding to an output of said decoded input selector and outputting said voice signal.

17. A voice coding-and-transmission system comprising:

a transmission node for outputting an original voice code which is a voice code obtained by coding a voice signal to a first transmission line;

a relay node for performing silent period elimination by selecting only a voice code corresponding to a voice period of a voice signal in accordance with an original voice code received from said first transmission line and outputting it to a second transmission line; and a reception node for decoding a silent-period-eliminated voice code received from said second transmission line and outputting a voice signal; wherein said relay node includes:

a relay decoder for extracting voice information included in a voice signal from said original voice code;

a relay control circuit for discriminating between a voice period and a silent period of said voice signal in accordance with said voice information and outputting a relay control signal for controlling operations of a relay node in accordance with a discrimination result;

a relay encoder for coding voice information at the present time in accordance with said voice information and generating a relay voice code; and a silent-period elimination circuit for receiving said original voice code and said relay voice code and outputting said relay voice code within a predetermined transient period from the start of voicing which is the timing of the change from said silent period to said voiceful period and said original voice code during a voiceful period after said transient period to said second transmission line in accordance with said relay control signal to synthesize said silent-period-eliminated voice code; and said reception node includes:

a reception control circuit for deciding the start of said voicing in accordance with said silent-period-eliminated voice code;

a first reception decoder for decoding said original voice code and outputting said voice signal;

a second reception decoder for decoding said relay voice code and outputting said voice signal;

a reference-value adapting section for differential-coding a voice signal output from said second reception decoder to output the voice signal to said first reception decoder and updating the reference value for said differential coding of said first reception decoder; and a decoder switching circuit for connecting said second reception decoder to said second transmission line during said transient period and said first reception decoder to said second transmission line until said voicing terminates after said transient period in accordance with said reception control signal.

18. The voice coding-and-transmission system according to claim 17, wherein said relay encoder is a quantizer for converting said voice information to quantized data, and said second reception decoder is an inverse quantizer for regenerating a voice signal from said quantized data.

19. A voice coding-and-transmission system comprising:

a transmission node for outputting an original voice code which is a voice code obtained by coding a voice signal to a first transmission line;

a relay node for performing silent period elimination by selecting only a voice code corresponding to a voice period of a voice signal in accordance with an original voice code received from said first transmission line and outputting it to a second transmission line; and a reception node for decoding a silent-period-eliminated voice code received from said second transmission line and outputting a voice signal; wherein said relay node includes:

a relay decoder for extracting voice information included in a voice signal from said original voice code;

a relay control circuit for discriminating between a voice period and a silent period of said voice signal in accordance with said voice information and outputting a relay control signal for controlling operations of a relay node in accordance with a discrimination result;

a delay circuit for delaying said original voice code by a predetermined delay time; and a silent-period elimination circuit for outputting said original voice code from said delay circuit to said second transmission line to perform said silent-period elimination during said voiceful period in accordance with said relay control signal; wherein said reception node includes:

a reception control circuit for deciding said start of voicing in accordance with said silent-period-eliminated voice code and outputting a reception control signal for controlling operations of said reception node in accordance with a decision result; and a reception decoder for applying said decoding corresponding to said coding to said silent-period-eliminated voice code and outputting said voice signal.

20. The voice coding-and-transmission system according to claim 19, wherein said reception node includes:

a pseudo-background-noise signal generator for outputting pseudo background noises which are artificial noises, and a reception output switching unit for selecting an output source from a reception node and outputting pseudo background noises from said pseudo-background-noise signal generator until said delay time passes after the start of said silent-period-eliminated voice code and thereafter outputting a voice signal from said reception decoder.

21. The voice coding-and-transmission system according to claim 19, wherein said reception node has a muting unit for muting outputs of said reception decoding means until said delay time passes after the start of said silent-period-eliminated voice code.

22. A voice coding-and-transmission system comprising:

a transmission node for outputting an original voice code which is a voice code obtained by coding a voice signal to a first transmission line;

a relay node for performing silent period elimination by selecting only a voice code corresponding to a voice period of a voice signal in accordance with an original voice code received from said first transmission line and outputting it to a second transmission line; and a reception node for decoding a silent-period-eliminated voice code received from said second transmission line and outputting a voice signal; wherein said relay node includes:

a relay decoder for extracting voice information included in a voice signal from said original voice code in accordance with a reference value for the decoding corresponding to said coding;

a relay control circuit for discriminating between a voice period and a silent period of said voice signal in accordance with said voice information and outputting a relay control signal for controlling operations of a relay node in accordance with a discrimination result;

a reference state encoder for outputting a reference state code obtained by coding the reference value of said relay decoder; and a silent-period elimination circuit 664 for receiving an original voice code output from said delay circuit and said reference state code and outputting said state code within said delay time from the start of voicing which is the timing of change from said silent period to said voiceful period and said original voice code after said delay time passes to synthesize said silent-period-eliminated voice code; wherein said reception node includes:

a reception control circuit for deciding the start of said voicing in accordance with said silent-period-eliminated voice code and outputting a reception control signal for controlling operations of a reception node in accordance with a decision result;

a reference state decoder for decoding said reference state code and outputting said reference value; and a reception decoder for starting said decoding of said silent-period-eliminated voice code in accordance with said reference value and outputting said voice signal.

23. A voice coding-and-transmission system comprising: a transmission node for performing a high-efficiency coding of a voice signal, dividing an original voice code obtained thereby to compose a cell, and outputting said cell to an asynchronous transfer mode transmission line;

a relay node for decomposing said cell received from said asynchronous transfer mode transmission line, extracting said original voice code therefrom, and outputting said original voice code synchronously to a synchronous transfer mode transmission line; and a reception node for decoding said original voice code received from said synchronous transfer mode transmission line, and outputting said voice code, wherein said relay node includes:

a relay control circuit for detecting cell vanishing in said asynchronous transfer mode transmission line from said received cell, and outputting a relay control signal for controlling operations of said relay node in accordance with a detection result;

a voice code repairing portion for compensating said original voice code which is lost due to said cell vanished based on said original voice code received, and generating a relay voice code;

and an output switching unit for switching outputs of said original voice code and said relay voice code in said synchronous transfer mode transmission line based on said relay control signal, outputting said relay voice code when detecting said cell vanishing and outputting said original voice code when detecting no said cell vanishing.

24. The voice coding-and-transmission system according to claim 23, wherein said voice code repairing portion includes:

a relay decoder for extracting voice information included in said voice signal from said original voice code;

a vanished cell compensator for compensating said voice information included in said vanished cell based on said voice information outputted from said relay decoder, and producing compensated voice information; and a relay encoder for performing said high-efficiency coding of said compensated voice information and producing said relay voice code.

25. The voice coding-and-transmission system according to claim 24, wherein said relay decoder extracts only a part of voice parameter included in said voice signal;

and said vanished cell compensator compensates said voice information of said vanished cell based on an output from said relay decoder.

26. The voice coding-and-transmission system according to claim 25, wherein said relay node includes:

an inspection decoder for decoding said relay voice code, an abnormal sound detector for detecting an abnormal sound component included in an output voice signal of said inspection decoder; and a voice code corrector for correcting said relay voice code inputted when detecting said abnormal sound component and outputting said relay voice code, and wherein said output switching unit switches and outputs said original voice code and said relay voice code outputted from said voice code corrector.

27. The voice coding-and-transmission system according to claim 24, wherein said voice code repairing portion includes a voice information delaying unit for delaying said voice information outputted from said relay decoder for a predetermined period, and wherein said vanished cell compensator obtains said voice information included in said vanished cell with an interpolation processing based on precedent voice information outputted from said voice information delaying unit and preceded said vanished cell and succeeding voice information succeeded said vanished cell.

28. The voice coding-and-transmission system according to claim 27, wherein said relay decoder extracts only a part of said voice parameter included in said voice signal from said original voice code, wherein said voice information delaying unit delays said output of said relay decoder, wherein said vanished cell compensator performs said interpolation processing based on said voice parameter, and wherein said relay encoder performs said high-efficiency coding based on said output of said vanished cell compensator.

29. The voice coding-and-transmission system according to claim 23, wherein said voice code repairing portion includes:

a relay decoder for extracting voice information included in said voice signal from said original voice code, compensating adaptively voice information included in said vanished cell based on said voice information received, and producing compensated voice information; and a relay decoder for performing said high-efficiency coding to said compensated voice information and producing said relay voice code.

30. The voice coding-and-transmission system according to claim 29, wherein said relay decoder outputs said voice signal as said compensated voice information, wherein said voice code repairing portion further includes:

an abnormal sound detector for detecting said abnormal sound component included in said output voice signal of said relay decoder, and a voice signal corrector for correcting and outputting said output voice signal when detecting said abnormal sound component, and wherein said relay encoder transforms said voice signal outputted from said voice signal corrector into said relay voice code.

31. The voice coding-and-transmission system according to claim 29, wherein said relay node includes a control signal delaying unit for delaying a timing of said relay control signal, wherein said output of said output switching unit is switched from said relay voice code to said original voice code for a predetermined period from a termination of a period corresponding to said vanished cell.

32. The voice coding-and-transmission system according to claim 29, wherein said relay encoder performs said high-efficiency coding utilizing said voice parameter calculated with said relay decoder.

33. The voice coding-and-transmission system according to claim 29, wherein said relay decoder extracts only a part of said voice parameter included in said voice signal from said original voice code, and wherein said relay encoder performs said high-efficiency coding based on said output of said relay decoder.

34. The voice coding-and-transmission system according to claim 23, wherein said voice code repairing portion includes:

a common processor for performing common processings of a relay decoding and repairing processings for extracting said voice information included in said voice signal from said original voice code, compensating adaptively said voice information included in said vanished cell based on said voice information received, and producing said compensated voice information, and of a relay encoding processing for performing said high-efficiency coding to said compensated voice information and producing said relay voice code, a relay decoder for performing an inherent processing to said relay decoding and repairing processings, a relay encoder for performing an inherent processing to said relay encoding processing, a common processing switching unit for switching a connection of said common processing unit to said relay decoder and to said relay encoder, and a common processing controller for controlling said common processing switching unit, and wherein said relay decoder performs said relay decoding and repairing processings using said common processing unit and outputs said compensated voice information, and wherein said relay encoder performs said relay coding processing using said common processing unit and outputs said relay voice code.

35. The voice coding-and-transmission system according to claim 29, wherein said relay decoder obtains said voice information included in said vanished cell with an interpolation processing based on precedent voice information preceded said vanished cell and succeeding voice information succeeded said vanished cell.

* * * * *